US010406068B2

(12) United States Patent
Lurie et al.

(10) Patent No.: US 10,406,068 B2
(45) Date of Patent: Sep. 10, 2019

(54) LOCKABLE HEAD UP CARDIOPULMONARY RESUSCITATION SUPPORT DEVICE

(71) Applicant: Keith G. Lurie, Minneapolis, MN (US)

(72) Inventors: Keith G. Lurie, Minneapolis, MN (US); Kanchana Sanjaya Gunesekera Karunaratne, Escondido, CA (US); Joseph Manno, La Jolla, CA (US); John P. Grimm, Santee, CA (US); Casimir A. Sienkiewicz, Minneapolis, MN (US); Robert R. Roberts, III, St. Paul, MN (US)

(73) Assignee: Keith G. Lurie, Minneapolis, MN (US)

( * ) Notice: Subject to any disclaimer, the term of this patent is extended or adjusted under 35 U.S.C. 154(b) by 0 days.

(21) Appl. No.: 15/285,063

(22) Filed: Oct. 4, 2016

(65) Prior Publication Data

US 2017/0119622 A1 May 4, 2017
US 2019/0209429 A9 Jul. 11, 2019

Related U.S. Application Data

(63) Continuation-in-part of application No. 15/160,492, filed on May 20, 2016, which is a continuation-in-part
(Continued)

(51) Int. Cl.
*A61H 31/00* (2006.01)

(52) U.S. Cl.
CPC ..... *A61H 31/006* (2013.01); *A61H 2205/084* (2013.01)

(58) Field of Classification Search
CPC .... A61H 31/00; A61H 31/004; A61H 31/005; A61H 31/006; A61H 31/007;
(Continued)

(56) References Cited

U.S. PATENT DOCUMENTS 1,995,583 A 3/1935 Sanderson
3,461,858 A 8/1969 Michaelson
(Continued)

FOREIGN PATENT DOCUMENTS

EP 2289477 A1 9/2014
WO 2015/127102 8/2015

OTHER PUBLICATIONS

Advisory Action dated Jul. 11, 2016, for U.S. Appl. No. 14/677,562, 4 pages.

(Continued)

*Primary Examiner* — LaToya M Louis
(74) *Attorney, Agent, or Firm* — Kilpatrick Townsend & Stockton LLP

(57) ABSTRACT

An elevation device used in the performance of cardiopulmonary resuscitation (CPR) and after resuscitation includes a base and an upper support operably coupled to the base. The upper support is configured to incline at an angle relative to the base to elevate an individual's upper back, shoulders and head. The elevation device includes a support arm coupled with the upper support. The support arm is movable to various positions relative to the upper support and is lockable at a fixed angle relative to the upper support such that the upper support and the support arm are movable as a single unit relative to the base while the support arm maintains the angle relative to the upper support. The elevation device also includes a chest compression device coupled with the support arm. The chest compression device is configured to compress the chest.

23 Claims, 45 Drawing Sheets

Related U.S. Application Data of application No. 15/133,967, filed on Apr. 20, 2016, now Pat. No. 9,801,782, which is a continuation-in-part of application No. 14/996,147, filed on Jan. 14, 2016, now Pat. No. 9,750,661, which is a continuation-in-part of application No. 14/935,262, filed on Nov. 6, 2015, now Pat. No. 9,707,152, which is a continuation-in-part of application No. 14/677,562, filed on Apr. 2, 2015, now Pat. No. 10,092,481, which is a continuation-in-part of application No. 14/626,770, filed on Feb. 19, 2015, now Pat. No. 10,245,209.

(60) Provisional application No. 62/242,655, filed on Oct. 16, 2015, provisional application No. 61/941,670, filed on Feb. 19, 2014, provisional application No. 62/000,836, filed on May 20, 2014, provisional application No. 62/087,717, filed on Dec. 4, 2014.

(58) Field of Classification Search

CPC ..... A61H 31/008; A61H 31/02; A61H 2031/001; A61H 2031/002; A61H 2031/003; A61H 2031/025; A61M 16/0048

See application file for complete search history.

(56) References Cited

U.S. PATENT DOCUMENTS 3,509,899 A 5/1970 Hewson
3,804,082 A 4/1974 Tarjan et al.
3,870,038 A 3/1975 Arblaster
3,985,126 A 10/1976 Baralow
4,060,079 A 11/1977 Reinhold, Jr.
4,095,590 A 6/1978 Harrigan
4,194,732 A 3/1980 Liebman
4,534,075 A 8/1985 Schnitzler
4,915,095 A 4/1990 Chun
5,048,136 A 9/1991 Popitz
5,316,907 A 5/1994 Lurie
5,399,148 A 3/1995 Waide et al.
5,400,448 A 3/1995 Zwickey
5,423,772 A 6/1995 Lurie
5,454,779 A 10/1995 Lurie et al.
5,487,722 A 1/1996 Sherman et al.
5,490,820 A 2/1996 Schock et al.
5,538,002 A 7/1996 Boussignac et al.
5,549,581 A 8/1996 Lurie
5,551,420 A 9/1996 Lurie et al.
5,588,422 A 12/1996 Lurie
5,618,665 A 4/1997 Lurie
5,634,222 A 6/1997 Zwickey
5,643,231 A 7/1997 Lurie
5,645,522 A 7/1997 Lurie et al.
5,692,498 A 12/1997 Lurie
5,722,963 A 3/1998 Lurie
5,730,122 A 3/1998 Lurie
5,827,893 A 10/1998 Lurie
5,919,210 A 7/1999 Lurie
5,984,909 A 11/1999 Lurie
6,001,085 A 12/1999 Lurie
6,029,667 A 2/2000 Lurie
6,062,219 A 5/2000 Lurie et al.
6,078,834 A 6/2000 Lurie
6,142,962 A 11/2000 Mollenauer
6,155,257 A 12/2000 Lurie et al.
6,224,562 B1 5/2001 Lurie et al.
6,234,916 B1 5/2001 Carusillo et al.
6,234,985 B1 5/2001 Lurie et al.
6,277,107 B1 8/2001 Lurie
6,312,399 B1 11/2001 Lurie et al.
6,357,065 B1 3/2002 Adams
6,371,119 B1 4/2002 Zadini et al.
6,425,393 B1 7/2002 Lurie et al.
6,446,288 B1 9/2002 Pi
6,446,962 B1 9/2002 Pi
6,459,933 B1 10/2002 Lurie et al.
6,463,327 B1 10/2002 Lurie et al.
6,486,206 B1 11/2002 Lurie
6,526,973 B1 3/2003 Lurie et al.
6,587,726 B2 7/2003 Lurie et al.
6,604,523 B2 8/2003 Lurie et al.
6,656,166 B2 12/2003 Lurie
6,751,818 B2 6/2004 Troop
6,776,156 B2 8/2004 Lurie et al.
6,863,656 B2 3/2005 Lurie
6,935,336 B2 8/2005 Lurie et al.
6,938,618 B2 9/2005 Lurie et al.
6,986,349 B2 1/2006 Lurie
7,044,128 B2 5/2006 Lurie
7,056,296 B2 6/2006 Sherman et al.
7,060,041 B1 6/2006 Weil et al.
7,082,945 B2 8/2006 Lurie
7,174,891 B2 2/2007 Lurie et al.
7,185,649 B2 3/2007 Lurie
7,195,012 B2 3/2007 Lurie
7,195,013 B2 3/2007 Lurie
7,204,251 B2 4/2007 Lurie
7,210,480 B2 5/2007 Lurie et al.
7,275,542 B2 10/2007 Lurie et al.
7,296,312 B2 11/2007 Menkedick
7,311,668 B2 12/2007 Lurie
7,347,832 B2 3/2008 Jensen et al.
7,569,021 B2 8/2009 Sebelius et al.
7,682,312 B2 3/2010 Lurie
7,766,011 B2 8/2010 Lurie
7,836,881 B2 11/2010 Lurie et al.
7,899,526 B2 3/2011 Benditt et al.
8,011,367 B2 9/2011 Lurie et al.
8,151,790 B2 4/2012 Lurie et al.
8,210,176 B2 7/2012 Metzger et al.
8,291,534 B2 10/2012 Karlson
8,408,204 B2 4/2013 Lurie
8,702,633 B2 4/2014 Voss et al.
8,752,220 B2 6/2014 Soderberg et al.
8,755,902 B2 6/2014 Lurie et al.
2002/0002347 A1 1/2002 Kelly et al.
2002/0069878 A1 6/2002 Lurie et al.
2002/0170562 A1 11/2002 Lurie et al.
2003/0062040 A1 4/2003 Lurie et al.
2004/0016428 A9 1/2004 Lurie
2004/0058305 A1 3/2004 Lurie et al.
2004/0116840 A1 6/2004 Cantrell et al.
2004/0200474 A1 10/2004 Lurie
2004/0211415 A1 10/2004 Lurie
2004/0211416 A1 10/2004 Lurie
2004/0211417 A1 10/2004 Lurie
2004/0231664 A1 11/2004 Lurie et al.
2005/0165334 A1 7/2005 Lurie
2005/0199237 A1 9/2005 Lurie
2005/0217677 A1 10/2005 Lurie et al.
2005/0267381 A1 12/2005 Benditt
2006/0162077 A1 7/2006 McDaniel et al.
2006/0277683 A1 12/2006 Lamire et al.
2007/0021683 A1 1/2007 Benditt et al.
2007/0277826 A1 12/2007 Lurie
2008/0045867 A1 2/2008 Jensen et al.
2008/0047555 A1 2/2008 Lurie et al.
2008/0255482 A1 10/2008 Lurie
2009/0062701 A1 3/2009 Yannopoulos et al.
2009/0277447 A1 11/2009 Voss et al.
2009/0308400 A1 12/2009 Wilson et al.
2010/0031961 A1 2/2010 Schmidt
2010/0179442 A1 7/2010 Lurie
2010/0319691 A1 12/2010 Lurie et al.
2011/0047709 A1 3/2011 Tarsaud et al.
2011/0098612 A1 4/2011 Lurie
2011/0160782 A1 6/2011 Lurie et al.
2011/0201979 A1 8/2011 Voss et al.
2011/0297147 A1 12/2011 Lick et al.
2012/0042881 A1 2/2012 Paulussen et al.
2012/0203147 A1 8/2012 Lurie et al.
2012/0260428 A1 10/2012 Franklin
2012/0266383 A1 10/2012 Pi

(56) References Cited

U.S. PATENT DOCUMENTS

| | | | |
|---|---|---|---|
| 2012/0330199 | A1 | 12/2012 | Lurie et al. |
| 2012/0330200 | A1 | 12/2012 | Voss et al. |
| 2013/0231593 | A1 | 9/2013 | Yannopoulos et al. |
| 2014/0005566 | A1 | 1/2014 | Homuth et al. |
| 2014/0048061 | A1 | 2/2014 | Yannopoulos et al. |
| 2014/0082842 | A1 | 3/2014 | Jackson |
| 2014/0171839 | A1 | 6/2014 | Fleming |
| 2014/0276269 | A1 | 9/2014 | Illindala |
| 2014/0363391 | A1 | 12/2014 | Yannopoulos et al. |
| 2015/0057580 | A1 | 2/2015 | Illindala |
| 2016/0338904 | A1 | 11/2016 | Lurie et al. |

OTHER PUBLICATIONS

Debaty G, et al. "Tilting for perfusion: Head-up position during cardiopulmonary resuscitation improves brain flow in a porcine model of cardiac arrest." Resuscitation. 2015: 87: 38-43.

Final Office Action dated May 27, 2016, for U.S. Appl. No. 14/667,562, 9 pages.

International Preliminary Report on Patentability dated Sep. 1, 2016, for International Patent Application No. PCT/US2015/016651, all pages.

International Search Report and Written Opinion dated Jul. 8, 2015 for International Patent Application No. PCT/US2015/016651, all pages.

Lurie, Keith G. (2015) "The Physiology of Cardiopulmonary Resuscitation," Anesthesia & Analgesia, doi:10.1513/ANE.0000000000000926, in Ryu, et. al. "The Effect of Head Up Cardiopulmonary Resuscitation on Cerebral and Systemic Hemodynamics." Resuscitation. 2016: 102: 29-34.

Lurie, Keith G. "Mechanical Devices for cardiopulmonary resuscitation: an update," "Emergency Medicine Clinics of North America," Dec. 2002, vol. 20, Issue 4, pp. 771-784.

Non-Final Office Action dated Aug. 26, 2016, for U.S. Appl. No. 14/996,147, 15 pages.

Non-Final Office Action dated Jan. 6, 2016, for U.S. Appl. No. 14/677,562, 33 pages.

Non-Final Office Action dated Sep. 9, 2016, for U.S. Appl. No. 14/935,262, all pages.

Non-Final Office Action dated Sep. 6, 2016, for U.S. Appl. No. 14/677,562, 12 pages.

Notice of Publication dated Aug. 11, 2016, for U.S. Appl. No. 15/133,967.

Physio-Control Inc., "Lucas CPR," retrieved from http://www.lucas-cpr.com/en/lucas_cpr/lucas_cpr.

Voelckel et al "The effects of positive end-expiratory pressure during active compression decompression cardiopulmonary resuscitation with the inspiratory threshold valve." Anesthesia and Analgesia. Apr. 2001: 92(4): 967-74.

Zoll Medical Corporation, "The System for High-Quality CPR", 2015, all pages.

U.S. Appl. No. 15/133,967 filed Apr. 20, 2016, Final Office Action dated Mar. 13, 2017, all pages.

International Search Report and Written Opinion of PCT/US2016/057366 dated Mar. 13, 2017, all pages.

U.S. Appl. No. 15/133,967, filed Apr. 20, 2016, Advisory Action dated Jun. 7, 2017, all pages.

U.S. Appl. No. 14/677,562, filed Apr. 2, 2015, Non-Final Office Action dated Jun. 13, 2017, all pages.

EP Patent Application No. 15751853.1 filed Feb. 19, 2015, Extended European Search Report dated Feb. 10, 2017, all pages.

LOCKABLE HEAD UP CARDIOPULMONARY RESUSCITATION SUPPORT DEVICE

CROSS-REFERENCES TO RELATED APPLICATIONS

This application claims priority to U.S. Provisional Application No. 62/242,655, filed Oct. 16, 2015, and is also a continuation in part of U.S. application Ser. No. 15/160,492, filed May 20, 2016, which is a continuation in part of U.S. application Ser. No. 15/133,967, filed Apr. 20, 2016, which is a continuation in part of U.S. application Ser. No. 14/996,147, filed Jan. 14, 2016, which is a continuation in part of U.S. application Ser. No. 14/935,262, filed Nov. 6, 2015, which is a continuation in part of U.S. application Ser. No. 14/677,562, filed Apr. 2, 2015, which is a continuation of U.S. patent application Ser. No. 14/626,770, filed Feb. 19, 2015, which claims the benefit of U.S. Provisional Application No. 61/941,670, filed Feb. 19, 2014, U.S. Provisional Application No. 62/000,836, filed May 20, 2014, and U.S. Provisional Application No. 62/087,717, filed Dec. 4, 2014, the complete disclosures of which are hereby incorporated by reference for all intents and purposes.

BACKGROUND OF THE INVENTION

The vast majority of patients treated with conventional (C) cardiopulmonary resuscitation (CPR) never wake up after cardiac arrest. Traditional closed-chest CPR involves repetitively compressing the chest in the med-sternal region with a patient supine and in the horizontal plane in an effort to propel blood out of the non-beating heart to the brain and other vital organs. This method is not very efficient, in part because refilling of the heart is dependent upon the generation of an intrathoracic vacuum during the decompression phase that draws blood back to the heart. Conventional (C) closed chest manual CPR (C-CPR) typically provides only 8-30% of normal blood flow to the brain and heart. In addition, with each chest compression, the arterial pressure increases immediately. Similarly, with each chest compression, right-side heart and venous pressures rise to levels nearly identical to those observed on the arterial side. The high right-sided pressures are in turn transmitted to the brain via the paravertebral venous plexus and jugular veins. The simultaneous rise of arterial and venous pressure with each C-CPR compression generates contemporaneous bi-directional (venous and arterial) high pressure compression waves that bombard the brain within the closed-space of the skull. This increase in blood volume and pressure in the brain with each chest compression in the setting of impaired cerebral perfusion further increases intracranial pressure (ICP), thereby reducing cerebral perfusion. These mechanisms have the potential to further reduce brain perfusion and cause additional damage to the already ischemic brain tissue during C-CPR.

To address these limitations, newer methods of CPR have been developed that significantly augment cerebral and cardiac perfusion, lower intracranial pressure during the decompression phase of CPR, and improve short and long-term outcomes. These methods may include the use of a load-distributing band, active compression decompression (ACD)+CPR, an impedance threshold device (ITD), active intrathoracic pressure regulation devices, and/or combinations thereof. However, despite these advances, most patients still do not wake up after out-of-hospital cardiac arrest. In the current invention the clinical benefits of each of these CPR methods and devices are improved when performed in the head and thorax up position.

BRIEF SUMMARY OF THE INVENTION

Embodiments of the invention are directed toward systems, devices, and methods of administering CPR to a patient in a head and thorax up position. Such techniques result in lower right-atrial pressures and intracranial pressure while increasing cerebral perfusion pressure, cerebral output, and systolic blood pressure (SBP) compared with CPR administered to an individual in the supine position. The configuration may also preserve a central blood volume and lower pulmonary vascular resistance and circulate drugs used during CPR more effectively. This provides a more effective and safe method of performing CPR for extended periods of time. The head and thorax up configuration may also preserve the patient in the sniffing position to optimize airway management and reduce complications associated with endotracheal intubation.

In one aspect, an elevation device used in the performance of cardiopulmonary resuscitation (CPR) and after resuscitation is provided. The elevation device may include a base and an upper support operably coupled to the base. The upper support may be configured to incline at an angle relative to the base to elevate an individual's upper back, shoulders and head. The elevation device may also include a support arm coupled with the upper support. The support arm may be movable to various positions relative to the upper support and may be lockable at a fixed angle relative to the upper support such that the upper support and the support arm are movable as a single unit relative to the base while the support arm maintains the angle relative to the upper support. The elevation device may also include a chest compression device coupled with the support arm. The chest compression device may be configured to compress the chest and to optionally actively decompress the chest.

In another aspect, an elevation device used in the performance of cardiopulmonary resuscitation (CPR) and after resuscitation may include a base configured to be positioned on a surface. The surface may be at least substantially aligned with a horizontal plane. The elevation device may also include an upper support operably coupled to the base. The upper support may be configured to move between a storage position and an elevated position. In the elevated position the upper supported may be inclined at an angle relative to the base to elevate an individual's upper back, shoulders. The elevation device may further include a support arm operably coupled with the upper support such that the support arm may be positionable at different locations relative to the upper support. The support arm may be configured to be locked in a given position relative to the upper support. The elevation device may include a chest compression device coupled with the support arm. The chest compression device may be configured to compress the chest at an angle generally orthogonal to the individual's sternum. The elevation device may be configured such that while the upper support is being moved to the elevated position, the chest compression device remains generally orthogonal to the individual's sternum.

In another aspect, a method of performing cardiopulmonary resuscitation (CPR) is provided. The method may include providing an elevation device. The elevation device may include a base, an upper support operably coupled to the base, a support arm coupled with the upper support, and a chest compression device coupled with the support arm. The chest compression device may be configured to compress the chest. The method may also include positioning the individual on the elevation device and elevating the upper support to raise the individual's upper torso and head while maintaining the chest compression device at an angle that is generally orthogonal to the individual's sternum. The method may further include performing one or more of CPR or intrathoracic pressure regulation while elevating the heart and the head.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1A:
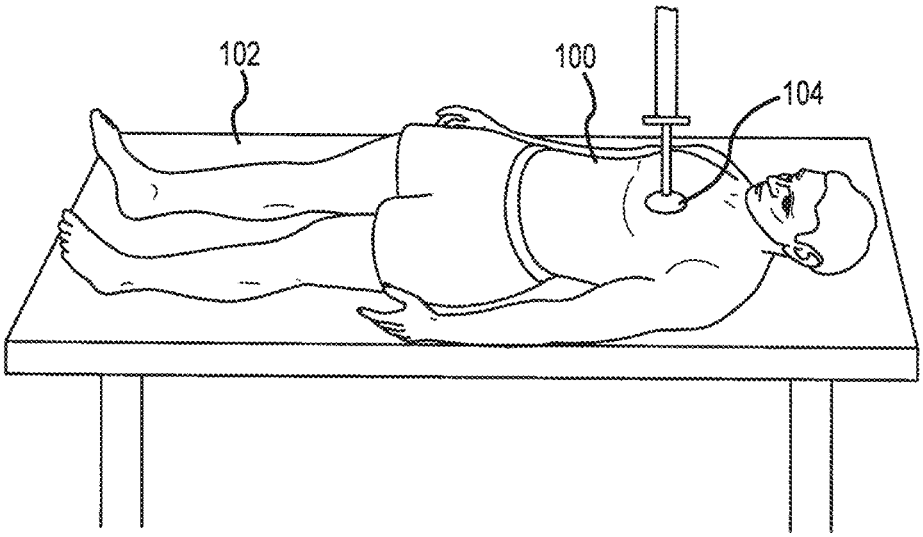
FIG. 1A is a schematic of a patient receiving CPR in a supine configuration according to embodiments.

One aspect of the invention involves CPR techniques where the entire body, and in some cases at least the head, shoulders, and heart, of a patient is tilted upward. This improves cerebral perfusion and cerebral perfusion pressures after cardiac arrest. In some cases, CPR with the head and heart elevated may be performed using any one of a variety of manual or automated conventional CPR devices (e.g. active compression-decompression CPR, load-distributing band, or the like) alone or in combination with any one of a variety of systems for regulating intrathoracic pressure, such as a threshold valve that interfaces with a patient's airway (e.g., an ITD), the combination of an ITD and a Positive End Expiratory Pressure valve (see Voelckel et al "The effects of positive end-expiratory pressure during active compression decompression cardiopulmonary resuscitation with the inspiratory threshold valve." *Anesthesia and Analgesia.* 2001 April: 92(4): 967-74, the entire contents of which is hereby incorporated by reference) or a Bousignac tube alone or coupled with an ITD (see U.S. Pat. No. 10,1038,002, the entire contents of which is hereby incorporated by reference). In some cases, the systems for regulating intrathoracic pressure may be used without any type of chest compression. When CPR is performed with the head and heart elevated, gravity drains venous blood from the brain to the heart, resulting in refilling of the heart after each compression and a substantial decrease in ICP, thereby reducing resistance to forward brain flow. This maneuver also reduces the likelihood of simultaneous high pressure waveform simultaneously compressing the brain during the compression phase. While this may represent a potential significant advance, tilting the entire body upward, or at least the head, shoulders, and heart, has the potential to reduce coronary and cerebral perfusion during a prolonged resuscitation effort since over time gravity will cause the redistribution of blood to the abdomen and lower extremities.

It is known that the average duration of CPR is over 20 minutes for many patients with out-of-hospital cardiac arrest. To prolong the elevation of the cerebral and coronary perfusion pressures sufficiently for longer resuscitation efforts, in some cases, the head may be elevated at between about 10 cm and 30 cm (typically about 20 cm) while the thorax, specifically the heart and/or lungs, is elevated at between about 3 cm and 8 cm (typically about 10 cm) relative to a supporting surface and/or the lower body of the individual. Typically, this involves providing a thorax support and a head support that are configured to elevate the respective portions of the body at different angles and/or heights to achieve the desired elevation with the head raised higher than the thorax and the thorax raised higher than the lower body of the individual being treated. Such a configuration may result in lower right-atrial pressures while increasing cerebral perfusion pressure, cerebral output, and systolic blood pressure SBP compared to CPR administered to an individual in the supine position. The configuration may also preserve a central blood volume and lower pulmonary vascular resistance.

The head up devices (HUD) described herein mechanically elevate the thorax and the head, maintain the head and thorax in the correct position for CPR when head up and supine using an expandable and retractable thoracic back plate and a neck support, and allow a thoracic plate to angulate during head elevation so the piston of a CPR assist device always compresses the sternum in the same place and a desired angle (such as, for example, a right angle) is maintained between the piston and the sternum during each chest compression. Embodiments were developed to provide each of these functions simultaneously, thereby enabling maintenance of the compression point at the anatomically correct place when the patient is flat (supine) or their head and chest are elevated.

Figure 1B:
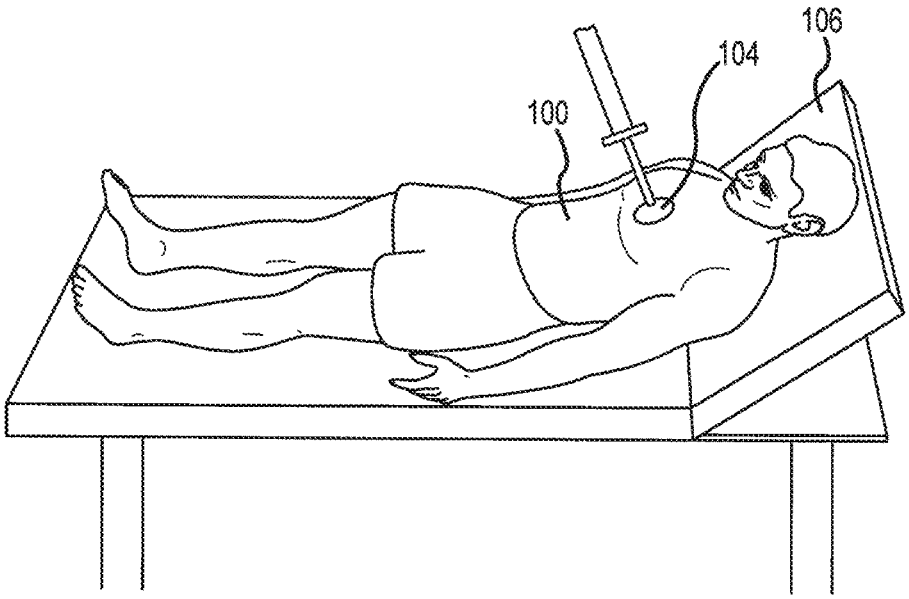
FIG. 1B is a schematic of a patient receiving CPR in a head and thorax up configuration according to embodiments.

Turning now to FIG. 1A, a demonstration of the standard supine (SUP) CPR technique is shown. Here, a patient 100 is positioned horizontally on a flat or substantially flat surface 102 while CPR is performed. CPR may be performed by hand and/or with the use of an automated CPR device and/or ACD+CPR device 104. In contrast, a head and thorax up (HUP) CPR technique is shown in FIG. 1B. Here, the patient 100 has his head and thorax elevated above the rest of his body, notably the lower body. The elevation may be provided by one or more wedges or angled surfaces 106 placed under the patient's head and/or thorax, which support the upper body of the patient 100 in a position where both the head and thorax are elevated, with the head being elevated above the thorax. HUP CPR may be performed with conventional standard CPR alone, with ACD alone, with the ITD alone, with the ITD in combination with conventional standard CPR alone, and/or with ACD+ITD together. Such methods regulate and better control intrathoracic pressure, causing a greater negative intrathoracic pressure during CPR when compared with conventional manual CPR. In some embodiments, HUP CPR may also be performed in conjunction with extracorporeal membrane oxygenation (ECMO).

Figures 2A, 2B, 2C:
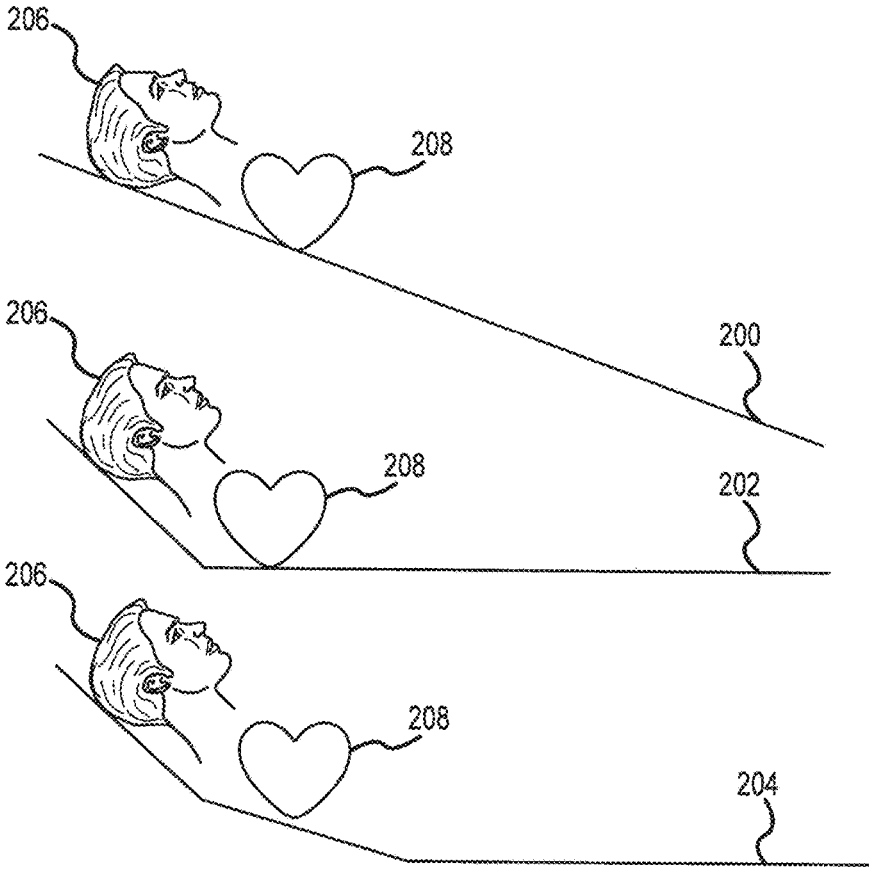
FIG. 2A is a schematic showing a configuration of head up CPR according to embodiments.
FIG. 2B is a schematic showing a configuration of head up CPR according to embodiments.
FIG. 2C is a schematic showing a configuration of head up CPR according to embodiments.

FIGS. 2A-2C demonstrate various set ups for HUP CPR as disclosed herein. Configuration 200 in FIG. 2A shows a user's entire body being elevated upward at a constant angle. As noted above, such a configuration may result in a reduction of coronary and cerebral perfusion during a prolonged resuscitation effort since blood will tend to pool in the abdomen and lower extremities over time due to gravity. This reduces the amount of effective circulating blood volume and as a result blood flow to the heart and brain decrease over the duration of the CPR effort. Thus, configuration 200 is not ideal for administration of CPR over longer periods, such as those approaching average resuscitation effort durations. Configuration 202 in FIG. 2B shows only the patient's head 206 being elevated, with the heart and thorax 208 being substantially horizontal during CPR. Without an elevated thorax 208, however, systolic blood pressures and coronary perfusion pressures are lower as lungs are more congested with blood when the thorax is supine or flat. This, in turn, increases pulmonary vascular resistance and decreases the flow of blood from the right side of the heart to the left side of the heart when compared to CPR in configuration 204. Configuration 204 in FIG. 2C shows both the head 206 and heart/thorax 208 of the patient elevated, with the head 206 being elevated to a greater height than that heart/thorax 208. This results in lower right-atrial pressures while increasing cerebral perfusion pressure, cerebral output, and systolic blood pressure compared to CPR administered to an individual in the supine position, and may also preserve a central blood volume and lower pulmonary vascular resistance.

Figures 3A, 3B, 3C:
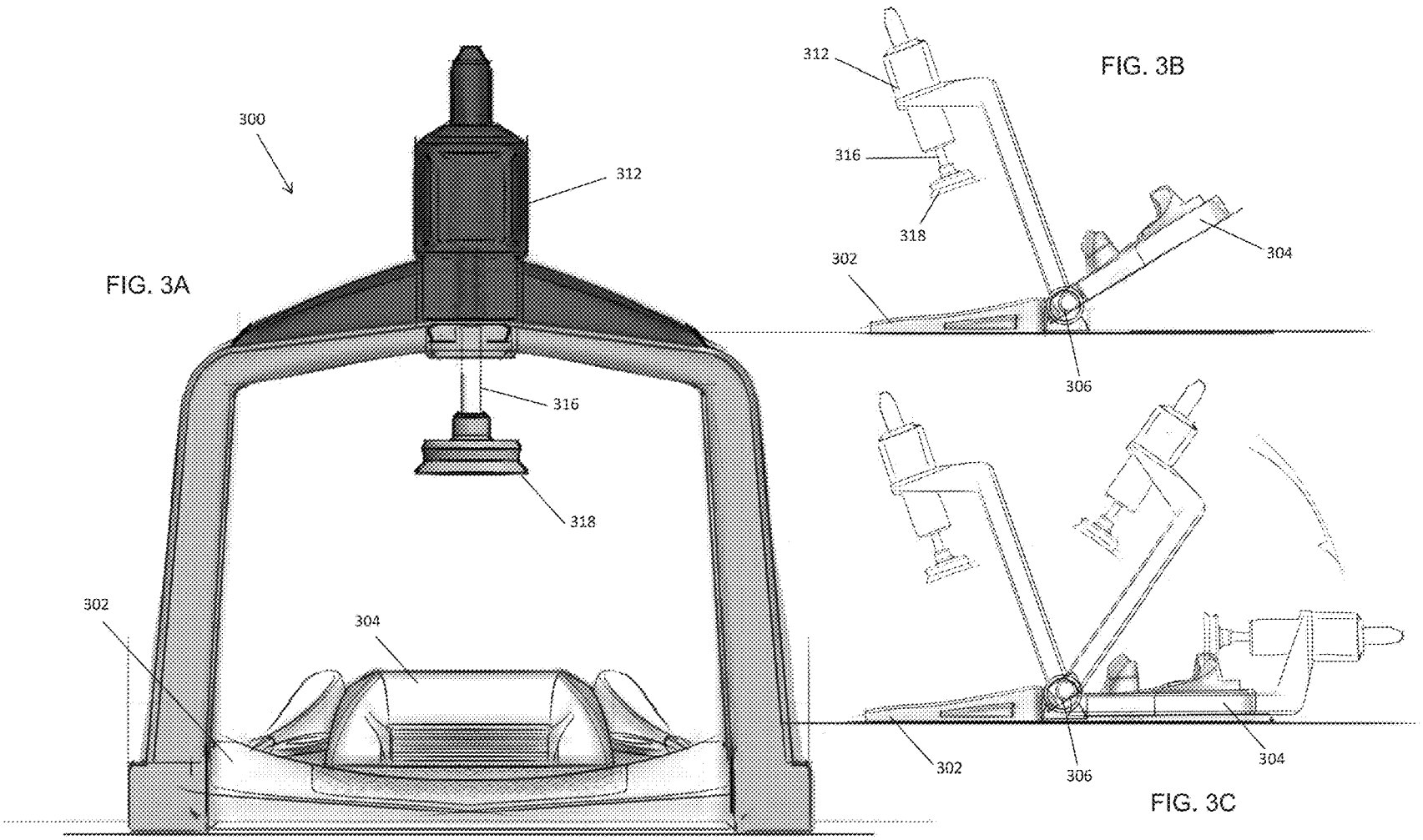
FIG. 3A depicts an elevation device in a lowered position according to embodiments.
FIG. 3B depicts the elevation device of FIG. 3A in an elevation position according to embodiments.
FIG. 3C depicts movement of a support arm of the elevation device of FIG. 3A between a storage position and an active position according to embodiments.

FIG. 3A depicts an embodiment of an elevation device 300. Elevation device may include a base 302 and an upper support 304 that is operably coupled with the base 302. The upper support 304 may be configured to elevate at an angle relative to the base 302 to elevate an individual's head and upper torso (such as the upper back and shoulders). As just one example, the upper support may be configured to pivot or otherwise rotate about a rotational axis 306 to elevate the head and upper torso as shown in FIG. 3B. In some embodiments, the upper support 304 may include a neck support 308 and/or a head cradle 310. These components may be useful in both supporting the individual, as well as in properly positioning the individual on the elevation device 300. For example, the individual may be placed on the elevation device 300 such that the neck support 308 is positioned along the individual's spine, such as at a point proximate to the C7 or C8 vertebrae. In a lowered position, the upper support 304 may elevate or otherwise incline the head between about 2 inches and about 10 inches above a substantially horizontal plane defined by the surface upon which the elevation device 300 is supported. The shoulders may be elevated between about 1 inch and about 3 inches when in the lowered position. In an elevated position, upper support 304 may elevate the head to a desired height, typically between about 3 inches and 24 inches relative to the substantially horizontal plane. Thus, the individual has its head at a higher height than the thorax, and both are elevated relative to the flat or supine lower body. Upper support 304 is often elevated at an angle between about 8° and 45° above the horizontal plane. Adjustment of the upper support 304 may be manual or may be driven by a motor that is controlled by a user interface. For example, the upper support 304 may adjusted by manually pivoting upper support about axis 306. In other embodiments, a hydraulic lift coupled with an extendable arm may be used. In other embodiments, a screw or worm gear may be utilized in conjunction with an extendable arm or other linkage. Any adjustment or pivot mechanism may be coupled between the base 302 of the elevation device 300 and the upper support 304

Elevation device 300 may also include a chest compression device 312 that may be positionable over an individual's chest. For example, chest compression device 312 may be coupled with a support arm 314 that is movable relative to the base 302 and the upper support 304 such that the chest compression device 312 may be aligned with the individual's sternum. In some embodiments, this may be done by the support arm 314 being rotated relative to the base to position the chest compression device 312 at a proper angle. In some embodiments, movement of the support arm 314 may be locked at a fixed angle relative to the upper support 304 such that the upper support and the support arm are movable as a single unit relative to the base while the support arm maintains the angle relative to the upper support. For example, the support arm may be configured to rotate, pivot, or otherwise move at a same rate as the upper support 304, thereby allowing an angular or other positional relationship to be maintained between the upper support 304 and the support arm 314. This ensures that the chest compression device 312 remains properly aligned with the individual's chest during elevation of the upper support 304. In some embodiments, the support arm 314 and chest compression device 312 may be moved independent of the upper support 304. For example, the support arm 314 may be unlocked from movement with the upper support 304 such that the support arm 314 may be moved between an active position in which the chest compression device 312 is aligned with the individual's sternum and a stowed position in which the chest compression device 312 and support arm 314 are positioned along the upper support 304 in a generally supine position as shown by the arrow in FIG. 3C. In the stowed position, the elevation device 300 not only takes up less vertical room, but also makes it easier to position an individual on the elevation device 300. For example, an individual may be lifted slightly such that the elevation device 300 may be slid underneath the individual without the support arm 314 and chest compression device 312 getting in the way. The support arm 314 may then be maneuvered into the active position after the individual is properly positioned on the elevation device 300.

In some embodiments, the chest compression device 312 may include a piston or plunger 316 and/or suction cup 318 that is configured to deliver compressions and/or to actively decompress the individual's chest. For example, on a down stroke of the plunger 316, the plunger 316 may compress the individual's chest, while on an upstroke of the plunger 316, the suction cup 318 may pull upward on the individual's chest to actively decompress the chest. While shown here with a suction cup 318 and plunger 316, it will be appreciated that chest compression device 312 may include other mechanisms alone or in conjunction with the suction cup 318 and/or plunger 316. For example, active compression bands configured to squeeze the chest may be used for the compression stage of CPR. In some embodiments, an adhesive pad may be used to adhere to the chest such that the chest may be actively decompressed without a suction cup 318. In some embodiments, the chest compression device 312 may be configured only for standard compression CPR, rather than active compression-decompression CPR.

Support arm 314 may be generally U-shaped and may be coupled with the base 302 on both sides as shown here. However, in some embodiments, the support arm 314 may be more generally L-shaped, with only a single point of coupling with base 302. In some embodiments, a size of the support arm 314 may be adjustable such that the support arm 314 may adjust a position of the chest compression device 312 to accommodate individuals of different sizes. In embodiments with a chest compression device 312 that is configured to only provide compressions using a compression band, the support arm 314 may be removed entirely. In such embodiments, an adjustable thoracic plate (not shown) may be included to help combat the effects of thoracic shift during elevation of the head and upper torso and during delivery of the chest compressions.

Figure 4:
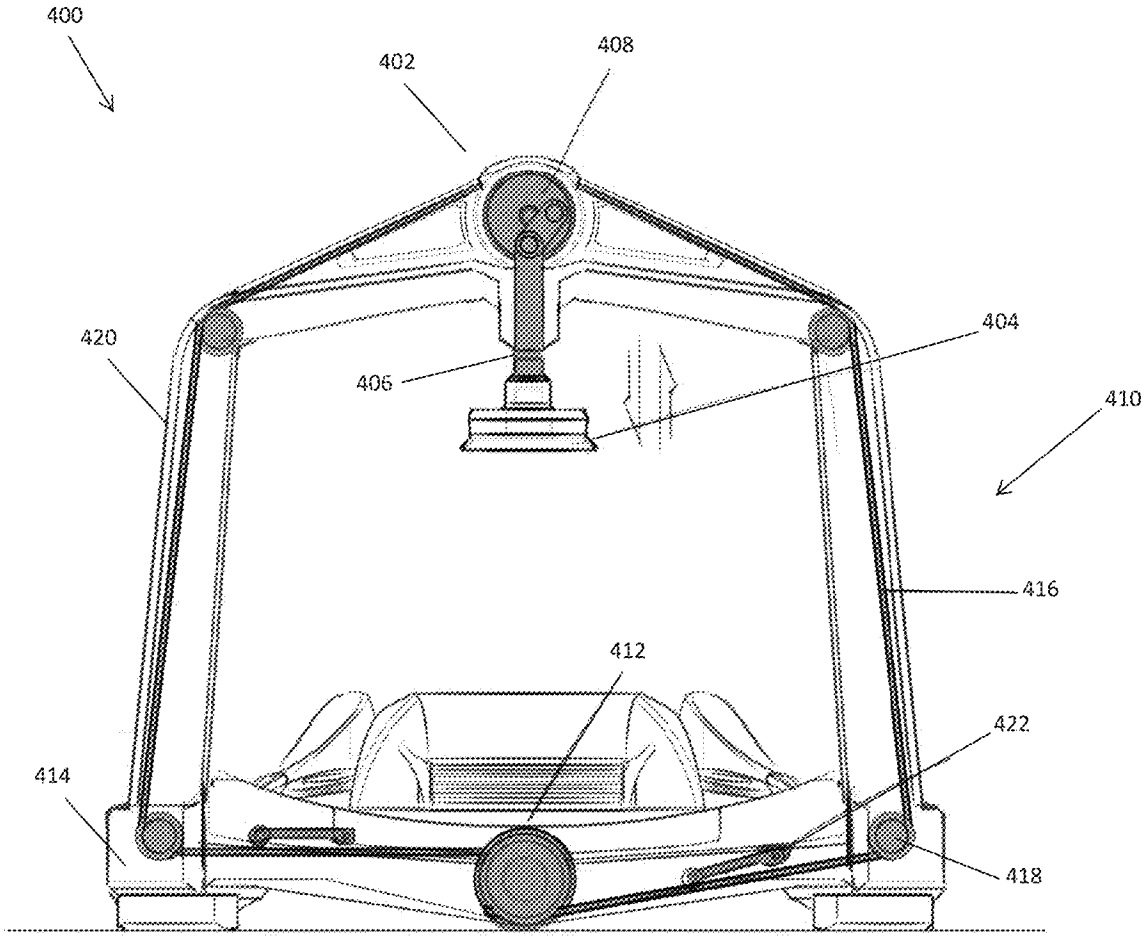
FIG. 4 depicts a chest compression device provided with an elevation device according to embodiments.

FIGS. 4-6B depict various chest compression devices that are usable with elevation devices such as elevation device 300. For example, FIG. 4 shows an elevation device 400 having a chest compression device 402. Chest compression device 402 includes a plunger 404 and/or suction cup 406 that are driven by a rotating linkage 408. The rotating linkage 408 may be driven by the movement of one or more cable assemblies 410, which in turn may be driven by a motor assembly 412. Here, motor assembly 412 is positioned within a base 414 of the elevation device 400. As the motor assembly 412 actuates, it winds a cable 416 of the cable assembly 410 around a portion of the motor assembly 412, while unwinding the cable 416 from another portion of the motor assembly 412. This causes the cable 416 to wind around a system of pulleys 418 within the cable assembly 410 and direct force from the winding cable 416 to the rotating linkage 408, which then transforms the linear force from the cable 416 into rotational force, which causes the rotating linkage to rotate. As the rotating linkage 408 rotates, it reciprocates the plunger 404, which compresses the chest on a down stroke and, if coupled with a suction up 406 or other coupling mechanism, actively decompresses the chest on each upstroke. In some embodiments, the cable assembly 410 may extend throughout a support arm 420 and base 414 of the elevation device 400, with the pulleys 418 directing the cable 416 within the housing. In some embodiments, the chest compression device 402 may also include one or more tensioners 422 positioned along a length of the cable 416. The tensioners 422 may be used to apply tension to the cable 416 to adjust a force and/or depth of chest compressions and/or decompressions delivered by the plunger 404 and/or suction cup 406.

Figure 5:
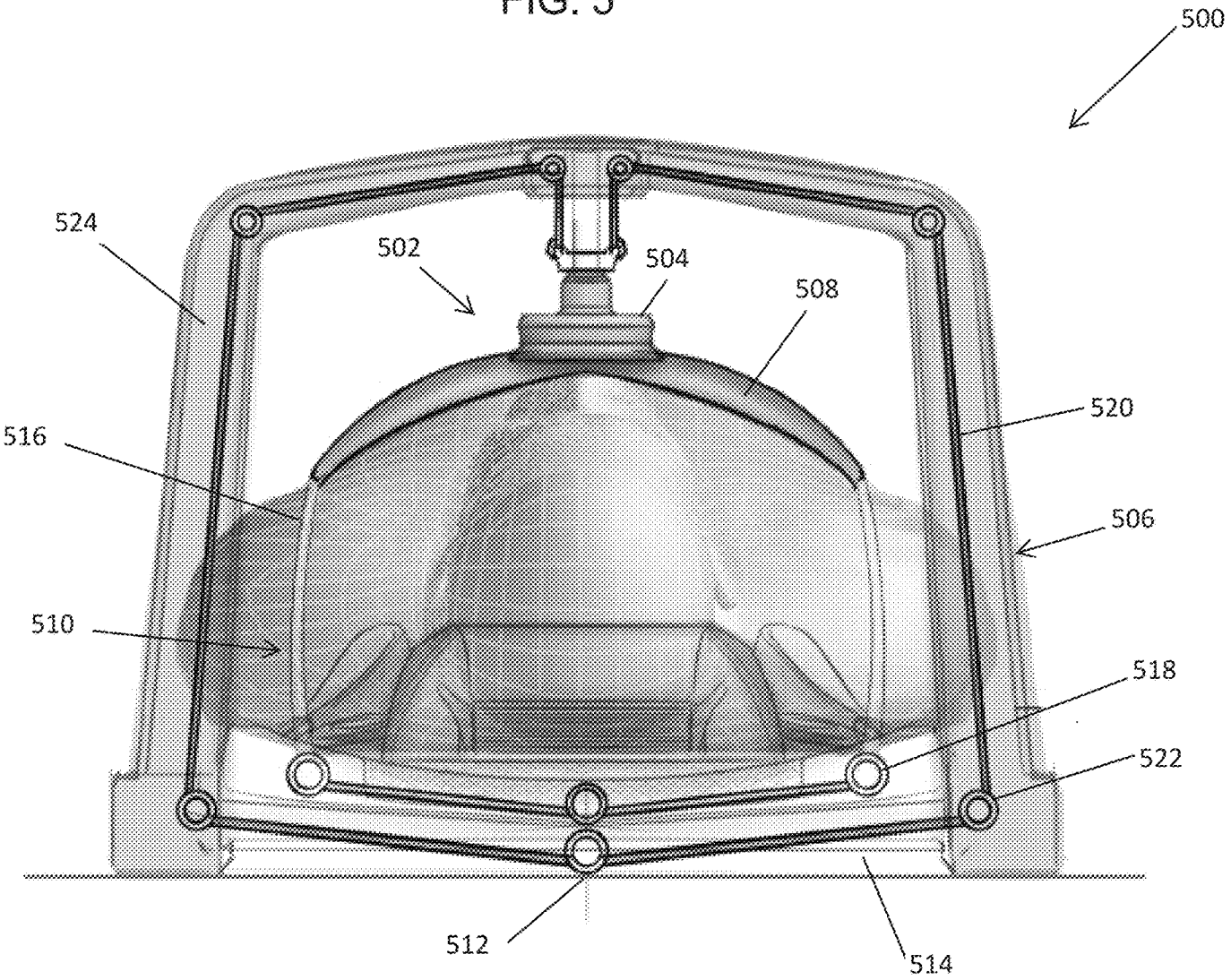
FIG. 5 depicts a chest compression device provided with an elevation device according to embodiments.

FIG. 5 shows an elevation device 500 having a chest compression device 502. Chest compression device 502 includes a suction cup 504 that is driven by a decompression cable system 506. Chest compression device 502 also includes a chest compression band 508 configured to be placed against an individual's chest to squeeze or otherwise compress the chest during CPR. Chest compression band 508 may be driven by a compression cable system 510 that is coupled with ends of the chest compression band 508. The decompression cable system 506 and/or compression cable system 510 may be driven by the actuation of one or more motor assemblies 512. Here, motor assembly 512 is positioned within a base 514 of the elevation device 500. As the motor assembly 512 actuates, it winds a cable 516 of the compression cable system 510 around a portion of the motor assembly 512, thereby reducing the amount of exposed cable 516 and tightening the chest compression band 508. The cable 516 may wind around a system of pulleys 518 within the compression cable system 510 and direct the winding cable 516 toward the motor assembly 512. Once the motor assembly 512 tightens the cable 516 sufficiently to compress the chest to a desired degree, motor assembly 512 may release the cable 516 such that the chest is free to expand. In some embodiments, the motor assembly 512 may then wind a cable 520 of the decompression cable system 506. This causes the winding cable 520, guided by a number of pulleys 522, to lift the suction cup 504, thereby actively decompressing the chest. Once the chest is fully decompressed, the motor assembly 512 may release the cable 520 and allow the chest to return to a resting state. By repeatedly actuating the compression cable system 510 and decompression cable system 506, the chest compression device 502 can provide active compression-decompression CPR.

In some embodiments, the motor assembly 512 may have one or more cord spools. As just one example, one or more of the spools may wind in a clockwise direction, thereby winding one of cable 516 or cable 520, while the other cable is unwound from the one or more spools. When operated in reverse, the motor assembly 512 may wind the one or more spools in a counterclockwise direction, thereby unwinding the wound cable and winding the unwound cable. This allows the compression and decompression phases to be easily regulated and synchronized such that as the decompression cable system 506 relaxes, the compression cable system 510 tightens and compresses the chest. In some embodiments, one or both of the decompression cable system 506 and the compression cable system 510 may extend throughout a support arm 524 and/or base 514 of the elevation device 500, with the pulleys 518 and 522 directing cable 516 and cable 520, respectively, within the housing. It will be appreciated that in some embodiments, separate motor assemblies may be used for the compression and decompression phases of CPR.

Figure 6A:
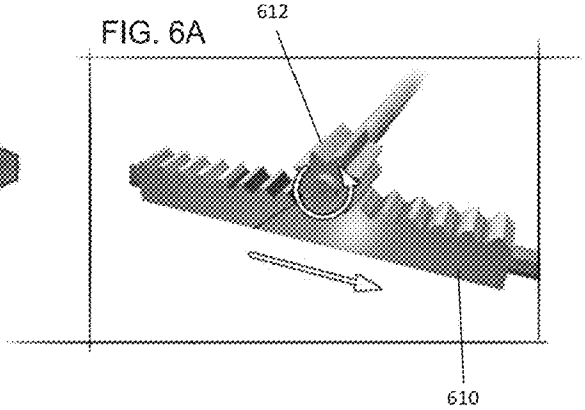
FIG. 6A depicts a linear actuator for use in the chest compression device provided with an elevation device of FIG. 6 according to embodiments.
Figure 6B:
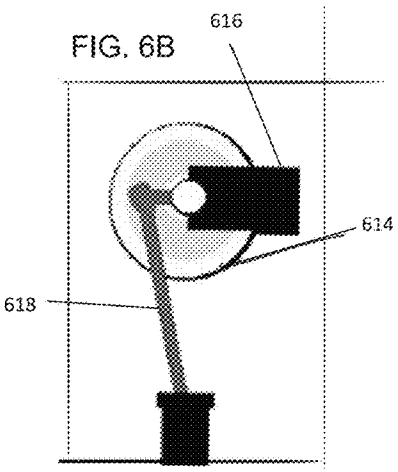
FIG. 6B depicts a linear actuator for use in the chest compression device provided with an elevation device of FIG. 6 according to embodiments.
Figure 6:
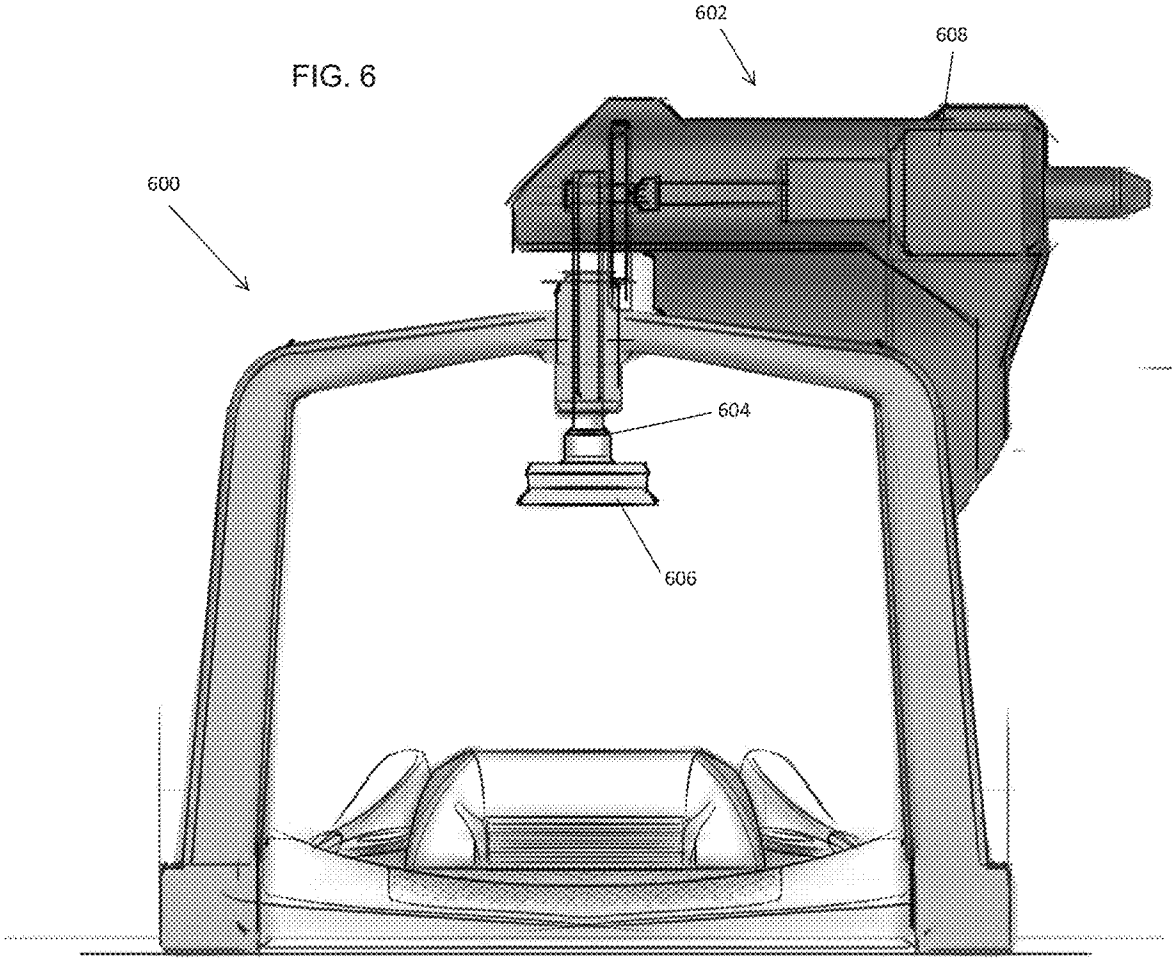
FIG. 6 depicts a chest compression device provided with an elevation device according to embodiments.

FIG. 6 shows an elevation device 600 having a chest compression device 602. Chest compression device 602 includes a plunger 604 and/or suction cup 606 that are driven by rotational force produced by a motor assembly 608. Various mechanisms may be utilized to convert rotational force generated by the motor assembly 608 into linear force that may be used to reciprocate the plunger 604 and/or suction cup 606. As just one example, the output of the motor assembly 608, such as a flywheel, may be operably coupled, such as using a drive rod, with a rack 610 and pinion 612 shown in FIG. 6A. As the pinion 612 rotates in a first direction, teeth of the pinion 612 engage teeth of the rack 610 and cause the rack to move linearly in a first direction. As the pinion 612 rotates in an opposite direction, the rack 610 is forced to move in an opposite direction. By alternating the rotational direction of the pinion 612, the rack 610 is forced to reciprocate. The rack 610 may be coupled with the plunger 604 with longitudinal axes of each component aligned and/or parallel to one another such that the reciprocation of the rack 610 causes a corresponding reciprocating of the plunger 604, thereby compressing the chest on down strokes and, if coupled with a suction cup 606, causing an active decompression of the chest on each upstroke.

In an embodiment shown in FIG. 6B, rotational force may be converted into linear movement using a crankshaft 614 coupled with a rotatable linkage 616. The crankshaft 614 may be operably coupled with an output of the motor assembly 608. As the crankshaft 614 rotates, the rotatable linkage 616 is moved around a circumference or other circular arc of the crankshaft 614, causing an arm 618 of the rotatable linkage 616 to reciprocate up and down. The rotatable linkage 616 may be coupled with the plunger 604 and/or suction cup 606 to drive the compression and/or decompression phase of CPR. While shown using rotatable linkages and/or rack and pinions, other mechanisms may be used to convert rotational force from a motor into linear movement. For example, chain or belt drives, lead screws, jacks, and/or other actuators may be used to transfer force of a motor assembly to linear motion of the plunger and/or suction cup.

It will be appreciated that the above chest compression devices are merely provided as examples, and that numerous variants may be contemplated in accordance with the present invention. Other actuators, motors, and force transfer mechanisms may be contemplated, such as pneumatic or hydraulic actuators. Additionally, some or all of the motors and force transfer components such as pulleys, cables, and drive shafts may be positioned external to a housing of the elevation device. Additionally, the positions of the motors may be moved based on the needs of a particular elevation device.

The type of CPR being performed on the elevated patient may vary. Examples of CPR techniques that may be used include manual chest compression, chest compressions using an assist device such as chest compression device 312, either automated or manually, ACD CPR, a load-distributing band, standard CPR, stutter CPR, and the like. Such processes and techniques are described in U.S. Pat. Pub. No. 2011/0201979 and U.S. Pat. Nos. 10,4104,779 and 10,6410,1022, all incorporated herein by reference. Further various sensors may be used in combination with one or more controllers to sense physiological parameters as well as the manner in which CPR is being performed. The controller may be used to vary the manner of CPR performance, adjust the angle of inclination, the speed of head and thorax rise and descent, provide feedback to the rescuer, and the like. Further, a compression device could be simultaneously applied to the lower extremities or abdomen to squeeze venous blood back into the upper body, thereby augmenting blood flow back to the heart. Further, a compression-decompression band could be applied to the abdomen that compresses the abdomen only when the head and thorax are elevated either continuously or in a pulsatile manner, in synchrony or asynchronously to the compression and decompression of the chest. Further, a rigid or semi-rigid cushion could be simultaneously inserted under the thorax at the level of the hart to elevate the heart and provide greater back support during each compression.

Additionally, a number of other procedures may be performed while CPR is being performed on the patient in the torso-elevated state. One such procedure is to periodically prevent or impede the flow in respiratory gases into the lungs. This may be done by using a threshold valve, sometimes also referred to as an impedance threshold device (ITD) that is configured to open once a certain negative intrathoracic pressure is reached. The invention may utilize any of the threshold valves or procedures using such valves that are described in U.S. Pat. Nos. 10,10101,420; 10,692,498; 10,730,122; 6,029,667; 6,062,219; 6,810,2107; 6,234,916; 6,224,1062; 6,1026,973; 6,604,1023; 6,986,349; and 7,204,2101, the complete disclosures of which are herein incorporated by reference.

Another such procedure is to manipulate the intrathoracic pressure in other ways, such as by using a ventilator or other device to actively withdraw gases from the lungs. Such techniques as well as equipment and devices for regulating respirator gases are described in U.S. Pat. Pub. No. 2010/0031961, incorporated herein by reference. Such techniques as well as equipment and devices are also described in U.S. patent application Ser. Nos. 11/034,996 and 10/796,8710, and also U.S. Pat. Nos. 10,730,122; 6,029,667; 7,082,9410; 7,1810,649; 7,1910,012; and 7,1910,013, the complete disclosures of which are herein incorporated by reference.

In some embodiments, the angle and/or height of the head and/or heart may be dependent on a type of CPR performed and/or a type of intrathoracic pressure regulation performed. For example, when CPR is performed with a device or device combination capable of providing more circulation during CPR, the head may be elevated higher, for example 10-30 cm above the horizontal plane (10-45 degrees) such as with ACD+ITD CPR. When CPR is performed with less efficient means, such as manual conventional standard CPR, then the head may be elevated less, for example 10-20 cm or 10 to 20 degrees.

A variety of equipment or devices may be coupled to or associated with the structure used to elevate the head and torso to facilitate the performance of CPR and/or intrathoracic pressure regulation. For example, a coupling mechanism, connector, or the like may be used to removably couple a CPR assist device to the structure. This could be as simple as a snap fit connector to enable a CPR assist device to be positioned over the patient's chest. Examples of CPR assist devices that could be used with the elevation device (either in the current state or a modified state) include the Lucas device, sold by Physio-Control, Inc. and described in U.S. Pat. No. 7,1069,021, the entire contents of which is hereby incorporated by reference, the Defibtech Lifeline ARM—Hands-Free CPR Device, sold by Defibtech, the Thumper mechanical CPR device, sold by Michigan Instruments, automated CPR devices by Zoll, such as the AutoPulse, as also described in U.S. Pat. No. 7,0106,296, the entire contents of which is hereby incorporated by reference, and the like.

Similarly, various commercially available intrathoracic pressure devices could be removably coupled to the elevation device. Examples of such devices include the Lucas device (Physio-control) such as is described in U.S. Pat. No. 7,1069,021, the Weil Mini Chest Compressor Device, such as described in U.S. Pat. No. 7,060,041 (Weil Institute), the entire contents of which are hereby incorporated by reference, the Zoll AutoPulse, and the like.

As an individual's head is elevated using an elevation device, such as elevation device 300, the individual's thorax is forced to constrict and compress, which causes a more magnified thorax migration during the elevation process. This thorax migration may cause the misalignment of a chest compression device, which leads to ineffective, and in some cases, harmful, chest compressions. It can also cause the head to bend forward thereby potentially restricting the airway. Thus, maintaining the individual in a proper position throughout elevation, without the compression and contraction of the thorax, is vital to ensure that safe and effective CPR can be performed. Embodiments of the elevation devices described herein provide upper supports that may expand and contract, such as by sliding along a support frame to permit the thorax to move freely upward and remain elongate, rather than contract, during the elevation process. For example, the upper support may be supported on rollers with minimal friction. As the head, neck, and/or shoulders are lifted, the upper support may slide away from the thoracic compression, which relieves a buildup of pressure on the thorax and minimizes thoracic compression and migration. Additionally, such elevation devices are designed to maintain optimal airway management of the individual, such as by supporting the individual in the sniffing position throughout elevation. In some embodiments, the upper supports may be spring biased in a contraction direction such that the only shifting or expansion of the upper support is due to forces from the individual as the individual is subject to thoracic shift. Other mechanisms may be incorporated to combat the effects of thoracic shift. For example, adjustable thoracic plates may be used that adjust angularly relative to the base to ensure that the chest compression device remains properly aligned with the individual's sternum. Typically, the thoracic plate may be adjusted between an angle of between about 0° and 8° from a substantially horizontal plane. In some embodiments, as described in greater detail below, the adjustment of the thoracic plate may be driven by the movement of the upper support. In such embodiments, a proper amount of thoracic plate adjustment can be applied based on the amount of elevation of the upper support.

In traditional CPR the patient is supine on an underlying flat surface while manual or automated CPR is implemented. During automated CPR, the chest compression device may migrate due to limited stabilization to the underlying flat surface, and may often require adjustment due to the migration of the device and/or body migration. This may be further exaggerated when the head and shoulders are raised. The elevation devices described herein offer a more substantial platform to support and cradle the chest compression device, such as, for example, a LUCAS device, providing stabilization assistance and preventing unwanted migratory motion, even when the upper torso is elevated. The elevation devices described herein provide the ability to immediately commence CPR in the lowered/supine position, continuing CPR during the gradual, controlled rise to the "Head-Up/Elevated" position. Such elevation devices provide ease of patient positioning and alignment for automated CPR devices. Correct positioning of the patient is important and readily accomplished with guides and alignment features, such as a shaped shoulder profile, a neck/shoulder support, a contoured thoracic plate, as well as other guidelines and graphics. The elevation devices may incorporate features that enable micro adjustments to the position of an automated CPR device position, providing control and enabling accurate placement of the automated CPR device during the lift process. In some embodiments, the elevation devices may establish the sniffing position for intubation when required, in both the supine position and during the lifting process. Features such as stationary pads and adjustable cradles may allow the reduction of neck extension as required while allowing ready access to the head for manipulation during intubation.

Figure 7A:
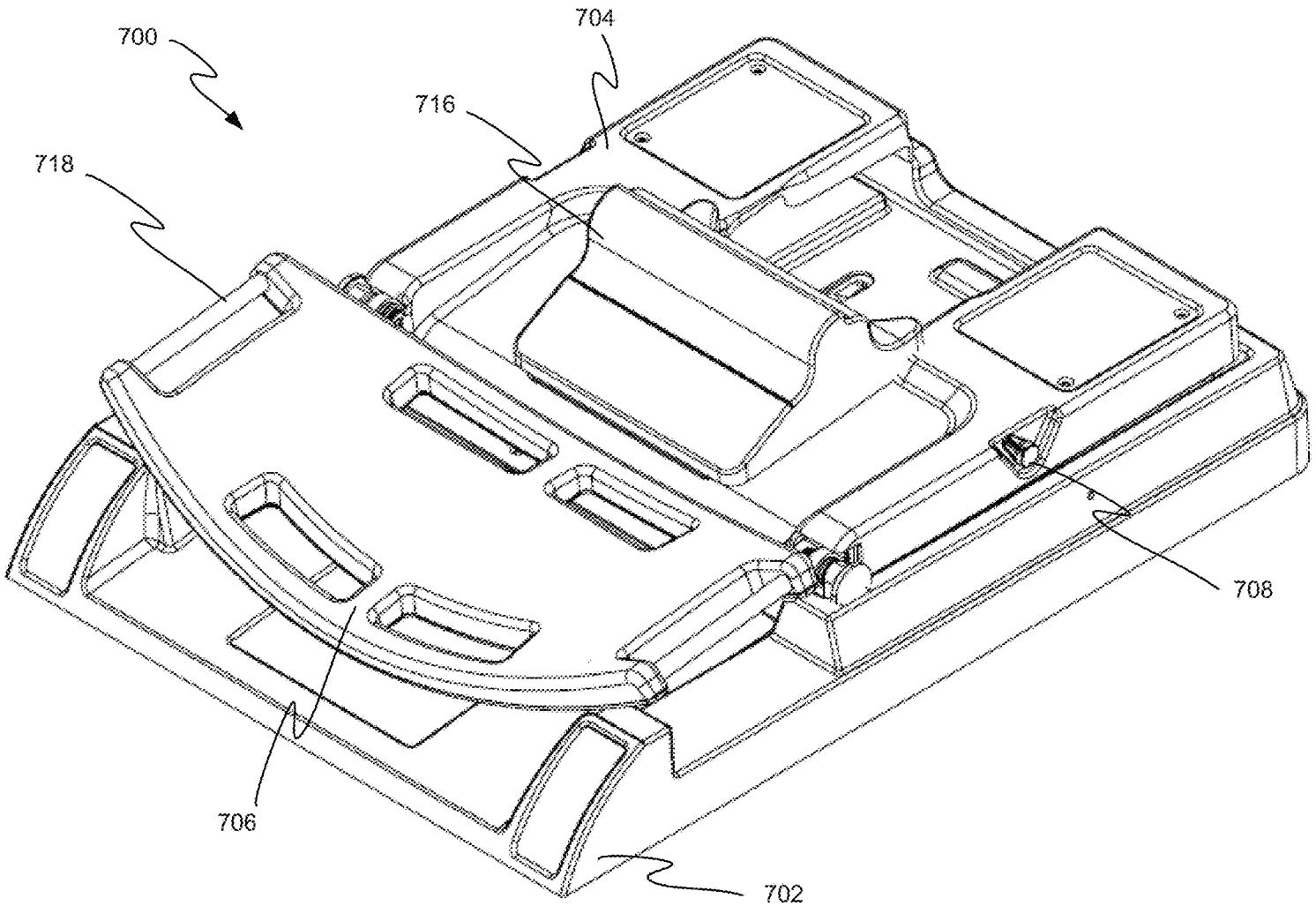
FIG. 7A depicts a support structure in a storage state according to embodiments.

Turning to FIGS. 7A-7H, an elevation device 700 for elevating a patient's head and heart is shown. FIG. 7A is an isometric view of elevation device 700 in a stowed configuration. Elevation device 700 includes a base 702 that supports and is coupled with an upper support 704 and a thoracic plate 706. Upper support 704 may be configured to support a patient's upper back, shoulders, neck, and/or head before, during, and/or after CPR administration. Upper support 704 may include a neck pad or neck support 716, as well as areas configured to receive a patient's upper back, shoulders, neck, and/or head. In some embodiments, the neck support 716 is shaped to engage the region of the individual's C7-C8 vertebrae. The contoured shape ensures that the body does not slip or side off of neck support 716. The C7-C8 region of the spine is a critical contact point of the body as it effectively allows the upper body to freely slide/migrate upward or away from thoracic plate 706 during the elevation process to minimize thoracic compression. Thoracic compression is a leading cause of migration of the contact point of an automated CPR device, which leads to ineffective chest compressions. By adequately supporting the individual in the C7-C8 region, the upper body is free to move and the thoracic cavity may expand, rather than contract. In some embodiments, neck support 716 is formed from a firm material, such as firm foam, plastic, and/or other material. The firmness of neck support 716 provides adequate support for the individual, while resisting deformation under the load of the individual. In some embodiments, the upper support 704 may include a shaped area, such as a cutout, and indentation, and/or other shaped feature. The shaped area 726 may serve as a guide for proper head and/or shoulder placement. Additionally, the shaped area 726 may promote positioning the individual in the sniffing position by allowing the individual's head to lean downward, providing an optimally open airway. In some embodiments, the shaped area 726 may define an opening that allows the head to extend at least partially through the upper support to further promote the sniffing position. In some embodiments, the upper support 704 may also include a coupling for an ITD device to be secured to the elevation device 700, or any of the other intrathoracic pressure regulation devices described herein.

The thoracic plate 706 may be contoured to match a contour of the patient's back and may include one or more couplings 718. Couplings 718 may be configured to connect a chest compression device to elevation device 700. For example, couplings 718 may include one or more mating features that may engage corresponding mating features of a chest compression device. As one example, a chest compression device may snap onto or otherwise receive the couplings 718 to secure the chest compression device to the elevation device 700. Any one of the devices described above could be coupled in this manner. The couplings 718 may be angled to match an angle of elevation of the thoracic plate 706 such that the chest compression is secured at an angle to deliver chest compressions at an angle substantially orthogonal to the patient's sternum, or other desired angle. In some embodiments, the couplings 718 may extend beyond an outer periphery of the thoracic plate 706 such that the chest compression device may be connected beyond the sides of the patient's body. In some embodiments, mounting 706 may be removable. In such embodiments, thoracic plate 706 may include one or more mounting features (not shown) to receive and secure the mounting 706 to the elevation device 700.

Typically, thoracic plate 706 may be positioned at an angle of between about 0° and 8° relative to a horizontal plane and at a height of between about 3 cm and 8 cm above the horizontal plane at a point of the thoracic plate 706 disposed beneath the patient's heart. Upper support 704 is often within about 8° and 45° relative to the horizontal plane and between about 10 cm and 40 cm above the horizontal plane, typically measured from the tragus of the ear as a guide point. In some embodiments, when in a stowed position thoracic plate 706 and upper support 704 are at a same or similar angle, with the upper support 704 being elevated above the thoracic plate 706, although other elevation devices may have the first portion and second portion at different angles in the stowed position. In the stowed position, thoracic plate 706 and/or upper support 704 may be near the lower ends of the height and/or angle ranges.

In an elevated position, upper support 704 may be positioned at angles above 8° relative to the horizontal plane. Elevation device 700 may include one or more elevation mechanisms 730 configured to raise and lower the thoracic plate 706 and/or upper support 704. For example, elevation mechanism 730 may include a mechanical and/or hydraulic extendable arm configured to lengthen or raise the upper support 704 to a desired height and/or angle, which may be determined based on the patient's body size, the type of CPR being performed, and/or the type of ITP regulation being performed. The elevation mechanism 730 may manipulate the elevation device 700 between the storage configuration and the elevated configuration. The elevation mechanism 730 may be configured to adjust the height and/or angle of the upper support 704 throughout the entire ranges of 8° and 45° relative to the horizontal plane and between about 10 cm and 40 cm above the horizontal plane. In some embodiments, the elevation mechanism 730 may be manually manipulated, such as by a user lifting up or pushing down on the upper support 704 to raise and lower the second portion. In other embodiments, the elevation mechanism 730 may be electrically controlled such that a user may select a desired angle and/or height of the upper support 704 using a control interface. While shown here with only an adjustable upper support 704, it will be appreciated that thoracic plate 706 may also be adjustable.

The thoracic plate 706 may also include one or more mounting features configured to secure a chest compression device to the elevation device 700. Here, upper support 704 is shown in an initial, stored configuration. In such a configuration, the upper support 704 is at its lowest position and in a contracted state, with the upper support 704 at its nearest point relative to the thoracic plate 706.

Figures 7B, 7C, 7D:
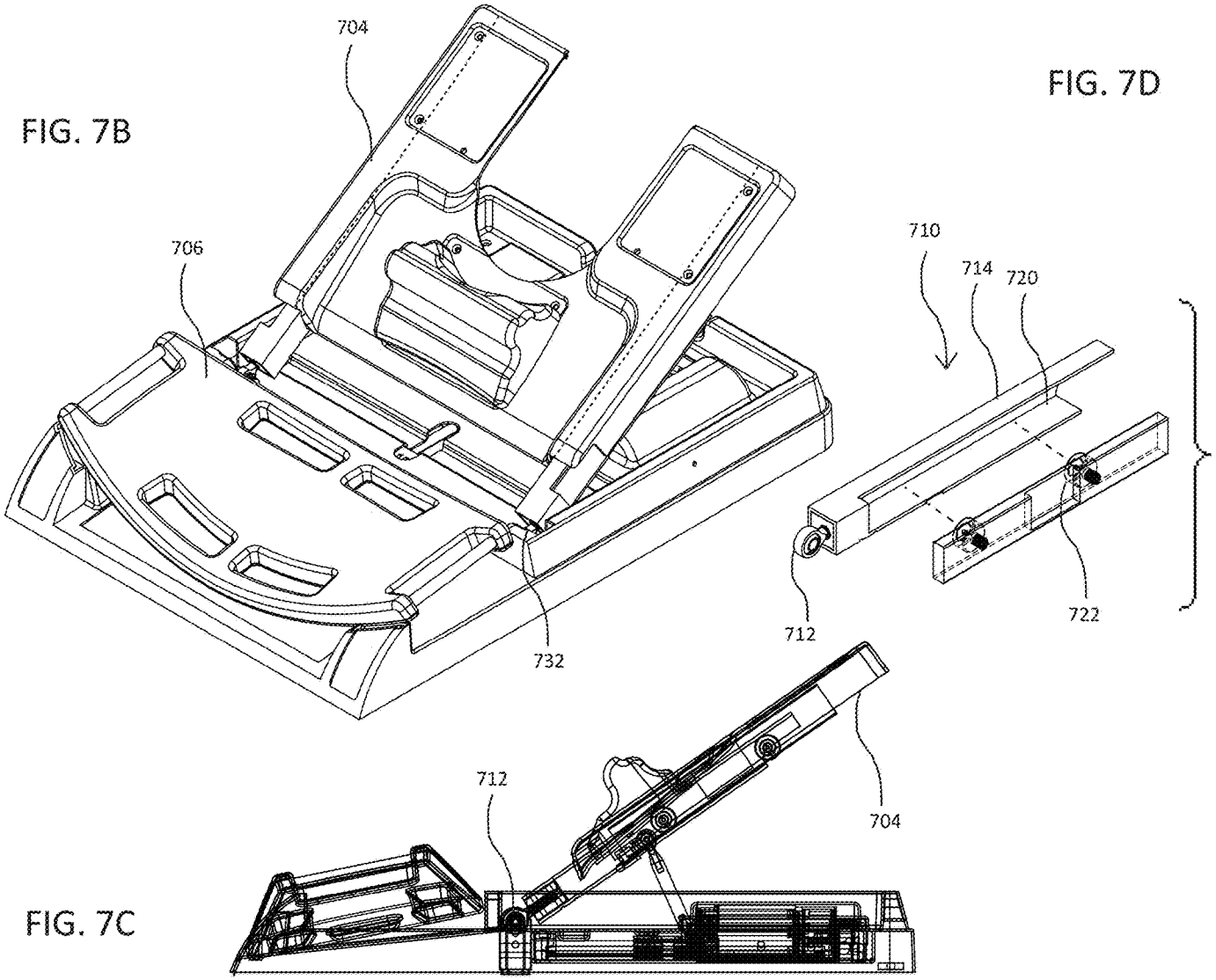
FIG. 7B depicts the support structure of FIG. 7A in an elevated position according to embodiments.
FIG. 7C depicts the support structure of FIG. 7A in an elevated position according to embodiments.
FIG. 7D depicts a roller assembly of the support structure of FIG. 7A according to embodiments.

As described in the elevation devices above, upper support 704 may be configured to elevate a patient's upper back, shoulders, neck, and/or head. Such elevation of the upper support 704 is shown in FIGS. 7B and 7C.

Upper support 704 may be configured to be adjustable such that the upper support 704 may slide along a longitudinal axis of base 702 to accommodate patients of different sizes as well as movement of a patient associated with the elevation of the head by upper support 704. Upper support 704 may be spring loaded or biased to the front (toward the patient's body) of the elevation device 700. Such a spring force assists in managing movement of the upper support 704 when loaded with a patient. Additionally, the spring force may prevent the upper support 704 from moving uncontrollably when the elevation device 700 is being moved from one location to another, such as between uses. Elevation device 700 may also include a lock mechanism 708. Lock mechanism 708 may be configured to set a lateral position of the upper support 704, such as when a patient is properly positioned on the elevation device 700. By allowing the upper support 704 to slide relative to the base 702 (and thus lengthen the upper support), the patient may be maintained in the "sniffing position" throughout the elevation process. Additionally, less force will be transmitted to the patient during the elevation process as the upper support 704 may slide to compensate for any changes in position of the patient's body, with the spring force helping to smooth out any movements and dampen larger forces.

Figure 7E:
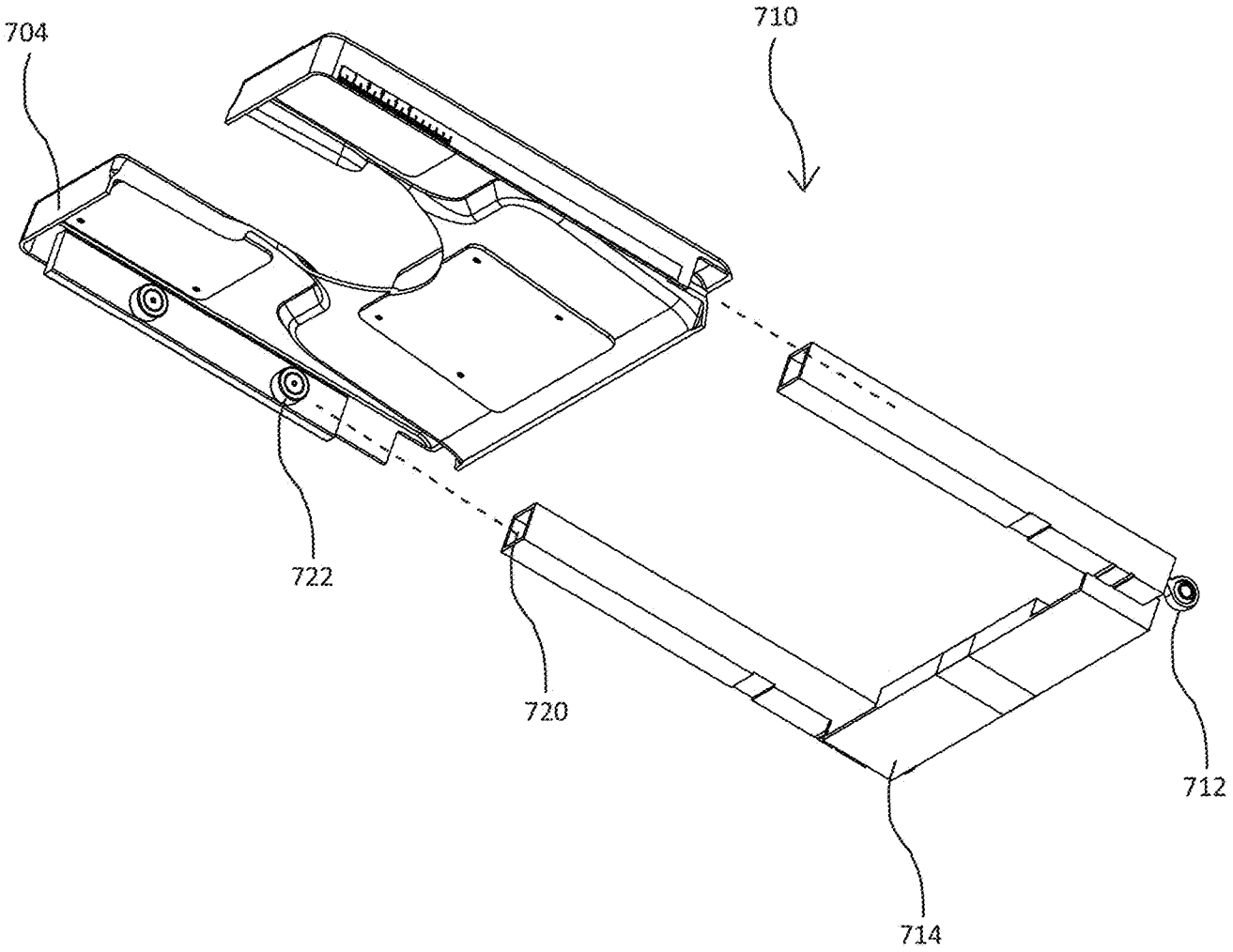
FIG. 7E depicts a roller assembly of the support structure of FIG. 7A according to embodiments.

In some embodiments, a mechanism that enables the sliding of the upper support 704 while the upper support 704 is elevated may allow the upper support 704 to be slidably coupled with the base, while in other embodiments, the mechanism may be included as part of the upper support 704 itself. For example, FIGS. 7D and 7E show one such sliding mechanism 710. Here, sliding mechanism 710 may include a pivotable coupling 712 that extends from a roller track 714 and is coupleable with a corresponding pivot point 732 of base 702. Pivotable coupling 712 enables the entire roller track 714 and upper support 704 to be pivoted to elevate the upper support 704 (and the patient's upper back, shoulders, neck, and/or head). In some embodiments, the elevation of the upper support 704 may be controlled with a motor and switch assembly, such as described above with regards to elevation device 800. Roller track 714 may include one or more tracks or rails 720 that extend away from pivotable coupling 712. Rails 720 may be configured to engage and/or receive corresponding rollers 722 on upper support 704. Oftentimes, rails 720 and roller track 714 may be formed integral with upper support 704. In other embodiments, the rollers 722 may be formed on an underside of upper support 704, oftentimes near an outer edge of the upper support 704. The rollers 722 may engage the roller track 714, which may be positioned near and within the outer edges of the upper support 704. In some embodiments, the track 714 may be positioned on an underside of upper support 704 such that the track 714 and other moving parts are out of the way of users of the elevation device 700. For example, one or more tracks 714 may be positioned at or near an outer edge of upper support 704, possibly on an underside of the upper support 704. In other embodiments, one or more tracks 714 may be near a center of the underside of the upper support 704. Rollers 722 may roll along the rails 720 and allow the upper support 704 to slide along the roller track 714 to adjust a lateral position of the upper support 704, e.g., to allow upper support 704 to expand and contract. Oftentimes, the sliding mechanism 710 may include one or more springs or other force dampening mechanisms that bias movement of the upper support 704 toward the thoracic plate 706. The spring force may be linear and be between about 0.210 kgf and about 1.10 kgf or other values that are sufficient to prevent unexpected motion of the upper support 704 in the absence of a patient while still being small enough to not inhibit the sliding of the upper support 704 when a patient is being elevated by elevation device 700. The sliding mechanism 710 accommodates the upward motion of the patient's upper body during the elevation process in a free manner that insures minimal stress to the upper thorax by allowing upper support 704 to expand lengthwise as the patient's upper body is being elevated, thereby minimizing the deflection and compression of the thorax region and enabling the "sniffing position" to be maintained throughout the elevation or lifting process as the patient's upper body shifts upward.

While shown with roller track 714 as being coupled with the base 702 and rollers 722 being coupled with the upper support 704, it will be appreciated that other designs may be used in accordance with the present invention. For example, a number of rollers may be positioned along a rail that is pivotally coupled with the base. The upper support may then include a track that may receive the rollers such that the upper support may be slid along the rollers to adjust a position of the upper support. Other embodiments may omit the use of rollers entirely. In some embodiments, the mechanism may be a substantially friction free sliding arrangement, while in others, the mechanism may be biased toward the thoracic plate 706 by a spring force. As one example, the upper support may be supported on one or more pivoting telescopic rods that allow a relative position of the upper support to be adjusted by extending and contracting the rods.

Figures 7F, 7G:
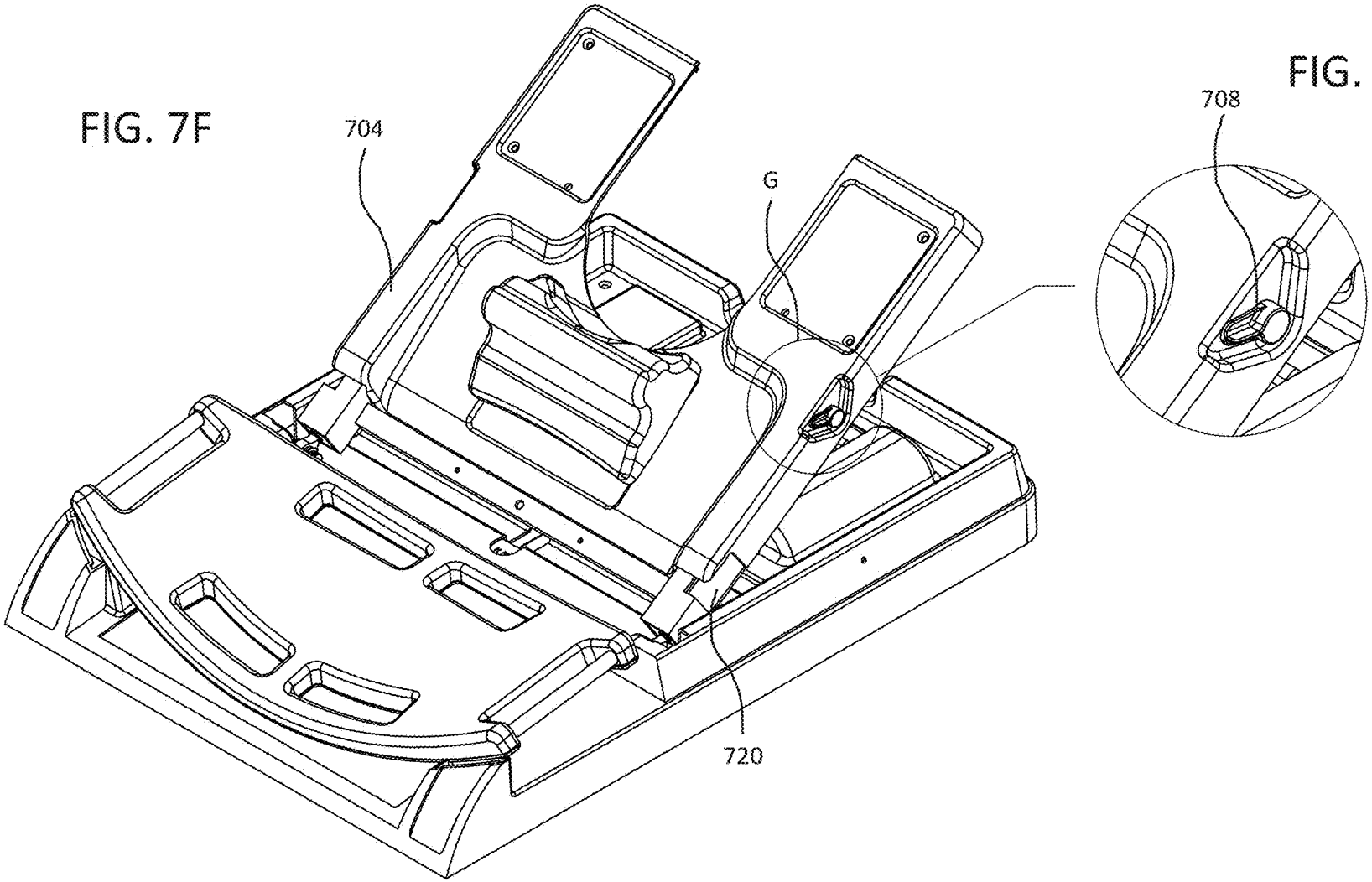
FIG. 7F depicts the support structure of FIG. 7A in an extended elevated position according to embodiments.
FIG. 7G depicts possible movement of the support structure of FIG. 7A from a storage position to an extended elevated position according to embodiments.

FIG. 7F shows a locking mechanism 724 of elevation device 700 in an elevated extended position. Locking mechanism 724, when engaged, locks the function of rollers 722 such that a lateral position of the upper support 704 is maintained. Locking mechanism 724 may be engaged and/or disengaged at any time during the elevation and/or CPR administration processes to allow adjustments of position of the patient to be made. In some embodiments, the locking mechanism 724 functions by applying friction, engaging a ratcheting mechanism, and/or applying a clamping force to prevent the upper support 704 from moving. In the elevated extended position, the upper support 704 is angularly elevated above the base 702, such as by pivoting the upper support 704 about the pivotable coupling 712. The upper support 704 is positioned along the roller track 714 at a distance from the thoracic plate 706. In some embodiments, this may result in a portion of the roller track 714 being exposed as the upper support 704 is extended along the track 714.

Figure 7H:
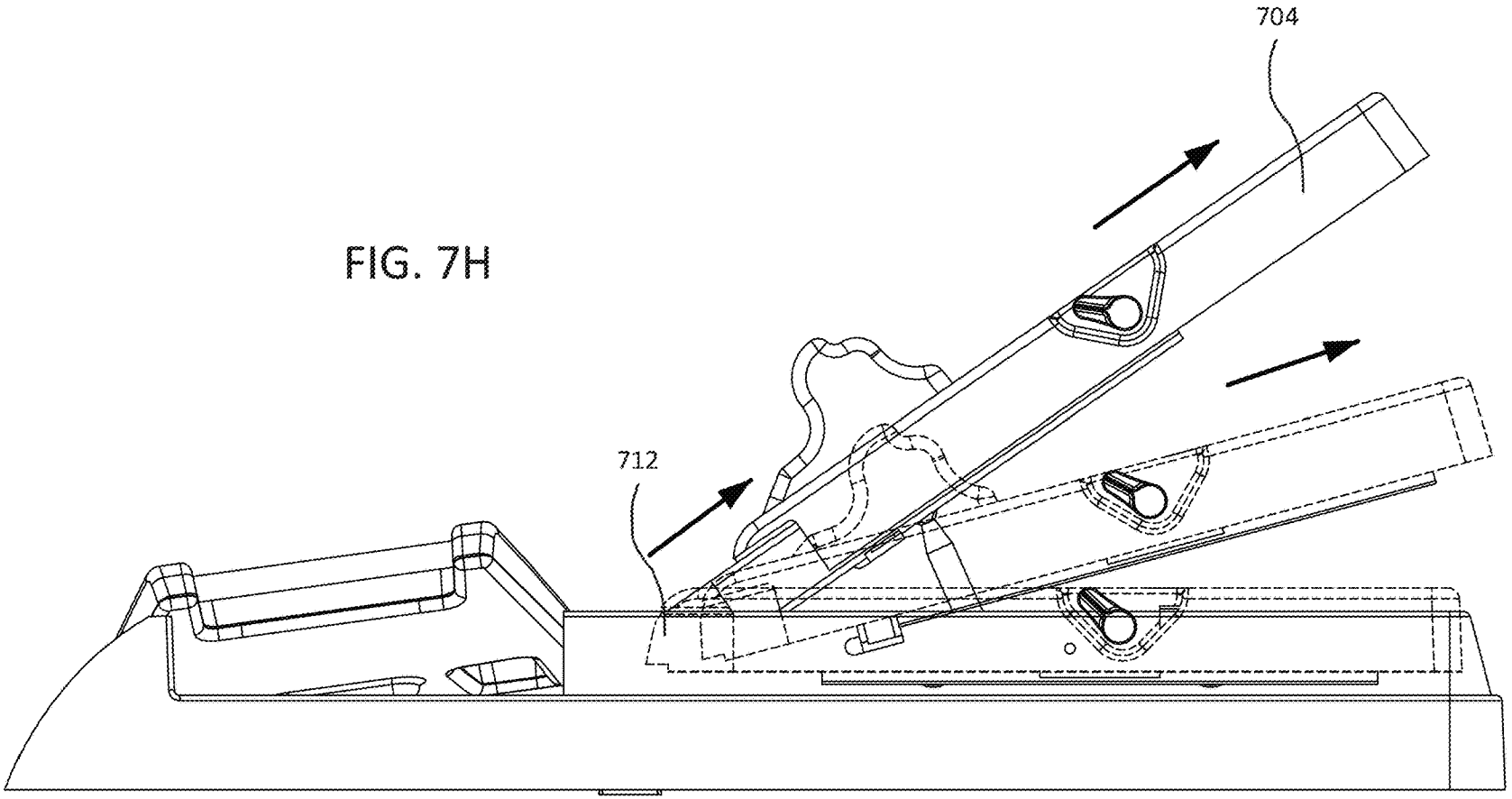
FIG. 7H depicts a lock mechanism of the support structure of FIG. 7A according to embodiments.

FIG. 7H shows possible movement of the upper support 704 during the elevation process. As noted above, the elevation device 700 and patient's body having different radii of curvature. The movement provided by the adjustable upper support 704 allows the upper support 704 to conform to the movement of the body to maintain proper support of the patient in the "sniffing position." The upper support 704 may initially be in a storage state. As the patient is positioned on the elevation device 700 and the upper support 704 is elevated, the upper support 704 may begin to slide away from the thoracic plate 706 in the direction of the arrow to accommodate the changing body position of the patient. Throughout the elevation process, the upper support 704 may continue to extend away from the thoracic plate 706 until the full elevation is reached. At this point, the patient will be maintained in the "sniffing position" in the elevated position, with the upper support 704 extended at some distance from the thoracic plate 706, effectively making the elevation device 700 longer than when the patient was in a supine position. At this point, the physician or other user may make any small adjustments to the position of the upper support 704 by sliding the upper support 704 along the roller track 714 and/or the user may lock the upper support 704 in the position using locking mechanism 708 as shown in FIG. 7G. Adjustments may be necessary to assist in airway management and/or intubation.

Figure 7I:
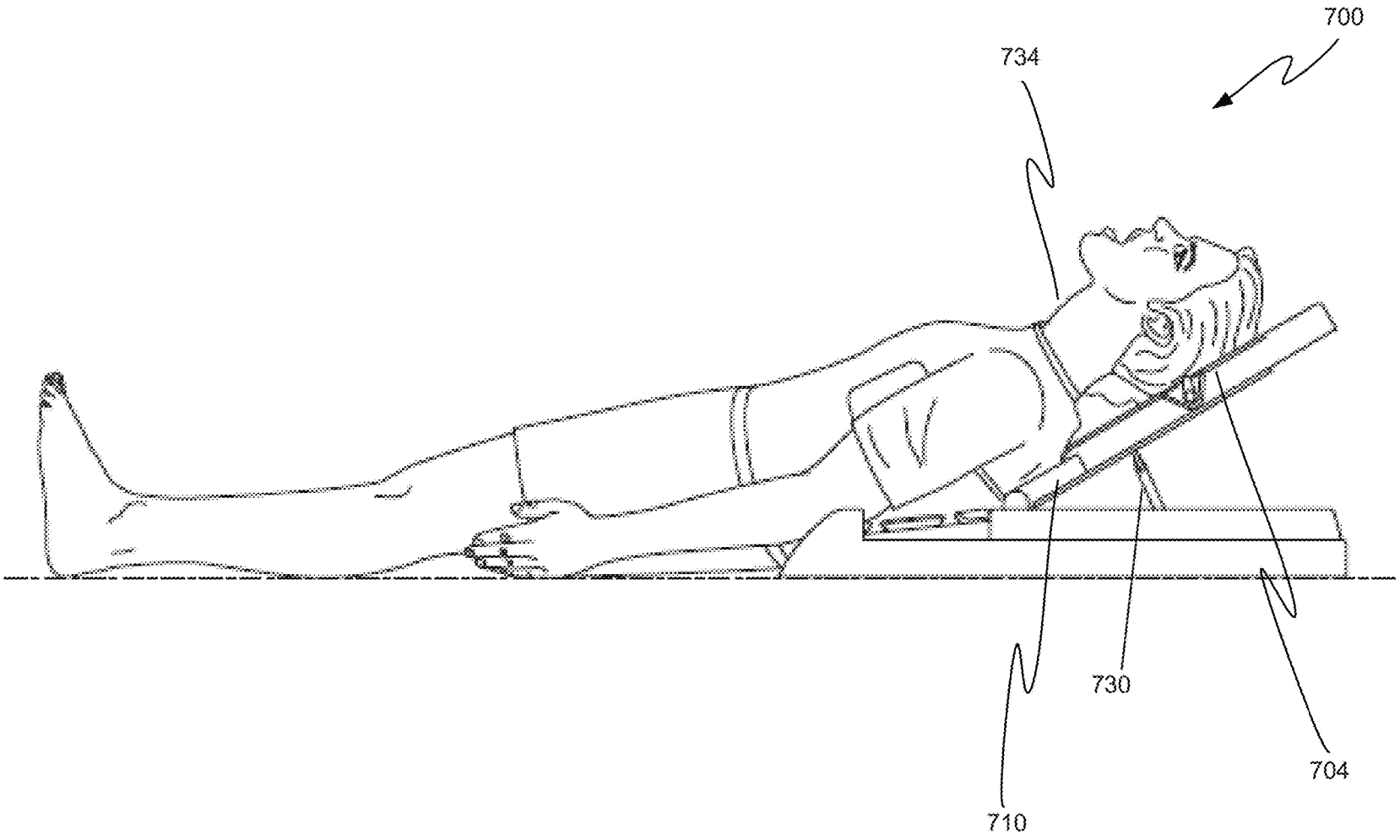
FIG. 7I depicts a patient maintained in the sniffing position using the support structure of FIG. 7A according to embodiments.

FIG. 7I shows a patient 734 positioned on the elevation device 700. Here, upper support 704 is extended along the roller track 714 as it is elevated, thereby maintaining the patient in the proper "sniffing position." Here, the thoracic plate 706 provides a static amount of elevation of the thorax, specifically the heart, in the range of about 3 cm to 7 cm. Such an elevation of the thorax promotes increased blood flow through the brain. As seen here, there are three primary contact points for the individual. The neck support 716 contacts the spine in the region of the C7-C8 vertebrae, the thoracic plate 706 contacts the back in line with the sternum, and the lower body (legs and buttocks) rest on a support surface. The lower body contact may provide stability and anchor the patient and the elevation device 700. It will be recognized that other contact points may exist as a result of individuals of different body sizes and other physiological factors. As shown here, the head of the individual may extend at least partially through the upper support 704, such as by being positioned within shaped area 726. This may help promote the sniffing position. Additionally, the individual may be properly positioned by positioning armpit supports 728 under the individual's underarms. This will not only help properly position the individual, but armpit supports 728 may help prevent the individual from sliding down the elevation device 700, thus keeping the individual properly aligned with a chest compression device.

In some embodiments, a chest compression/decompression system may be coupled with an elevation device. Proper initial positioning and orientation, as well as maintaining the proper position, of the chest compression/decompression system, is essential to ensure there is not an increased risk of damage to the patient's rib cage and internal organs. This correct positioning includes positioning and orienting a piston type automated CPR device. Additionally, testing has shown that such CPR devices, even when properly positioned, may shift in position during administration of head up CPR. Such shifts may cause an upward motion of the device relative to the sternum, and may cause an increased risk of damage to the rib cage, as well as a risk of ineffective CPR. If a piston of the CPR or chest compression/decompression device has an angle of incidence that is not perpendicular to the sternum (thereby resulting in a force vector that will shift the patient's body), there may be an increased risk of damage to the patient's rib cage and internal organs. However, it will be appreciated that certain chest compression devices may be designed to compress the chest at other angles.

Figure 8A:
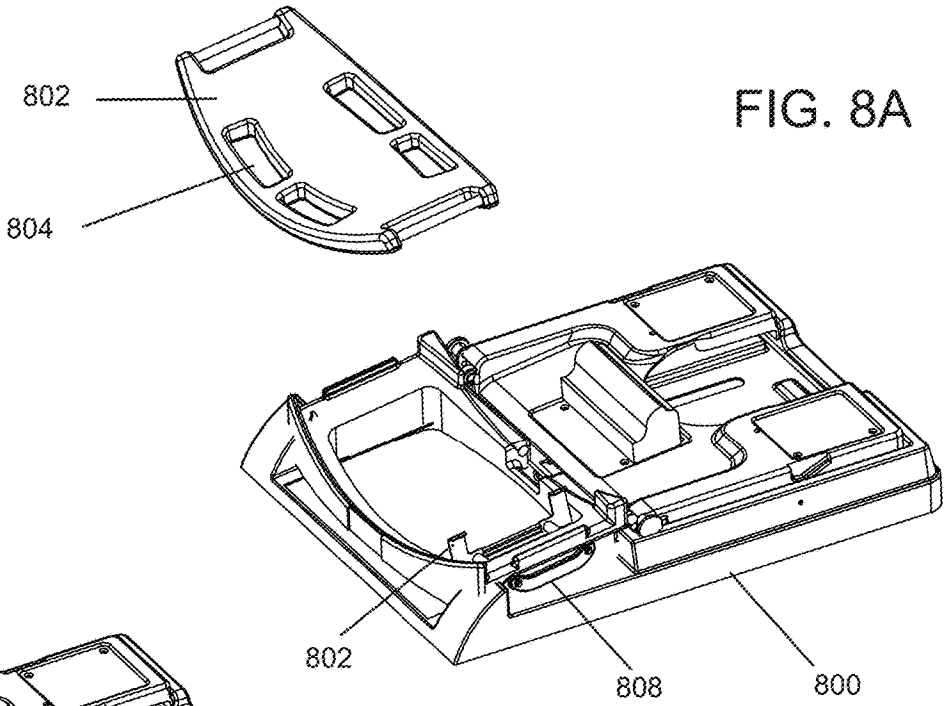
FIG. 8A depicts an exploded view of a support structure with a separable thoracic plate according to embodiments.
Figure 8B:
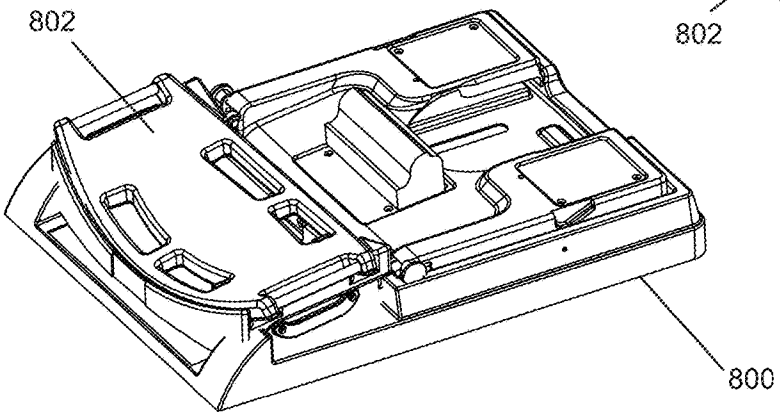
FIG. 8B depicts an assembled view of the support structure of FIG. 8A according to embodiments.
Figure 8C:
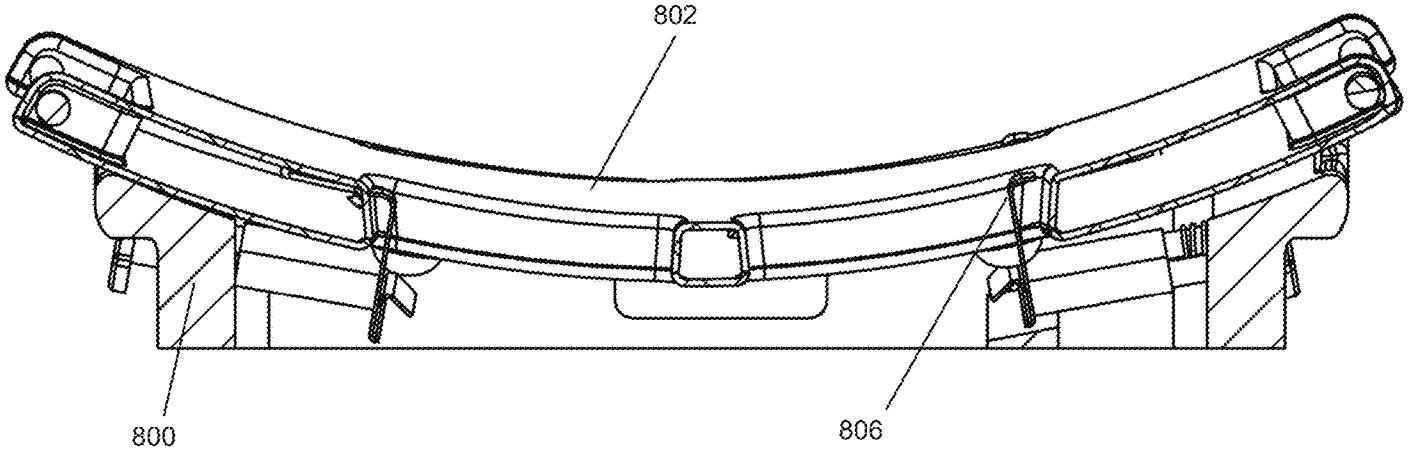
FIG. 8C depicts a cross section of the support structure of FIG. 8A showing an upper clamping arm in a receiving position according to embodiments.
Figure 8D:
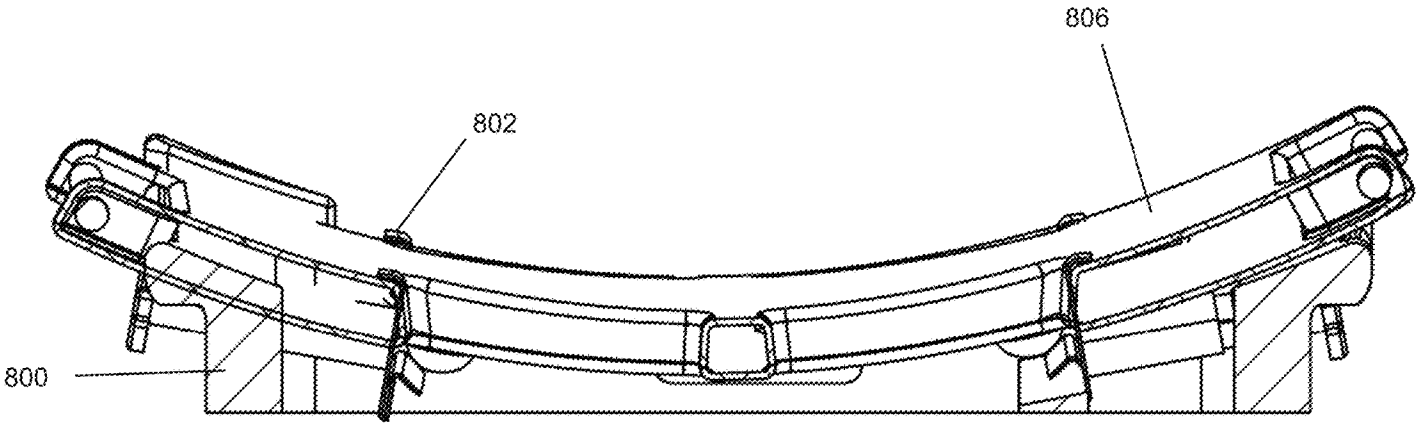
FIG. 8D depicts a cross section of the support structure of FIG. 8A showing an upper clamping arm in a locked position according to embodiments.

FIGS. 8A-8D depict an embodiment of an alternative mechanism for securing a thoracic plate to an elevation device. As seen in FIGS. 8A and 8B, thoracic plate 802 may be clipped into position on elevation device 800. When first brought into contact with elevation device 800, apertures 804 of thoracic plate 802 may be positioned over one or more clamping arms 806 of the elevation device 800. Oftentimes, each side of the elevation device 800 includes one or more clamping arms that are controllable independent of clamping arms on the other side of the elevation device, however in some embodiments both sides of clamping arms may be controllable using a single actuator. Clamping arms 806 may be slidable and/or pivotable by actuating one or more buttons, levers, or other mechanisms 808, which may be positioned on or extending from an outside surface of the elevation device 800. For example, the mechanism 808 may be moved toward the elevation device 800 to maneuver the clamping arms 806 from a receiving position that allows the clamping arms 806 to be inserted within apertures 804 and to be moved away from the elevation device to maneuver the clamping arms 806 to a locked position in which the clamping arms 806 contact a portion of the thoracic plate 802 proximate to the apertures 804. As seen in FIG. 8C, in the receiving position clamping arms 806 are disengaged from the thoracic plate 802 allowing it to be positioned on or removed from the elevation device 800. As shown in FIG. 8D, clamping arms 806 are in the locked position, with the mechanism 808 in a position pulled away from the surface of the elevation device 800. Ends of the clamping arms 806 may overlap with and engage a top surface of the thoracic plate 802, thereby maintaining the thoracic plate 802 in position relative to the elevation device 800.

In some embodiments, the thoracic plate 802 may be positioned on the elevation device 800 by manipulating both sides of clamping arms 806 and setting the thoracic plate 802 on top of the elevation device 800 with the apertures 804 aligned with the clamping arms 806. The mechanisms 808 for each of the sides of clamping arms 806 may then be manipulated to move the clamping arms 806 into the locked position. This may be done simultaneously or one by one.

Figure 9A:
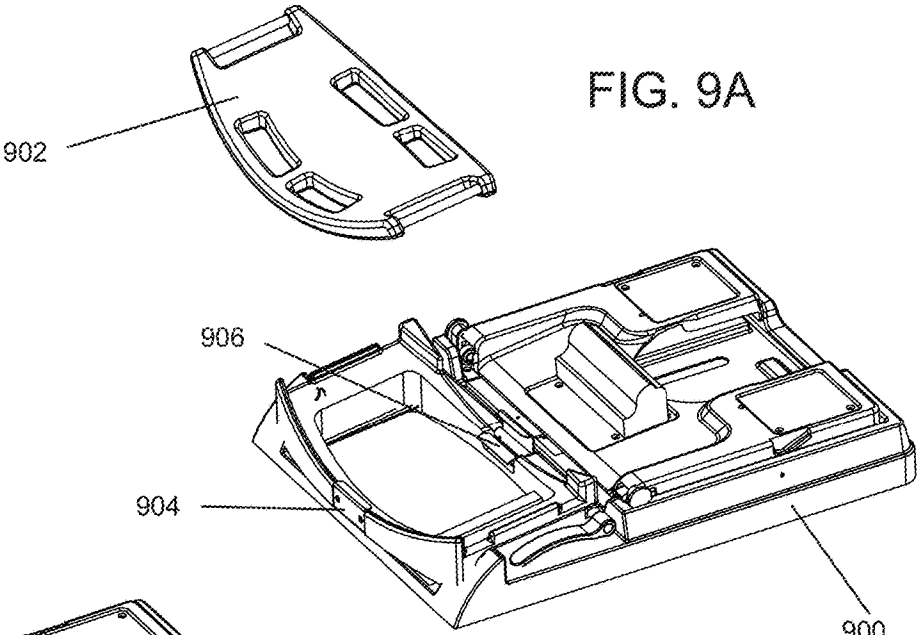
FIG. 9A depicts an exploded view of a support structure with a separable thoracic plate according to embodiments.
Figure 9B:
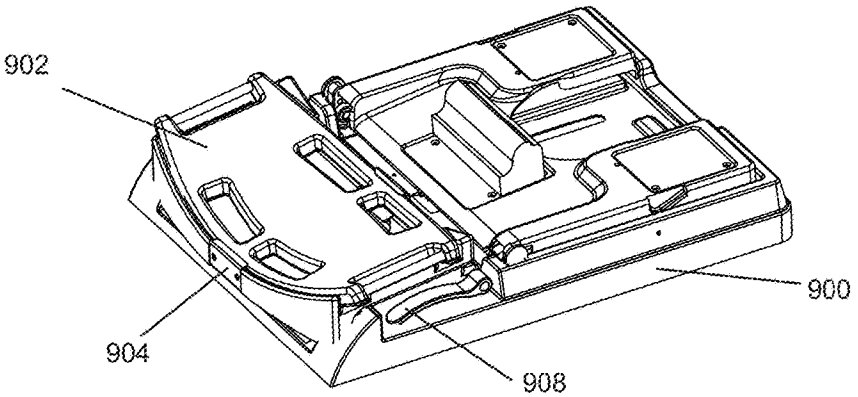
FIG. 9B depicts an assembled view of the support structure of FIG. 9A according to embodiments.
Figure 9C:
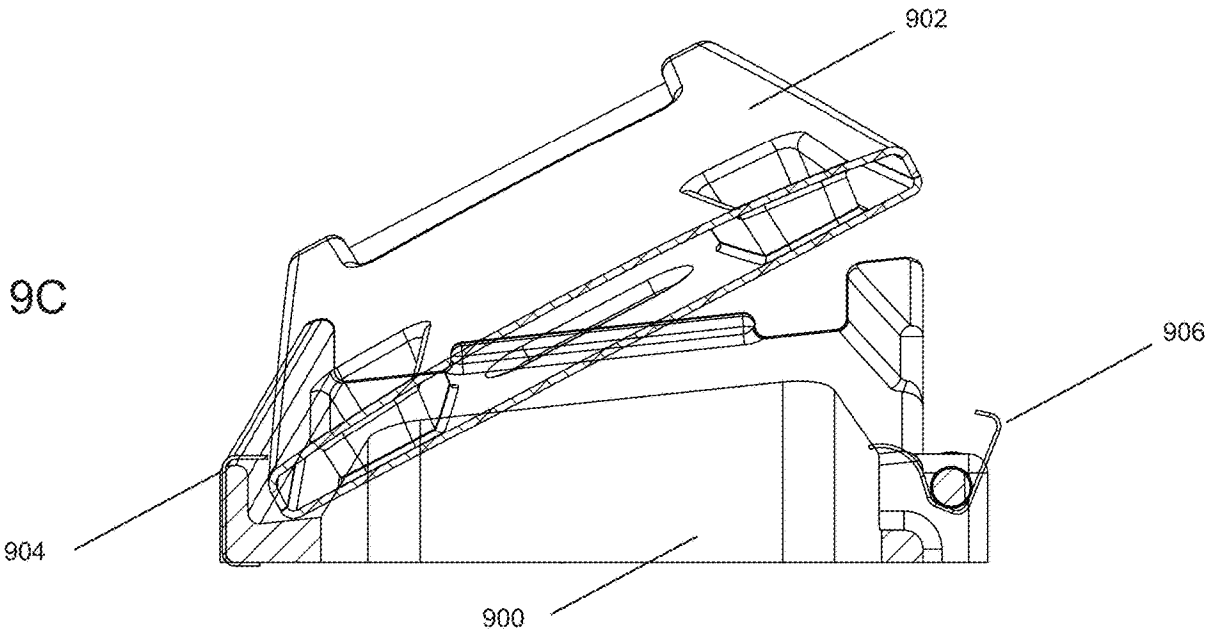
FIG. 9C depicts a cross section of the support structure of FIG. 9A showing clamping arms in a receiving position according to embodiments.
Figure 9D:
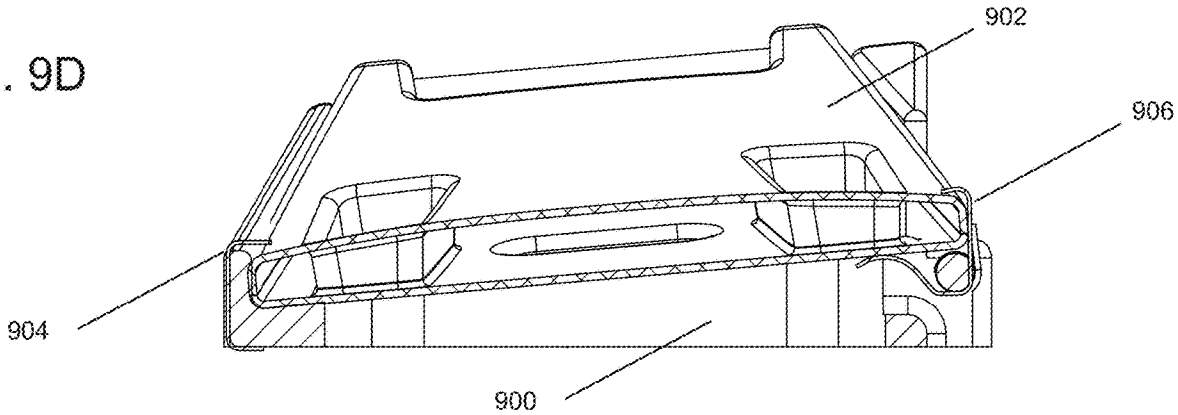
FIG. 9D depicts a cross section of the support structure of FIG. 9A showing clamping arms in a locked position according to embodiments.
Figure 9E:
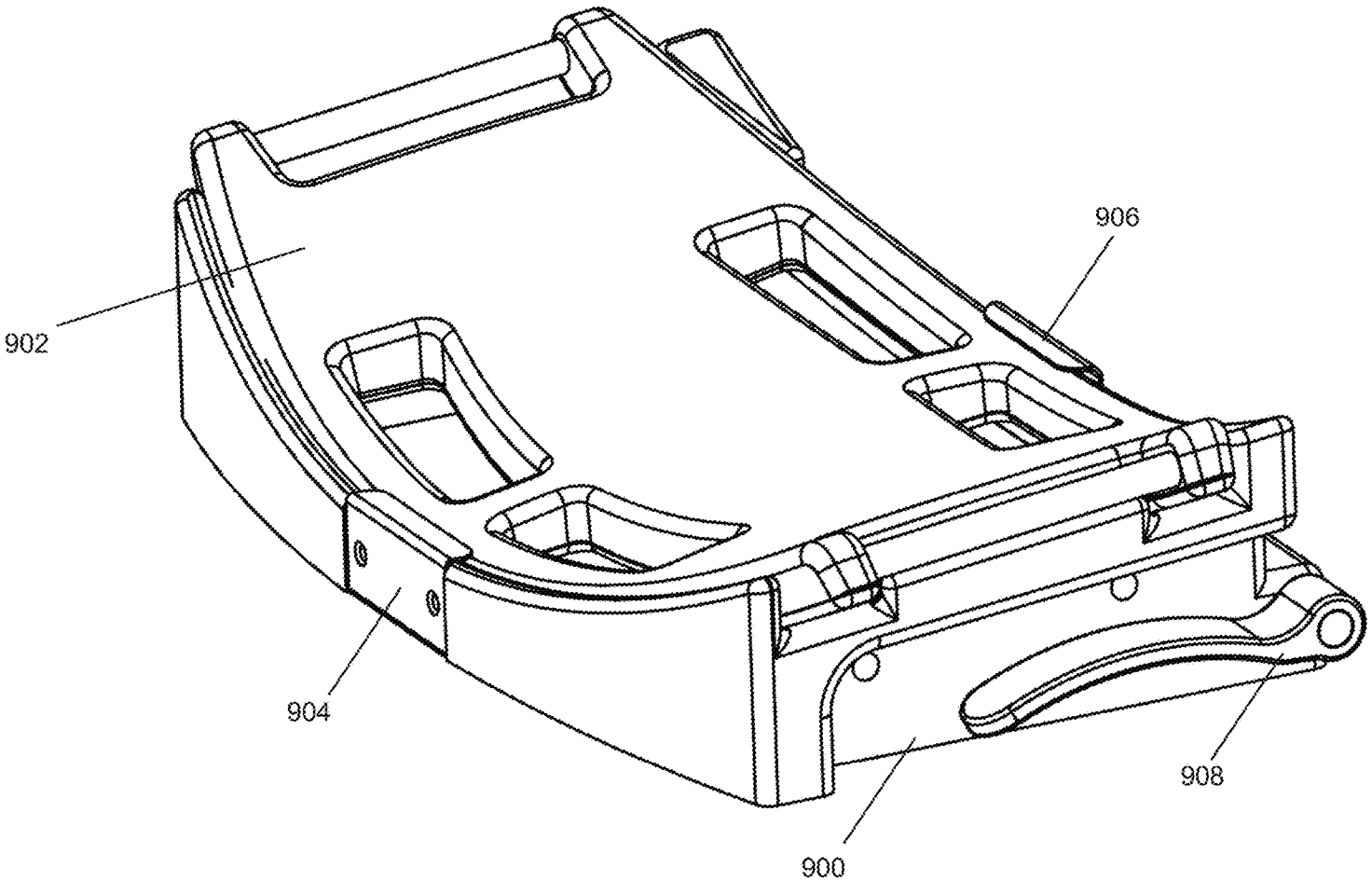
FIG. 9E depicts the support structure of FIG. 9A with clamping arms in a locked position according to embodiments.

FIGS. 9A-9E depict another alternate mechanism for securing a thoracic plate to an elevation device. As seen in FIGS. 9A and 9B, thoracic plate 902 may be clipped into position or removed from elevation device 900. In contrast to elevation device 800, elevation device 900 may secure outer edges of the thoracic plate 902, rather than edges proximate to the apertures of the thoracic plate 902. Elevation device 900 includes a lower clamp 904 and an upper clamp 906, although it will be appreciated that more than one clamp may be present at each location. Here, lower clamp 904 is fixed in position while upper clamp 906 may be slidable and/or pivotable in a direction away from the lower clamp 904 to provide sufficient area in which to insert the thoracic plate 902. The sliding and/or pivoting movement of the upper clamp 906 may be controlled by lever 908 or another mechanism, which may be positioned near an outer side of the elevation device 900, thus providing access to the lever 908 even when a patient is being supported on the elevation device 900. In some embodiments, the lever 908 may be spring biased or utilize cams to maintain the lever 908 in either extreme position. To secure the thoracic plate 902, the lever 908 may be manipulated to slide, pivot, and/or otherwise move the upper 906 away from the lower clamp 904 as shown in FIG. 9C. A lower edge of the thoracic plate 902 may then be positioned against and underneath a lip of the lower clamp 904 such that the lip prevents the thoracic plate 902 from moving away from the elevation device 900. The rest of the thoracic plate 902 may then be positioned against the elevation device 900 and the lever 908 may be maneuvered such that the upper clamp 906 moves toward lower clamp 904 as shown in FIG. 9D. This allows a lip of the upper clamp 906 to engage with a top surface of the thoracic plate 902. Once in this position, the thoracic plate 902 is maintained in the desired position by the lips of both the upper clamp 906 and lower clamp 904 as seen in FIG. 9E.

Figures 10A, 10B, 10C:
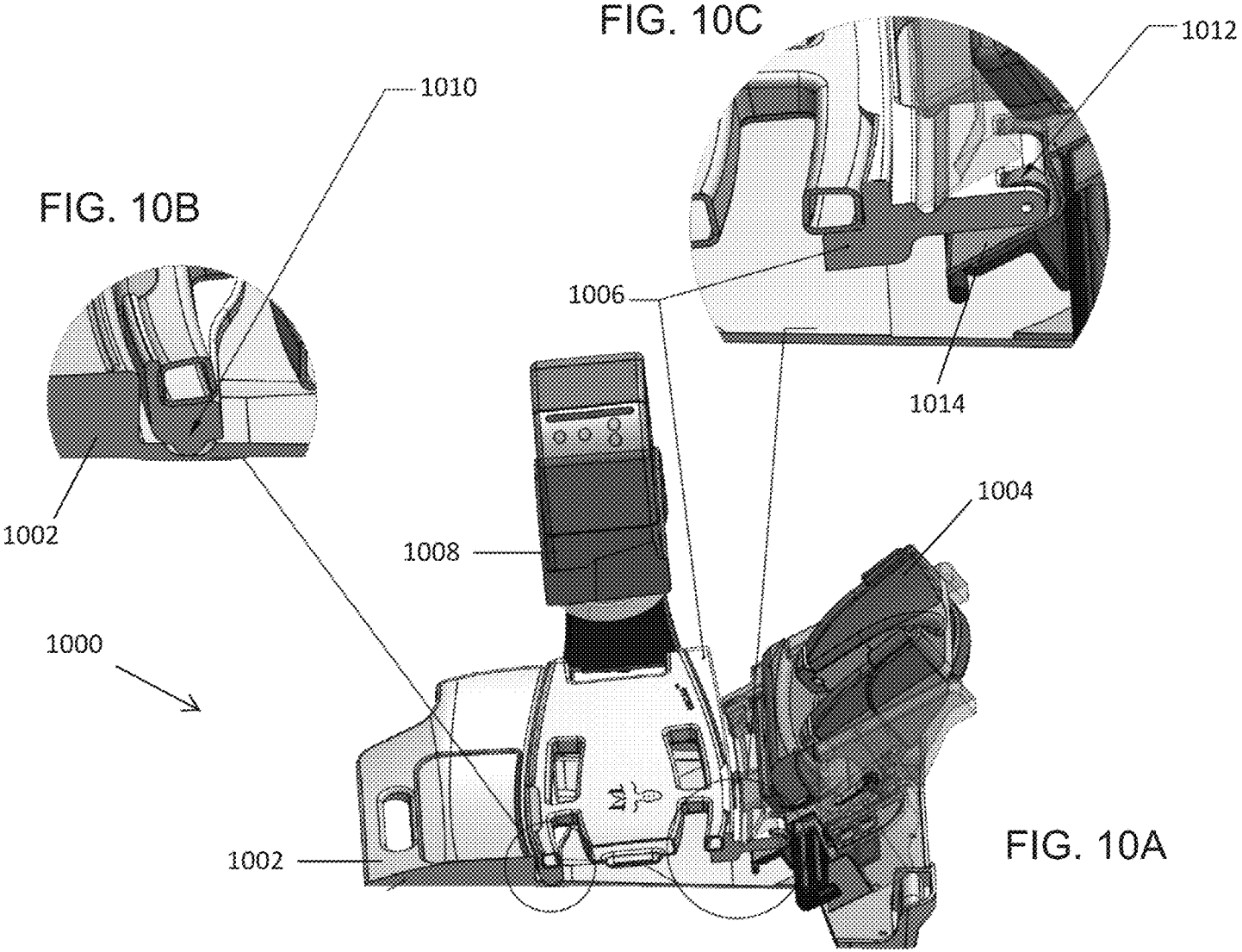
FIG. 10A depicts a mechanism for tilting a thoracic plate of an elevation device according to embodiments.
FIG. 10B depicts a pivot point of the mechanism for tilting a thoracic place of an elevation device of FIG. 10A according to embodiments.
FIG. 10C depicts a roller assembly of the mechanism for tilting a thoracic place of an elevation device of FIG. 10A according to embodiments.

FIGS. 10A-10C show a mechanism for tilting a thoracic plate 1006 while an upper support 1004 of an elevation device 1000 is elevated or otherwise inclined. Elevation device 1000 may be similar to those described above in FIGS. 7A-9D. For example, elevation device 1000 may include a base 1002 coupled with the thoracic plate 1006 and the upper support 1004 as shown in FIG. 10A. A chest compression device 1008, such as a LUCAS® device may be coupled with the thoracic plate 1006 (which may be a LUCAS® back plate) such that any movement by the thoracic plate 1006 causes a similar movement in the chest compression device 1008, thereby keeping the chest compression device 1008 aligned with the thoracic plate 1006 and an individual's sternum. Thoracic plate 1006 may be mounted to the base 1002 using any technique, such as those described in relation to FIGS. 8A-9E. As shown in FIG. 10B, thoracic plate 1006 may include a fixed pivot point 1010 on an underside of the thoracic plate 1006 on a side opposite the upper support 1004. The pivot point 1010 may enable the thoracic plate 1006 to pivot or otherwise rotate about the pivot point 1010 while a front edge of the thoracic plate 1006 remains generally in a same position relative to the base 1002. At an upper end of the thoracic plate 1006 proximate to the upper support 1004, the thoracic plate 1006 may include one or more rollers 1012 configured to be supported by a track 1014 of the upper support 1004 as shown in FIG. 10C. As the upper support 1004 elevates, the track 1014 forces the rollers 1012 upward. As the rollers 1012 are positioned at an upper end of the thoracic plate 1006, the thoracic plate 1006 is tilted at a slightly slower rate and/or to a slightly lower angle than the upper support 1004. This tilt helps combat the effects of thoracic shift due to elevation of the head and upper torso.

Figure 11A:
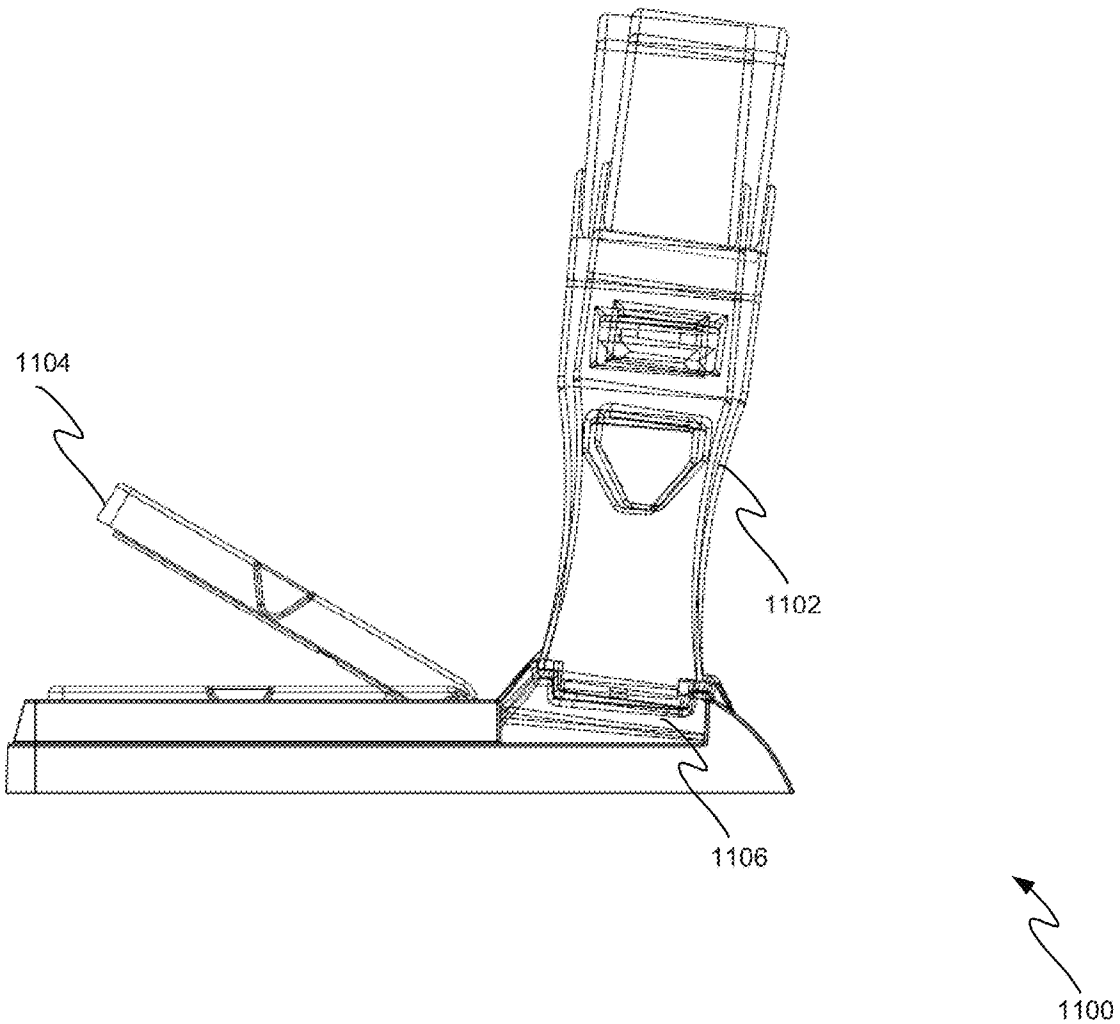
FIG. 11A depicts a support structure with a tilting thoracic plate according to embodiments.

FIGS. 11A-11E depict a elevation device 1100 for coupling with a chest compression/decompression or CPR device 1102 while combating the effects of the thoracic shift and thoracic misalignment caused by improperly aligning the CPR device and/or improperly maintaining such position and alignment. Elevation device 1100 may include similar features as elevation device 400, as well as the other elevation devices described herein. FIG. 11A shows an upper support 1104 of elevation device 1100 that is in an elevated position. During elevation, a thoracic plate 1106 is tilted to control a corresponding shift of the thorax relative to CPR device 1102. For example, a lever, cam, or other connection may link the tilt of the thoracic plate 1106 with the elevation of the upper support 1104, thereby causing the CPR device 1102 to move down and at a slightly forward angle. This tilting insures that the thorax and sternum are properly aligned with a piston of the CPR device 1102 to provide safe and effective head up CPR. Oftentimes proper alignment involves the piston being perpendicular, or substantially perpendicular, to the sternum, however in other cases non-perpendicular alignments may be desirable. In some embodiments, the thoracic plate 1106 may have a default angle relative to a horizontal plane of between about 0° and 10°. The tilt may provide an additional 2°-8° of tilt to accommodate the shifting thorax of the patient and to maintain proper alignment of the CPR device 1102.

Figure 11B:
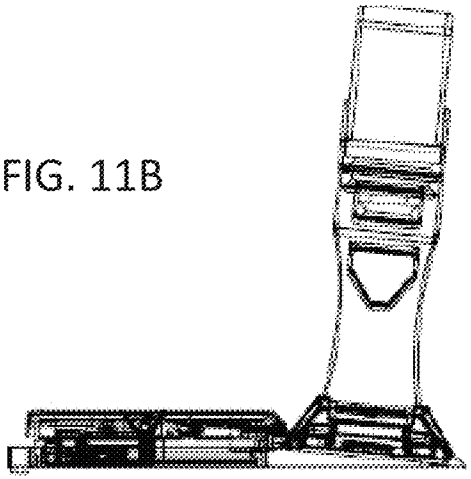
FIG. 11B depicts the support structure of FIG. 11A in a lowered position according to embodiments.
Figure 11C:
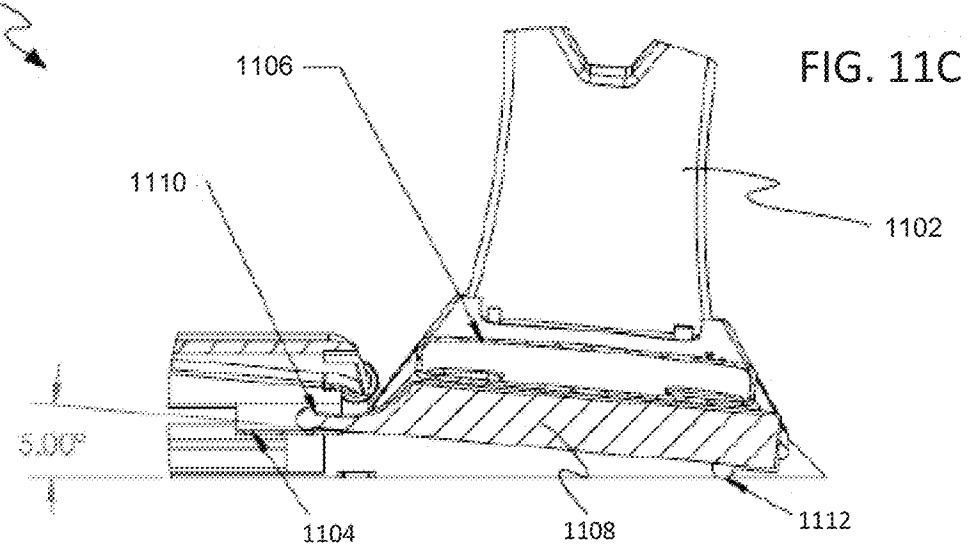
FIG. 11C depicts the support structure of FIG. 11A in a lowered position according to embodiments.
Figure 11D:
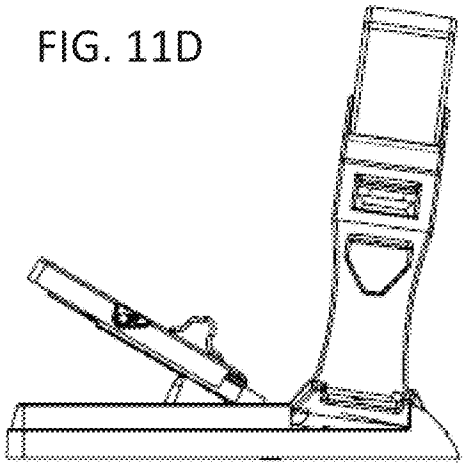
FIG. 11D depicts the support structure of FIG. 11A in a raised position according to embodiments.
Figure 11E:
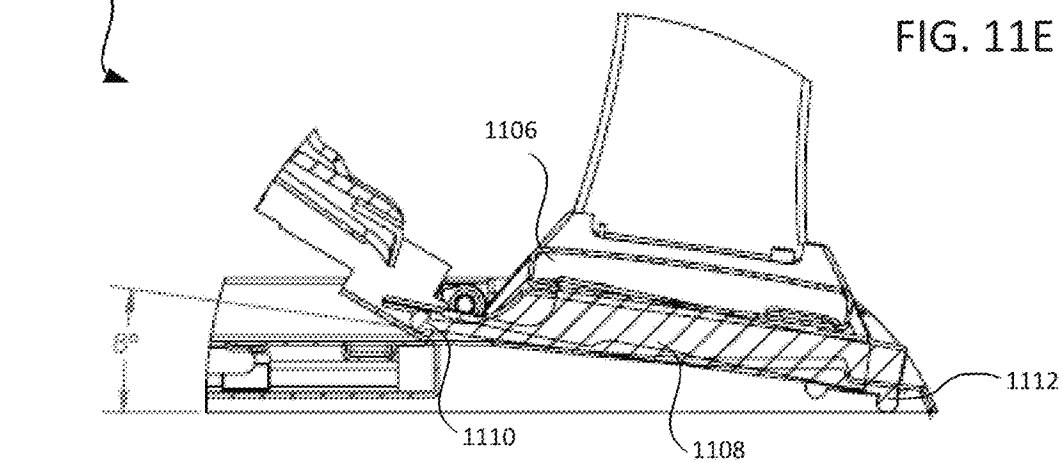
FIG. 11E depicts the support structure of FIG. 11A in a raised position according to embodiments.

FIG. 11B shows the upper support 1104 in a lowered position. In the lowered position, the thoracic plate 1106 has a default angle of elevation of approximate 10°, although it will be appreciated that other default angles may be utilized in accordance with the present invention, such as, for example, in the range of about 0° to about 8°. As seen in FIG. 11C, the thoracic plate 1106 is attached to a carriage 1118 that is attached by rollers 1110 and pivots 1112 to the upper support 1104. For example, the roller 1110 may be disposed on a rail 1140 of upper support 1104. The upper support 1104 may be elevated to the position shown in FIG. 11D. In some embodiments, upper support 1104 may be extended along a length of the elevation device 1100 during elevation of the upper support 1104. As seen in FIG. 11E, during elevation of the upper support 1104, the roller 1110 and carriage 1118 are lifted upward by the movement of the rail 1140, thereby lifting and/or tilting the thoracic plate 1106 (here by 3° to a total angle of 8°), which causes a similar change in position or orientation of the CPR device 1102. The synchronization of movement of the upper support 1104, thoracic plate 1106, and CPR device 1102 insures that the CPR device 1102 is maintained at a proper position and angle of incidence relative to the sternum throughout the head up CPR process to manage thoracic shift. The proper position and alignment of a plunger of the CPR device 1102 are necessary to prevent damage to the patient's thorax. The plunger should be positioned between about 2 and 10 cm above the base of the sternum and must stay within about 1 cm of its initial position. The plunger must be angled within about 20-25 degrees of perpendicular relative to the patient's sternum. In other words, the plunger may be positioned at an angle of between about 70° and 110° relative to the patient's chest. In some embodiments, this angle may be adjusted or otherwise controlled to achieve desired compression/decompression effects on the patient. In conjunction with this position, it is desirable for the individual's thorax to be raised between about 3 cm and 7 cm, at the location of the heart, above a horizontal plane on which the lower body is supported. Additionally, the head may be raised between about 15 cm and 25 cm above the horizontal plane, and the individual may be in the sniffing position.

Figure 12A:
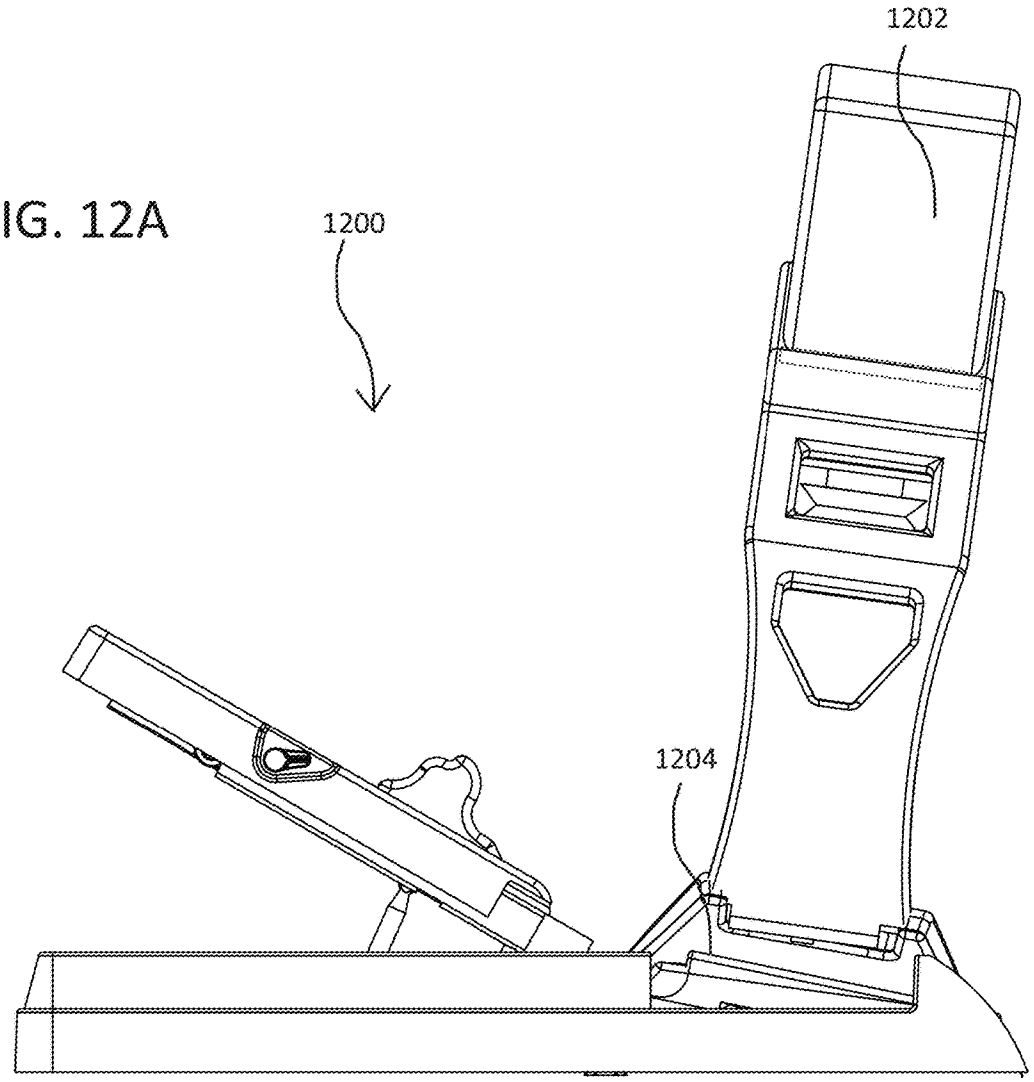
FIG. 12A depicts a support structure with a tilting and shifting thoracic plate according to embodiments.
Figure 12C:
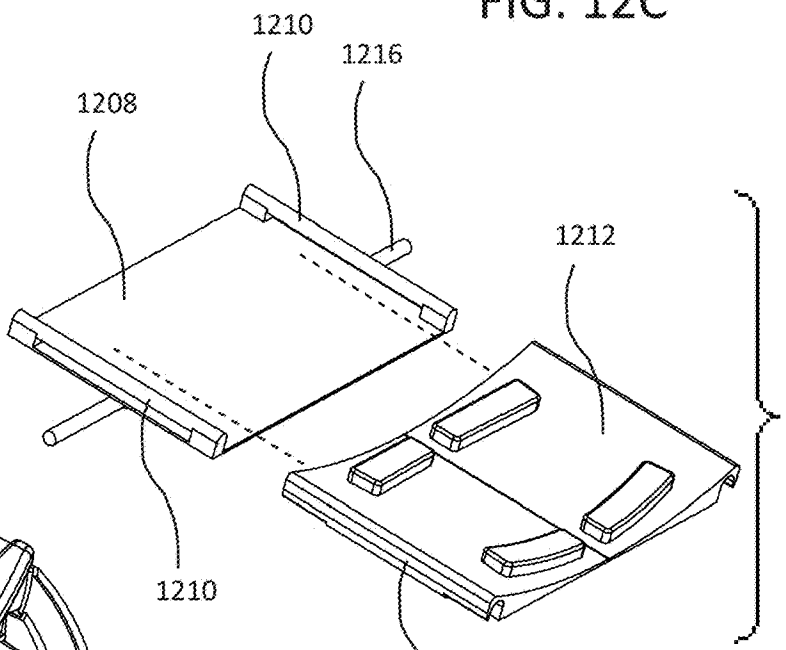
FIG. 12C depicts a pivoting base and cradle of the support structure of FIG. 12A with a according to embodiments.
Figure 12B:
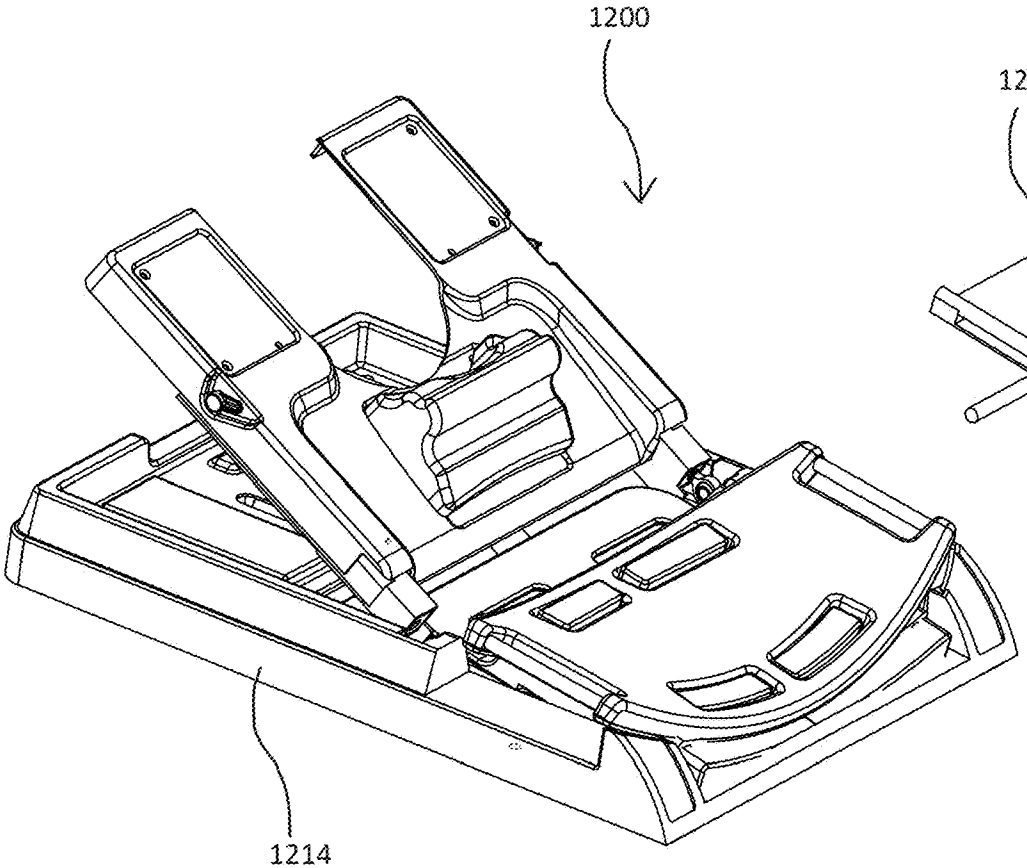
FIG. 12B depicts a pivoting base of the support structure of FIG. 12A with a according to embodiments.

FIGS. 12A-12E depict a elevation device 1200 for coupling with a chest compression/decompression or CPR device 1202 while combating the effects of the thoracic shift and thoracic misalignment caused by improperly aligning the CPR device 1202 and/or improperly maintaining such position and alignment. Elevation device 1200 may include similar features as the other elevation devices described herein. For example, elevation device 1200 may include an upper support that is extendable along a length of the elevation device 1200 during elevation of the upper support. FIGS. 12A and 12B show elevation device 1200 having an independently adjustable thoracic plate 1206. The natural tendency of the sternum, as the body is lifted/elevated, is to migrate in a downward direction due to the natural curving motion of the upper body. Elevation device 1200 includes an automatic and/or manual adjustment mechanism that allows a lengthwise position and/or an angular position of the thoracic plate 1206 to be adjusted to account for the migrating sternum. Such an adjustment mechanism may be locked to set a position of the thoracic plate 1206 and/or unlocked to allow adjustments to be made at any time during the elevation and/or CPR administration processes.

Figure 12D:
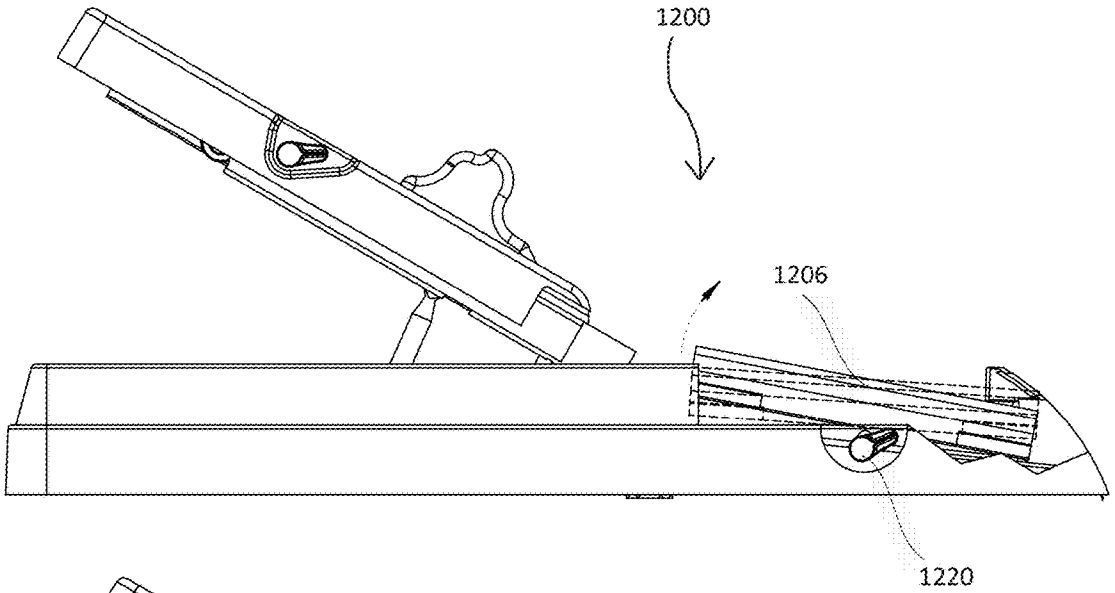
FIG. 12D demonstrates the pivoting ability of the supports structure of FIG. 12A according to embodiments.
Figure 12E:
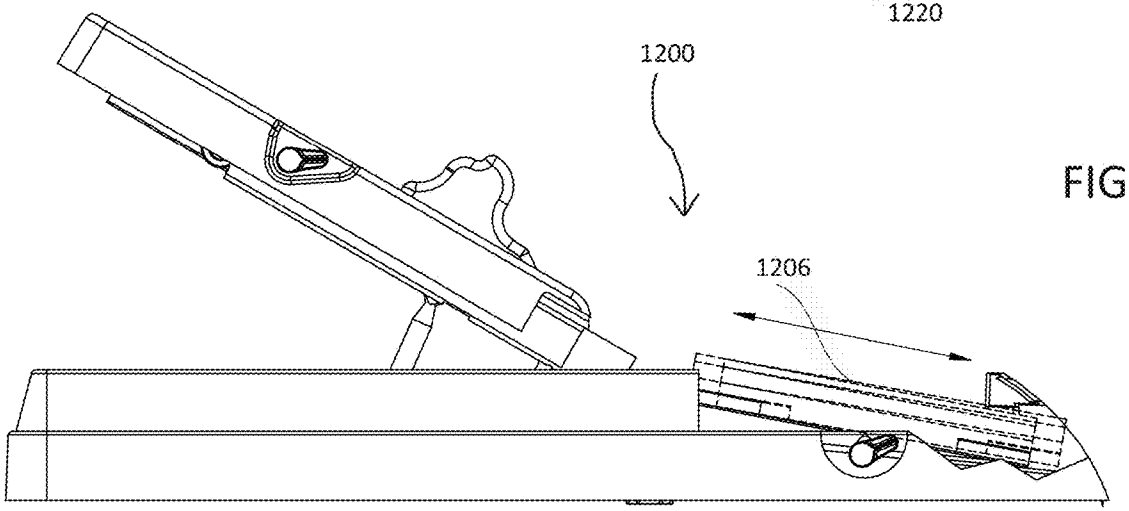
FIG. 12E demonstrates the shifting ability of the supports structure of FIG. 12A according to embodiments.

Thoracic plate 1206 includes a pivoting base 1208. As shown in FIG. 12C, pivoting base 1208 may include one or more rails or tracks 1210 that may guide a corresponding roller, track, or other guide 1218 of the thoracic plate 1206 and/or a base 1212 of the thoracic plate 1206. Pivoting base 1208 may pivotally engage with a cradle or other mating feature of a base 1214 of the elevation device 1200. For example, pivoting base 1208 may include one or more rods 1216 that may be received in corresponding cradles or channels in base 1214. The rods 1216 may rotate or otherwise pivot within the channels to allow the pivoting base 1208 to pivot about the axis of the rods 1216. Such pivoting allows the thoracic plate 1204 to be pivoted to adjust an angle of the CPR device 1202 relative to the patient's sternum once properly elevated as shown in FIG. 12D. The tracks 1210 may be engaged with guide 1218 to allow the thoracic plate 1206 and/or base 1212 to be slid laterally along the pivoting base 1208. This allows the CPR device 1202 to be laterally aligned with the patient's sternum while elevated as indicated in FIG. 12E. A locking lever 1220 may be included to lock one or both of the pivoting and the lateral movement of the thoracic plate 1206 once a desired orientation is achieved. In some embodiments, the thoracic plate 1206 may have a freedom of adjustability of between about +/−7° of tilt or pivot relative to its default position and/or between about +/−1.10 inches of lateral movement relative to its default position.

During administration of various types of head and thorax up CPR, it is advantageous to maintain the patient in the sniffing position where the patient is properly situated for endotracheal intubation. In such a position, the neck is flexed and the head extended, allowing for patient intubation, if necessary, and airway management. During elevation of the upper body, the sniffing position may require that a center of rotation of an upper elevation device supporting the patient's head be co-incident to a center of rotation of the upper head and neck region. The center of rotation of the upper head and neck region may be in a region of the spinal axis and the scapula region. Maintaining the sniffing position of the patient may be done in several ways.

In some embodiments, the motors may be coupled with a processor or other computing device. The computing device may communicate with one or more input devices such as a keypad, and/or may couple with sensors such as flow and pressure sensors. This allows a user to select an angle and/or height of the heart and/or head. Additionally, sensor inputs may be used to automatically control the motor and angle of the supports based on flow and pressure measurements, as well as a type of CPR and/or ITP regulation.

Figure 13:
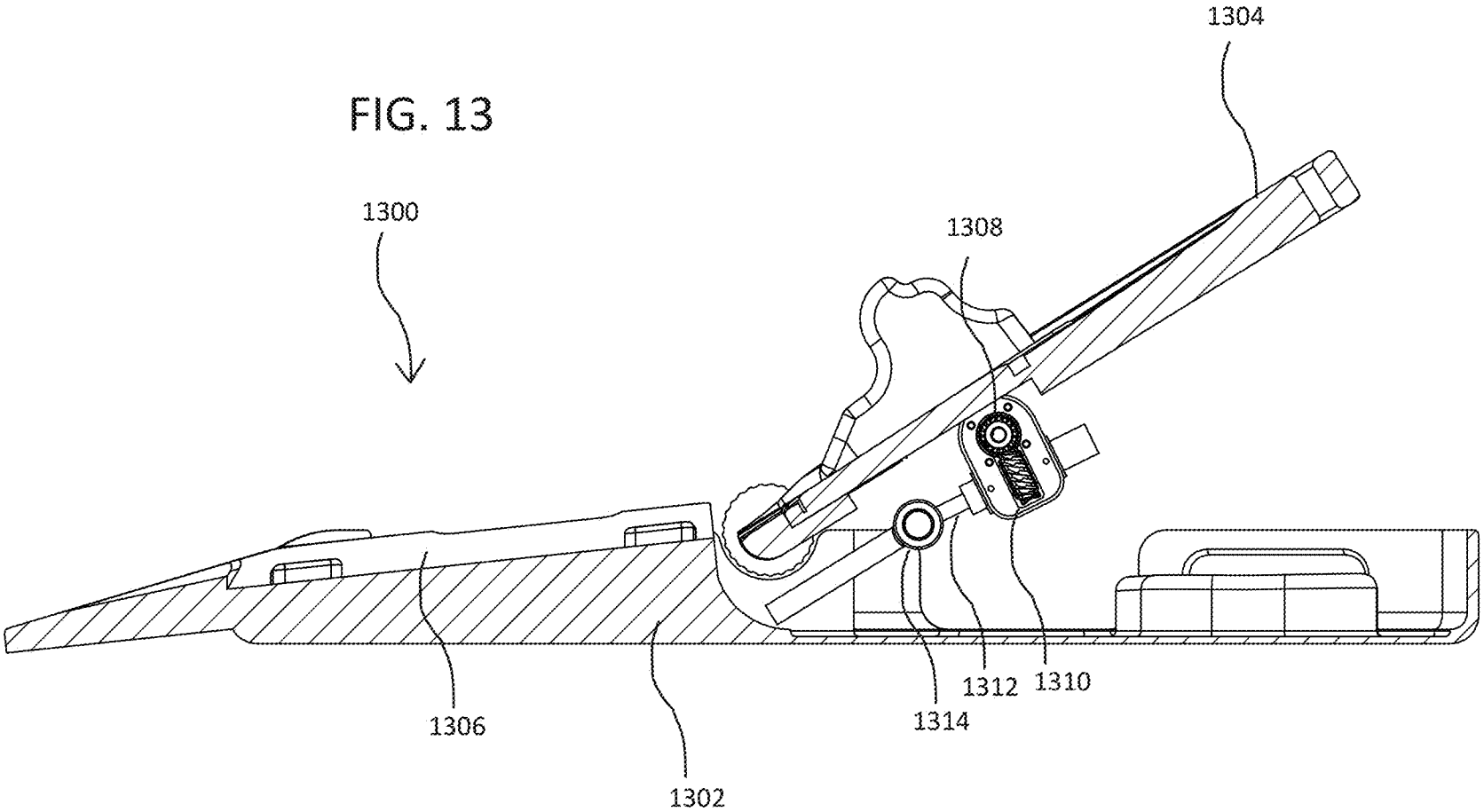
FIG. 13 depicts an elevation mechanism of a support structure according to embodiments.

FIG. 13 depicts an elevation device 1300 for elevating an individual's head, heart, and/or neck. Elevation device 1300 may be similar to the elevation devices described above and may include a base 1302, an upper support 1304, and a thoracic plate 1306. In some embodiments, the upper support may be elevated using an elevation device, such as gas springs (not shown) that utilize stored spring energy or an electric motor 1308. Electric motor 1308 may be battery powered and/or include a power cable. During operation, electric motor 1308 may raise, lower, and/or maintain a position of the upper support 1304. Here, the electric motor 1308 operates through a gearbox to generate right angle linear motion. This occurs by the motor shaft having a worm gear attached to it. This worm gear drives a right angle worm wheel 1310 that has a lead nut pressed into it. The rotation of the worm wheel/lead nut assembly causes a lead screw 1312 to move in a direction perpendicular to the original motor shaft. As lead screw 1312 extends, it pushes against a fixed linkage that has pivots at each end, thereby forcing the elevation of the upper support by pivoting about joint 1314 to raise and lower the upper support 1304. It will be appreciated that other elevation mechanisms may be utilized to raise and lower the upper support. In some embodiments, as the upper support 1304 is elevated, it may extend along a length of the elevation device 1300 to accommodate movement of the patient as described elsewhere herein.

In some embodiments, the elevation device 1300 may include a rail (not shown) that extends at least substantially horizontally along the upper support 1304 and/or the thoracic plate 1306, with a fixed pivot point near the thoracic plate 1306, such as near a pivot point of the thoracic plate 1306. The rail is configured to pivot about the fixed pivot point and is coupled with the thoracic plate 1306 such that pivoting of the rail causes a similar and/or identical pivot or tilt of the thoracic plate 1306. A collar (not shown) may be configured to slide along a length of the rail. The collar may include a removable pin (not shown) that may be inserted through an aperture defined by the collar, with a portion of the pin extending into one of a series of apertures defined by a portion of the upper support 1304. By inserting the pin into one of the series of apertures on the upper support 1304, pivoting or tilting of the rail, and thus the thoracic plate 1306, is effectuated by the elevation of the upper support 1304. By moving the position of the pin closer to the fixed pivot point, a user may reduce the angle that the thoracic plate 1306 pivots or tilts, while moving the pin away from the fixed pivot point increases the degree of elevation of the rail, and thus increases the amount of tilting of the thoracic plate 1306 while still allowing both the thoracic plate 1306 and the upper support 1304 to return to an initial supine position. In this manner, a user may customize an amount of thoracic plate tilt that corresponds with a particular amount of elevation. For example, with a pin in a middle position along the rail, elevating the upper support 1304 to a 45° angle may cause a corresponding forward tilt of the thoracic plate 1306 of 12°. By moving the pin to a position furthest from the fixed pivot point along the rail, upper support 1304 to a 45° angle may cause a corresponding forward tilt of the thoracic plate 1306 of 20°. It will be appreciated that any combination of upper support 1304 and thoracic plate 1306 elevation and/or tilting may be achieved to match a particular patient's body size and that the above numbers are merely two examples of the customization achievable using a pin and rail mechanism.

Figure 14:
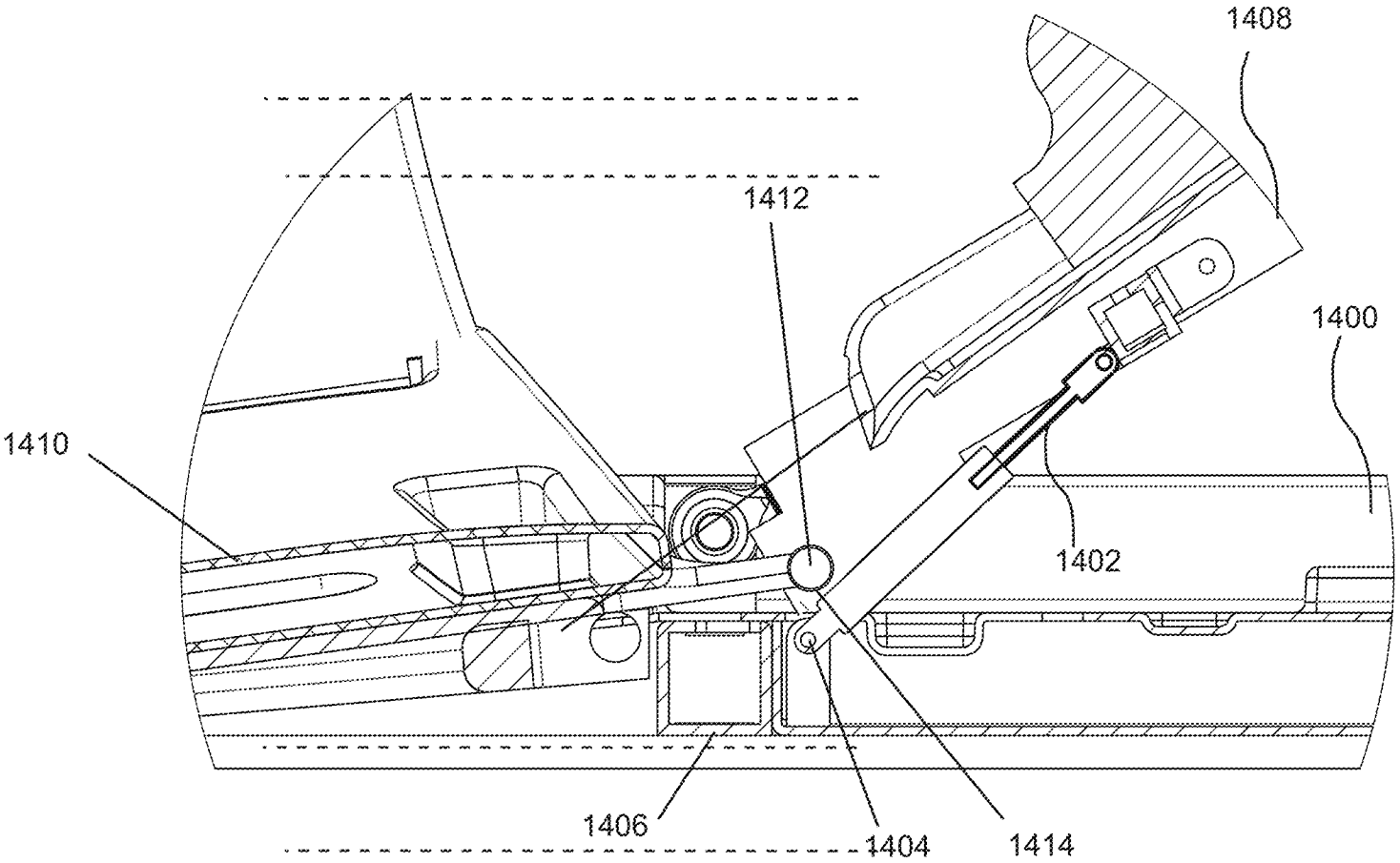
FIG. 14 depicts an elevation mechanism of a support structure according to embodiments.

For example, a gas strut may be used to elevate an upper support in a similar manner. FIG. 14 depicts an elevation device 1400 that utilizes a gas strut 1402. Ends of the gas strut 1402 may be positioned on elevation device 1400 similar to the ends of the motor mechanism in the embodiment of FIG. 13. For example, one end of the strut 1402 may be positioned at a pivot point 1404 near a base 1406 of the elevation device 1400, while the other end is fixed to a portion of an upper support 1408 of the elevation device 1400. The strut 1402 may be extended or contracted, just as the lead screw extends and contracts, which drives elevation changes of the upper support 1408. In some embodiments, an angle of a thoracic plate 1410 may be adjusted as a result of the elevation of the upper support 1408 changing. A roller 1412 or other support of the thoracic plate 1410 may be positioned on a rail 1414 or other support feature of the upper support. In the lower or supine position, the rail 1414 supports the roller 1412 at a low level, and maintains the thoracic plate 1410 at an initial angle relative to a horizontal plane. As the upper support 1408 is elevated, so is the rail 1414. The elevation of rail 1414 forces roller 1412 upward, thereby tilting the thoracic plate 1410 away from the upper support 1408 and increasing an angle of the thoracic plate 1410 relative to the horizontal plane., which may help combat thoracic shift. For example, elevating the upper support 1408 from a lowest position to a fully raised position may result in the thoracic plate 1410 tilting between 3 and 10 degrees. In some embodiments, as the upper support 1408 is elevated, it may extend along a length of the elevation device 1400 to accommodate movement of the patient as described elsewhere herein.

Figure 15A:
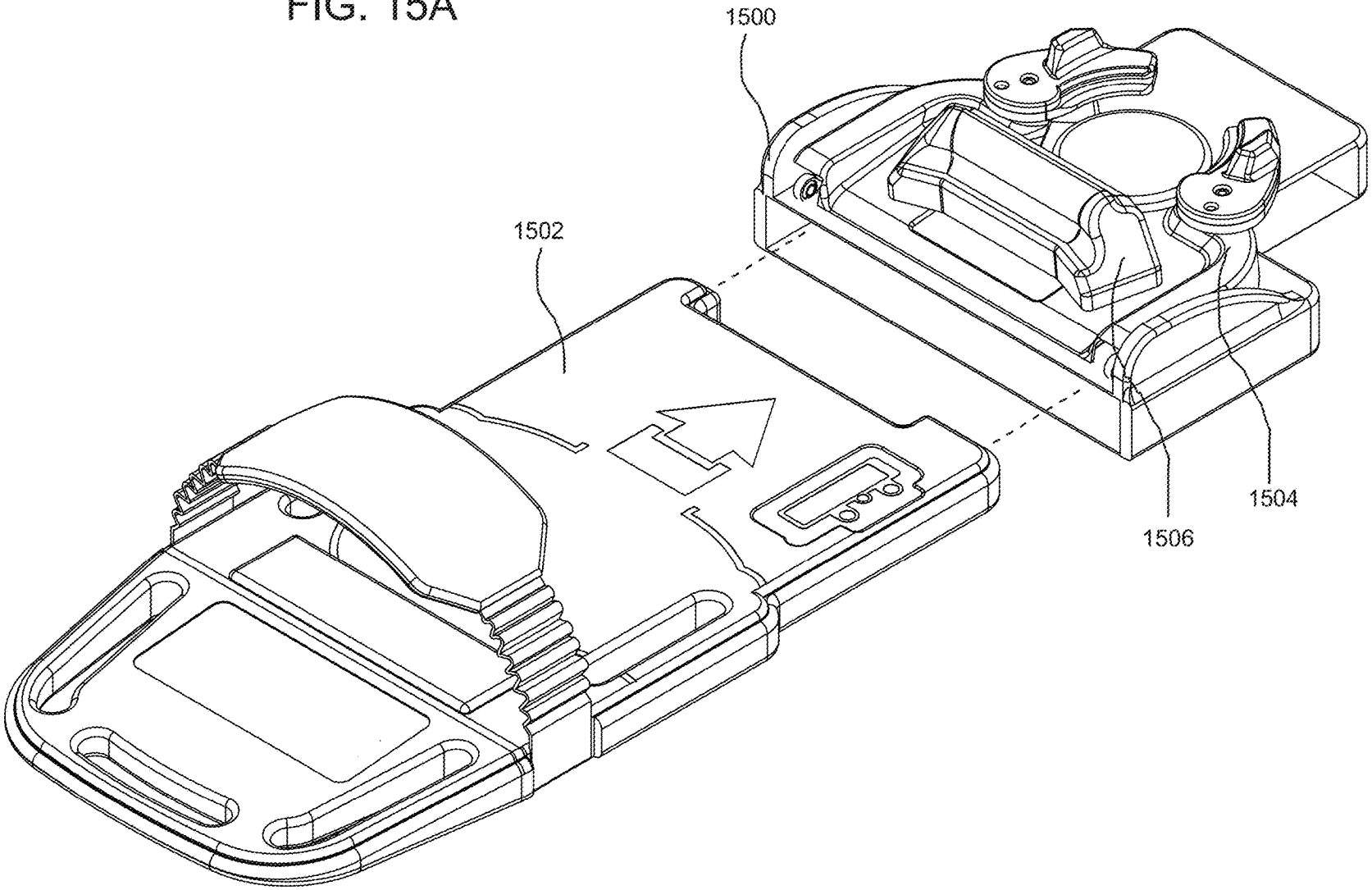
FIG. 15A depicts a support structure with a separable base according to embodiments.
Figure 15B:
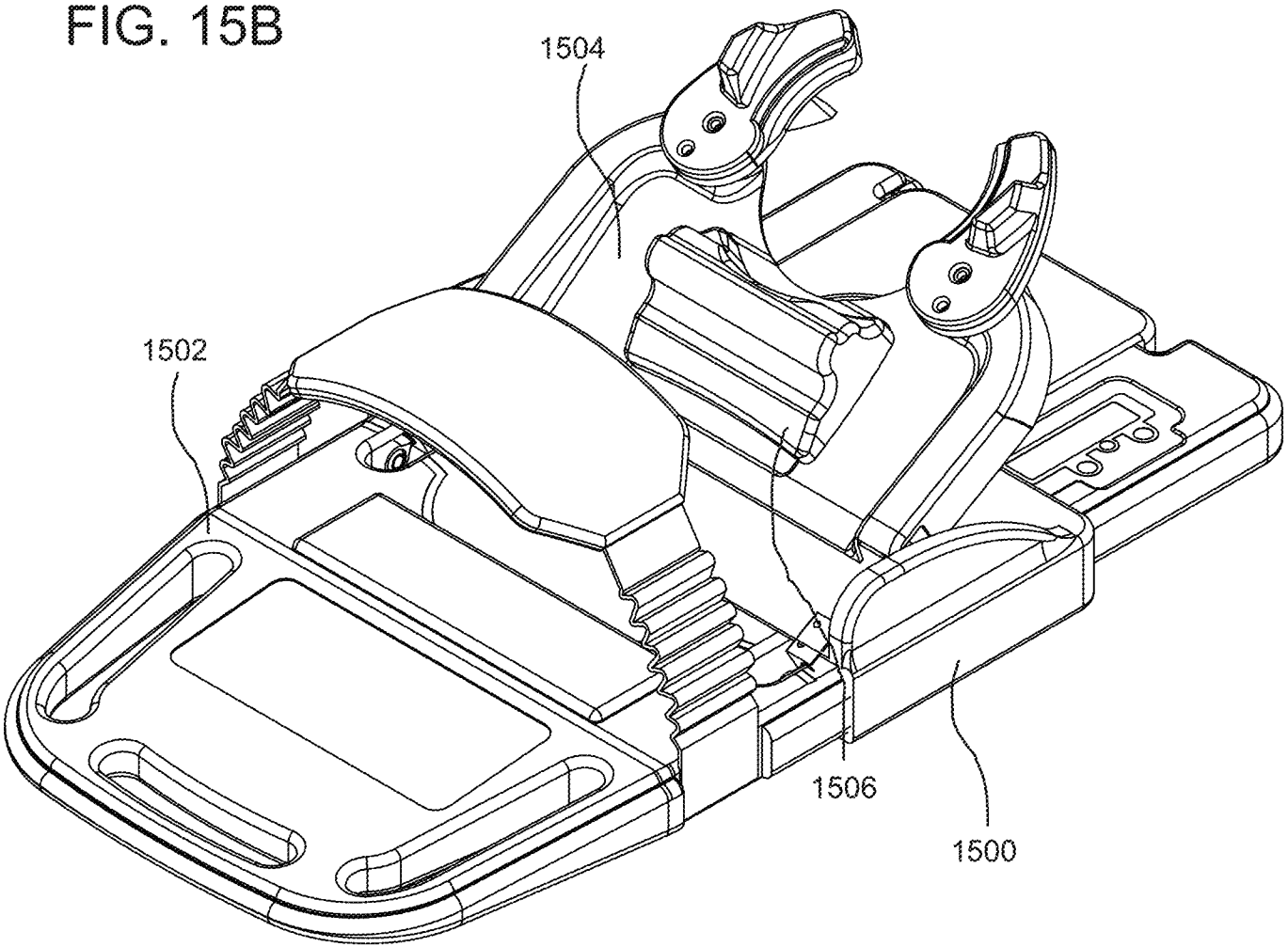
FIG. 15B depicts the support structure with a separable base of FIG. 19A coupled as a single unit according to embodiments.

FIGS. 15A and 15B depict an embodiment of an elevation device 1500 having a removable base 1502. Elevation device 1500 may be similar to the elevation devices described above, however rather than having a thoracic plate the elevation device 1500 may have a channel that receives the base 1502 or other back plate that may support at least a portion of the patient's torso and/or upper body. Base 1502 may be a wedge or other shape that may be made of foam, plastic, metal, and/or combinations thereof. Base 1502 may be completely separable from elevation device 1500 as shown in FIG. 15A. Base 1502 may be configured to slide within the channel of elevation device 1500 when head up CPR is desired. When outside of the channel, base 1502 may be used to couple a load-distributing band to the patient during supine CPR. If head up CPR is needed, the patient's head, neck, and shoulders may be lifted, the base 1502 may be slid into the channel, and the head, neck, and shoulders may be lowered onto an upper support 1504 of the elevation device 1500. In some embodiments, the elevation device 1500 may include clamps or locks that secure the base 1502 in position such that the base 1502 does not slide during performance of CPR. When coupled as shown in FIG. 15B, elevation device 1500 and base 1502 form an elevation device with similar functionality as those described herein, with the base 1502 supporting part of the patient's torso and providing a point of coupling for a CPR assist device, while elevation device 1500 includes an upper support 1504 and neck pad 1506 that may be elevated and expanded along a length of the elevation device 1500 to maintain the patient's head, neck, and shoulders in a proper position, such as the sniffing position, during elevation and head up CPR. By having an elevation device 1500 separate from the base 1502, it is possible to use various chest compression devices with the elevation device 1500.

Figure 16:
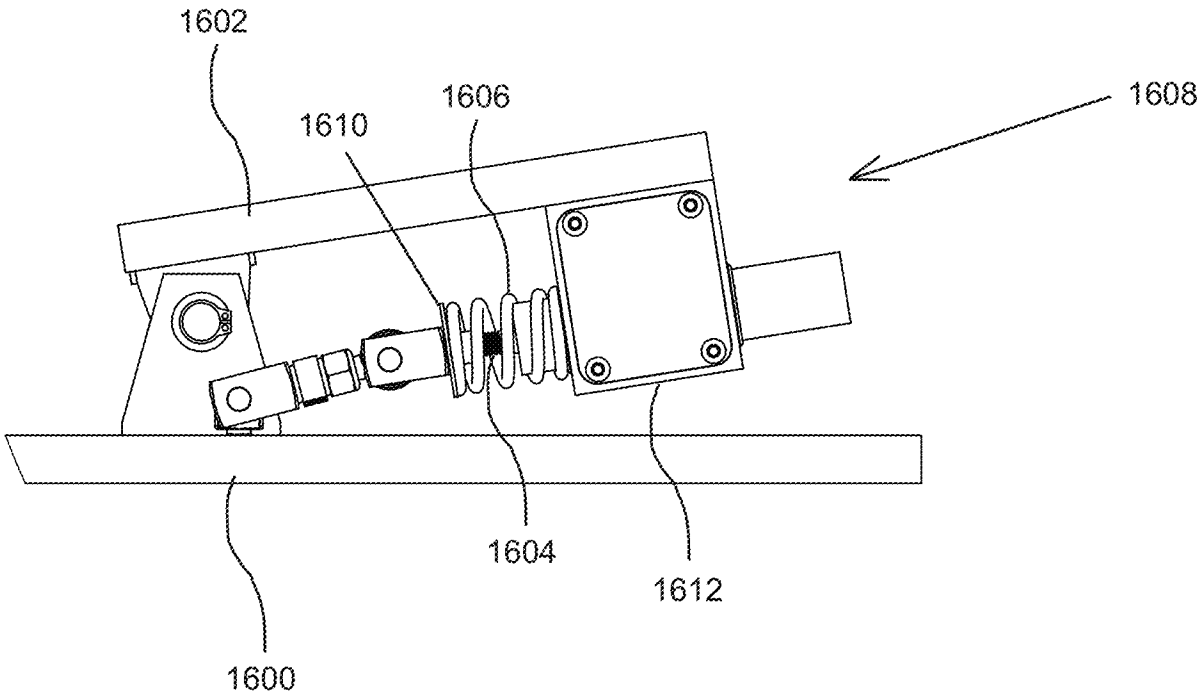
FIG. 16 depicts a spring-assisted motor mechanism of a support structure according to embodiments.

FIG. 16 depicts one embodiment of a spring-assisted motor assembly 1608 for an elevation device 1600. Elevation device 1600 and motor assembly 1608 may operate similar to the motors described herein. For example, elevation device 1600 may include a base and an upper support 1602. The upper support 1602 may be elevated using motor assembly 1608, which may be battery powered and/or include a power cable. During operation, motor assembly 1608 may raise, lower, and/or maintain a position of the upper support 1602. Here, the motor assembly 1608 operates through a gearbox to generate right angle linear motion. This occurs by the motor shaft having a worm gear attached to it. This worm gear drives a right angle worm wheel that has a lead nut pressed into it. The rotation of the worm wheel/lead nut assembly causes a lead screw 1604 to move in a direction perpendicular to the original motor shaft. As lead screw 1604 extends, it pushes against a fixed linkage that has pivots at each end, thereby forcing the elevation of the upper support by pivoting about a joint to raise and lower the upper support 1602. A spring 1606 may be positioned concentrically with the lead screw 1604. Spring 1606 is configured to store potential energy when the spring 1606 is compressed, such as when the motor assembly 1608 is used to lower the upper support 1602. This occurs as lead screw 1604 contracts, a spring stop 1610 and a motor assembly housing 1612 (or another spring stop) are drawn toward one another. Spring 1606 is positioned between the spring stop 1610 and the motor assembly housing 1612, with the ends of spring 1606 coupled with and/or positioned against the spring stop 1610 and/or motor assembly housing 1612. The drawing of the spring stop 1610 toward the motor assembly housing 1612 thereby forces spring 1606 to compress. As the motor assembly 1608 is used to elevate the upper support 1602, the motor assembly housing 1612 is drawn away from spring stop 1610, allowing the spring 1606 to expand and release some or all of the stored potential energy in a direction matching the direction of extension of lead screw 1604, thereby providing additional force to aid the motor assembly 1608 in lifting the upper support 1602. This reduces the electrical energy requirement (batteries or other electrical power source) on the motor assembly 1608, allowing the elevation device 1600 to operate with a lower energy cost, as well as reducing the strain on the motor assembly 1608, which may allow a less powerful motor to be used.

Figure 17:
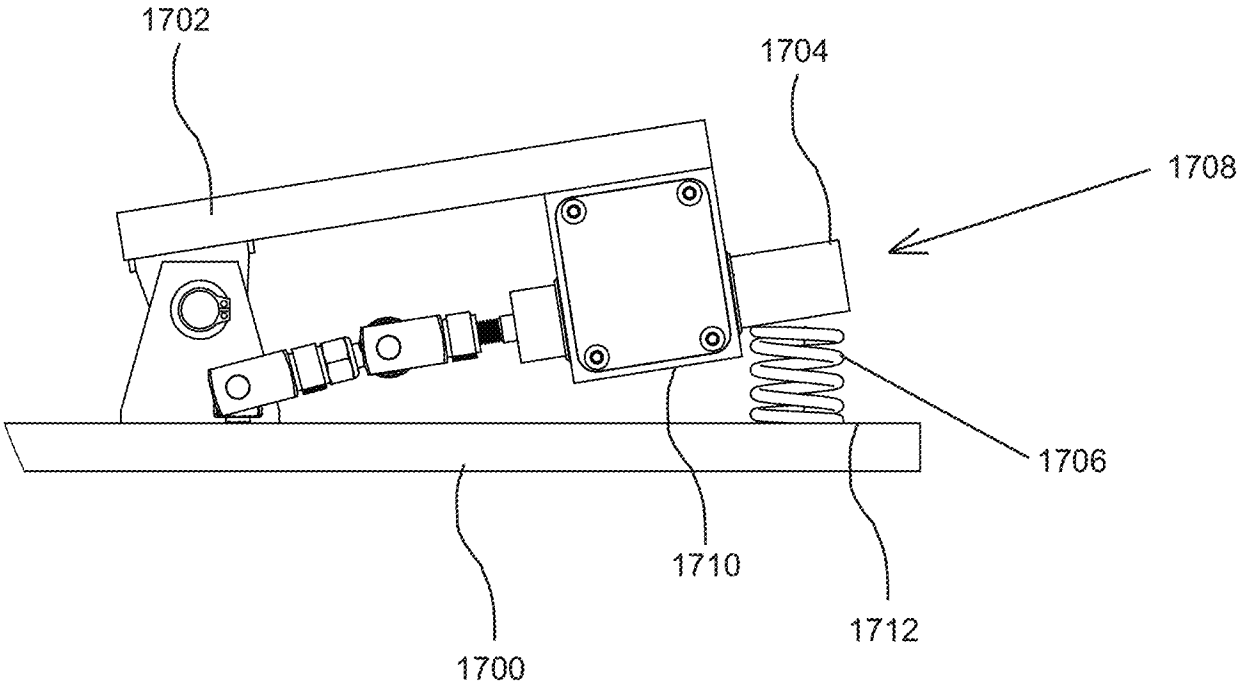
FIG. 17 depicts a spring-assisted motor mechanism of a support structure according to embodiments.

FIG. 17 depicts another embodiment of a spring-assisted motor assembly 1708 for an elevation device 1700. Elevation device 1700 and motor assembly 1708 may operate similar or identical to the other elevation devices and motor assemblies described above. For example, elevation device 1700 may include a base and an upper support 1702. The upper support 1702 may be elevated using motor assembly 1708, which may be battery powered and/or include a power cable. During operation, motor assembly 1708 may raise, lower, and/or maintain a position of the upper support 1702. Here, the motor assembly 1708 operates through a gearbox to generate right angle linear motion. This occurs by the motor shaft having a worm gear attached to it. This worm gear drives a right angle worm wheel that has a lead nut pressed into it. The rotation of the worm wheel/lead nut assembly causes a lead screw to move in a direction perpendicular to the original motor shaft. As lead screw extends, it pushes against a fixed linkage that has pivots at each end, thereby forcing the elevation of the upper support by pivoting about a joint to raise and lower the upper support 1702. A spring 1706 may be positioned between a base 1712 of the elevation device 1700 and one or both of an extension 1704 or a motor assembly housing 1710. Spring 1706 is configured to store potential energy when the spring 1706 is compressed, such as when the motor assembly 1708 is used to lower the upper support 1702. This occurs as the upper support 1702 is lowered, the extension 1704 and motor assembly housing 1710 are also lowered, drawing the components toward the base 1712 and forcing spring 1706 to compress. As the motor assembly 1708 is used to elevate the upper support 1702, the motor assembly housing 1710 and extension 1704 are drawn away from base 1712, allowing the spring 1706 to expand and release some or all of the stored potential energy in an upward direction, thereby providing additional force to aid the motor assembly 1708 in lifting the upper support 1702. This reduces the electrical energy requirement (batteries or other electrical power source) on the motor assembly 1708, allowing the elevation device 1700 to operate with a lower energy cost, as well as reducing the strain on the motor assembly 1708, which may allow a less powerful motor to be used.

In some embodiments, active decompression may be provided to the patient receiving CPR with a modified load distributing band device (e.g. modified Zoll Autopulse® band) by attaching a counter-force mechanism (e.g. a spring) between the load distributing band and the head up device or elevation device. Each time the band squeezes the chest, the spring, which is mechanically coupled to the anterior aspect of the band via an arch-like suspension means, is actively stretched. Each time the load distributing band relaxes, the spring recoils pulling the chest upward. The load distributing band may be modified such that between the band the anterior chest wall of the patient there is a means to adhere the band to the patient (e.g. suction cup or adhesive material). Thus, the load distributing band compresses the chest and stretches the spring, which is mounted on a suspension bracket over the patient's chest and attached to the head up device.

In other embodiments, the decompression mechanism is an integral part of the head up device and mechanically coupled to the load distributing band, either by a supermagnet or an actual mechanical couple. The load distributing band that interfaces with the patient's anterior chest is modified so it sticks to the patient's chest, using an adhesive means or a suction means. In some embodiments, the entire ACD CPR automated system is incorporated into the head up device, and an arm or arch is conveniently stored so the entire unit can be stored in a relative flat planar structure. The unit is placed under the patient and the arch is lifted over the patient's chest. The arch mechanism allows for mechanical forces to be applied to the patient's chest orthogonally via a suction cup or other adhesive means, to generate active compression, active decompression CPR. The arch mechanism may be designed to tilt with the patient's chest, such as by using a mechanism similar to that used to tilt the thoracic plate in the embodiments described herein.

Figure 18A:
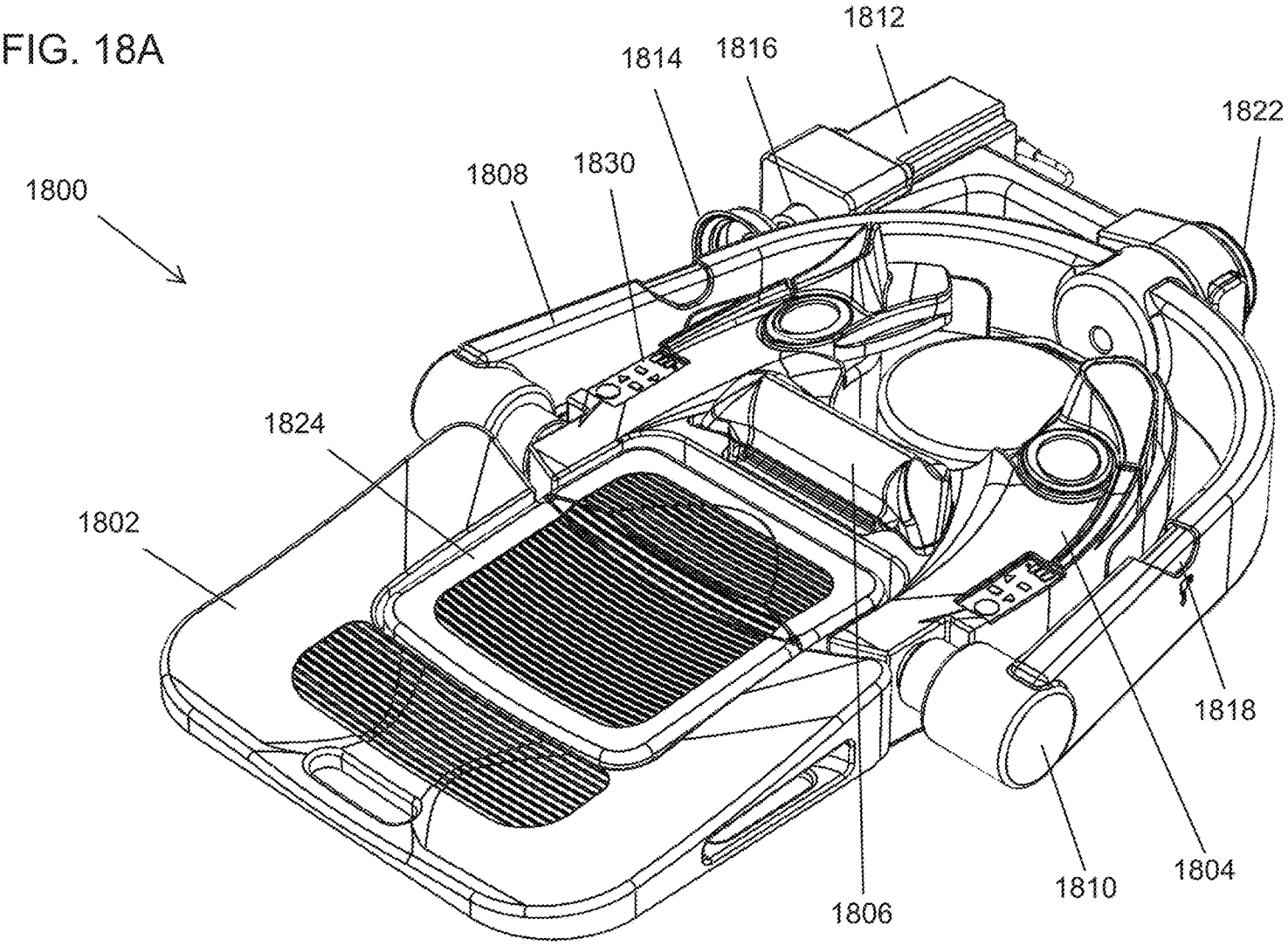
FIG. 18A depicts an isometric view of an elevation device in a stowed position according to embodiments.

FIGS. 18A-18K depict an example of an elevation device 1800, which may be similar to other elevation devices described herein. This device is designed to be placed under the patient as soon as a cardiac arrest is diagnosed. It has a low profile designed to slip under the patient's body rapidly and easily. For example, FIG. 18A shows that elevation device 1800 may include a base 1802 that supports and is pivotally or otherwise operably coupled with an upper support 1804. Upper support 1804 may include a neck pad or neck support 1806, as well as areas configured to receive a patient's upper back, shoulders, neck, and/or head. An elevation mechanism may be configured to adjust the height and/or angle of the upper support 1804 throughout the entire ranges of 0° and 45° relative to the horizontal plane and between about 10 cm and 40 cm above the horizontal plane. Upper support 1804 may be configured to be adjustable such that the upper support 1804 may slide along a longitudinal axis of base 1802 to accommodate patients of different sizes as well as movement of a patient associated with the elevation of the head by upper support 1804. In some embodiments, this sliding movement may be locked once an individual is positioned on the elevated upper support 1804. In some embodiments, the upper support 1804 may include one or more springs that may bias the upper support 1804 toward the torso. This allows the upper support 1804 to slide in a controlled manner when the individual's body shifts during the elevation process. In some embodiments, the one or more springs may have a total spring force of between about 10 lb. and about 50 lbs., more commonly between about 25 lb. and about 30 lb. Such force allows the upper support 1804 to maintain a proper position, yet can provide some give as the head and upper torso are elevated. Further, the elevation device may include a slide mechanism similar to the one shown in FIGS. 7A-7I such that with elevation of the head and neck the portion of elevation device behind the head and shoulder elongates. This helps to maintain the neck in the sniffing position.

Figure 18B:
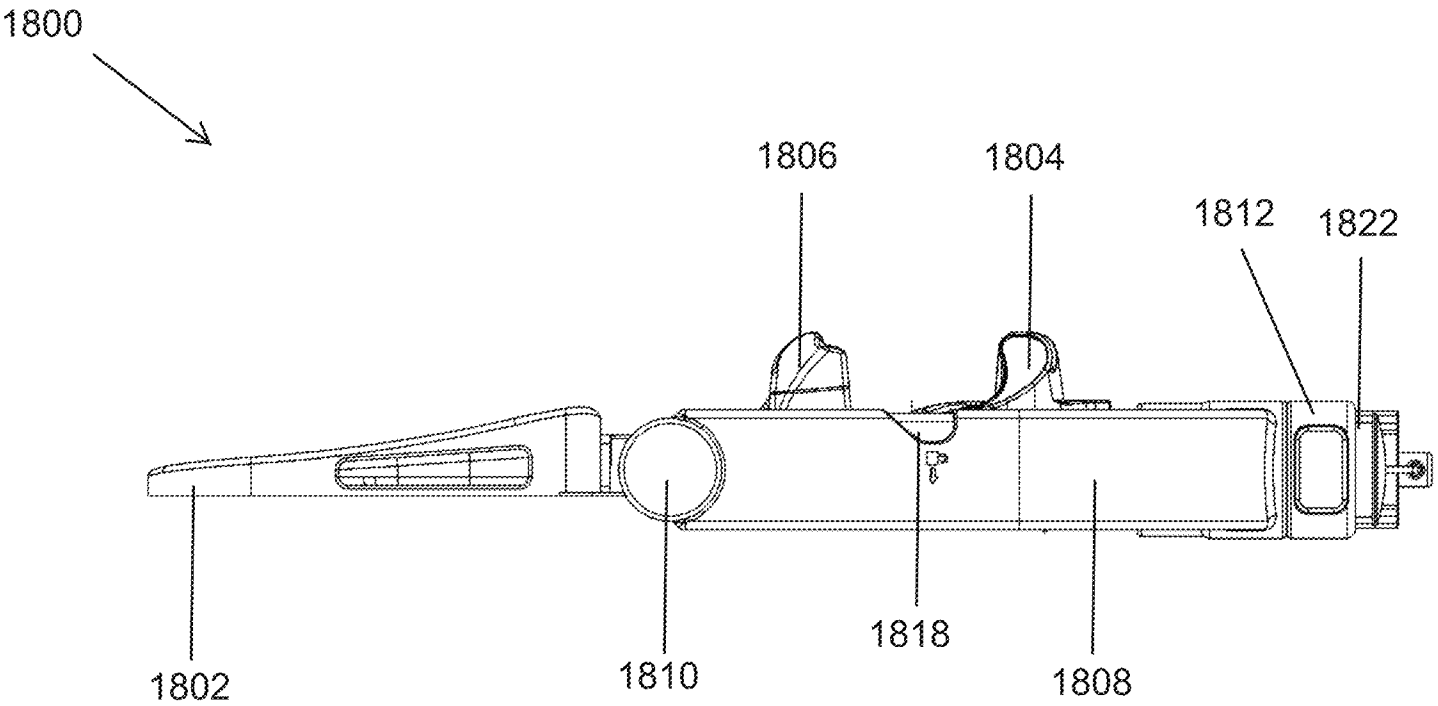
FIG. 18B depicts a side view of the elevation device of FIG. 18A with a chest compression device in a stowed position according to embodiments.

Elevation device 1800 may also include a support arm 1808 that may rotate about a pivot point 1810 or other rotational axis. In some embodiments, rotational axis 1810 may be coaxially aligned with a rotational axis of the upper support 1804. Support arm 1808 that may rotate between and be locked into a stowed position in which the support arm 1808 is at least substantially in plane with the elevation device 1800 when the upper support 1804 is lowered as shown in FIG. 18B and an active position in which the support arm 1808 is positioned substantially orthogonal to a patient's chest. The support arm 1808 is shown in the active position in FIG. 18E. Turning back to FIG. 1B, the support arm 1808 may be coupled with a chest compression device 1812, which may be secured to the patient's chest using an adhesive material and/or suction cup 1814 positioned on a lower portion of a plunger 1816. In some embodiments, the support arm 1808 may be configured to tilt along with the patient's chest as the head, neck, and shoulders are elevated by the upper support 1804. The support arm 1808 is movable to various positions relative to the upper support 1804 and is lockable at a fixed angle relative to the upper support 1804 such that the upper support 1804 and the support arm 1808 are movable as a single unit relative to the base 1802 while the support arm 1808 maintains the angle relative to the upper support 1804 while the upper support 1804 is being elevated. For example, the support arm 1808 and upper support 1804 may be rotated at a same rate about rotational axis 1810. In some embodiments, the support arm 1808 may be moved independently from the upper support 1804. For example, when in the stowed position, a lock mechanism 1818 of the support arm 1808 may be disengaged, allowing the support arm 1808 to being freely rotated. This allows the support arm 1808 to be moved to the active position. Once in the active position, lock mechanism 1818 may be engaged to lock the movement of the support arm 1808 with the upper support 1804.

Figure 18C:
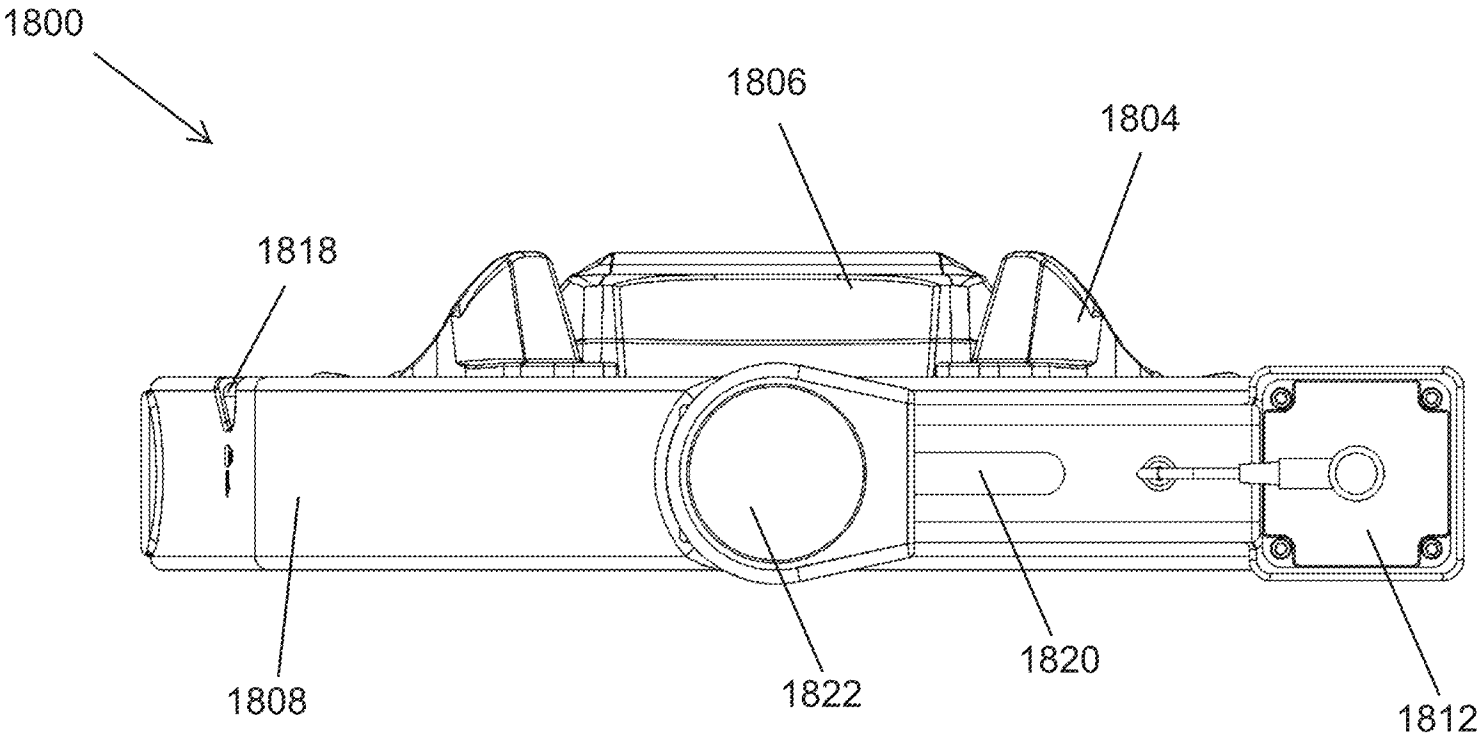
FIG. 18C depicts a rear view of the elevation device of FIG. 18A with a chest compression device in a stowed position according to embodiments.

In some embodiments, a position of the chest compression device 1812 may be adjusted relative to the support arm 1808. For example, the chest compression device 1812 may include a slot or track 1820 that may be engaged with a fastener, such as a set screw 1822 on the support arm 1808 as shown in FIG. 18C. The set screw 1822 or other fastener may be loosened, allowing the chest compression device 1812 to be repositioned to accommodate individuals of various sizes. Once properly adjusted, the set screw 1822 may be inserted within the track 1820 and tightened to secure the chest compression device 1812 in the desired position.

Figure 18D:
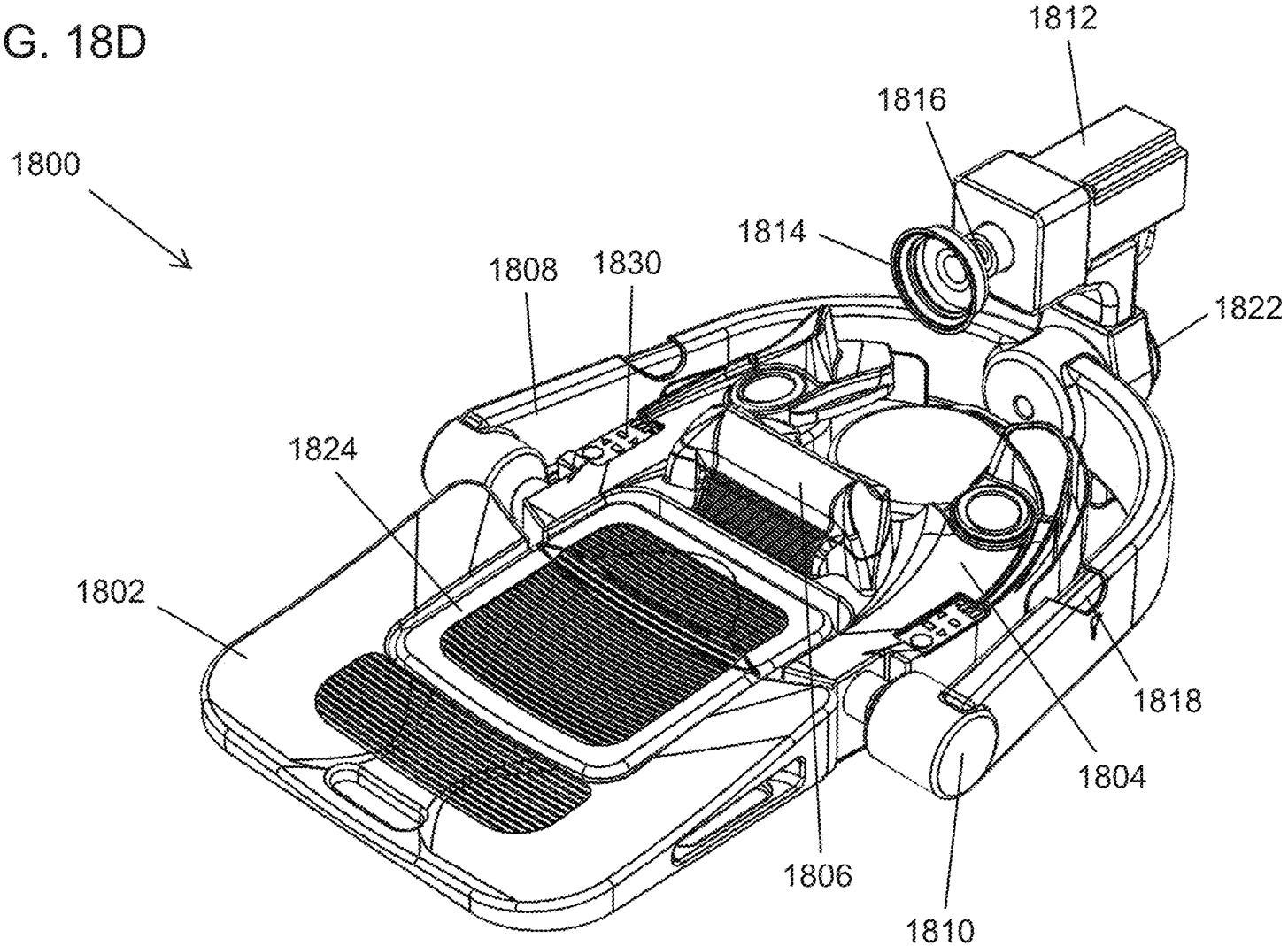
FIG. 18D depicts an isometric view of the elevation device of FIG. 18A with a chest compression device in an intermediate position according to embodiments.

FIG. 18D shows the chest compression device 1812 of elevation device 1800 in an intermediate position, with the chest compression device 1812 being rotated out of alignment with the support arm 1808. Here, the chest compression device 1812 is generally orthogonal to the support arm 1808. This is often done prior to maneuvering the support arm 1808 to the active position, although in some cases, the support arm 1808 may be moved prior to the chest compression device 1812 to be rotated to the generally orthogonal position.

Figure 18E:
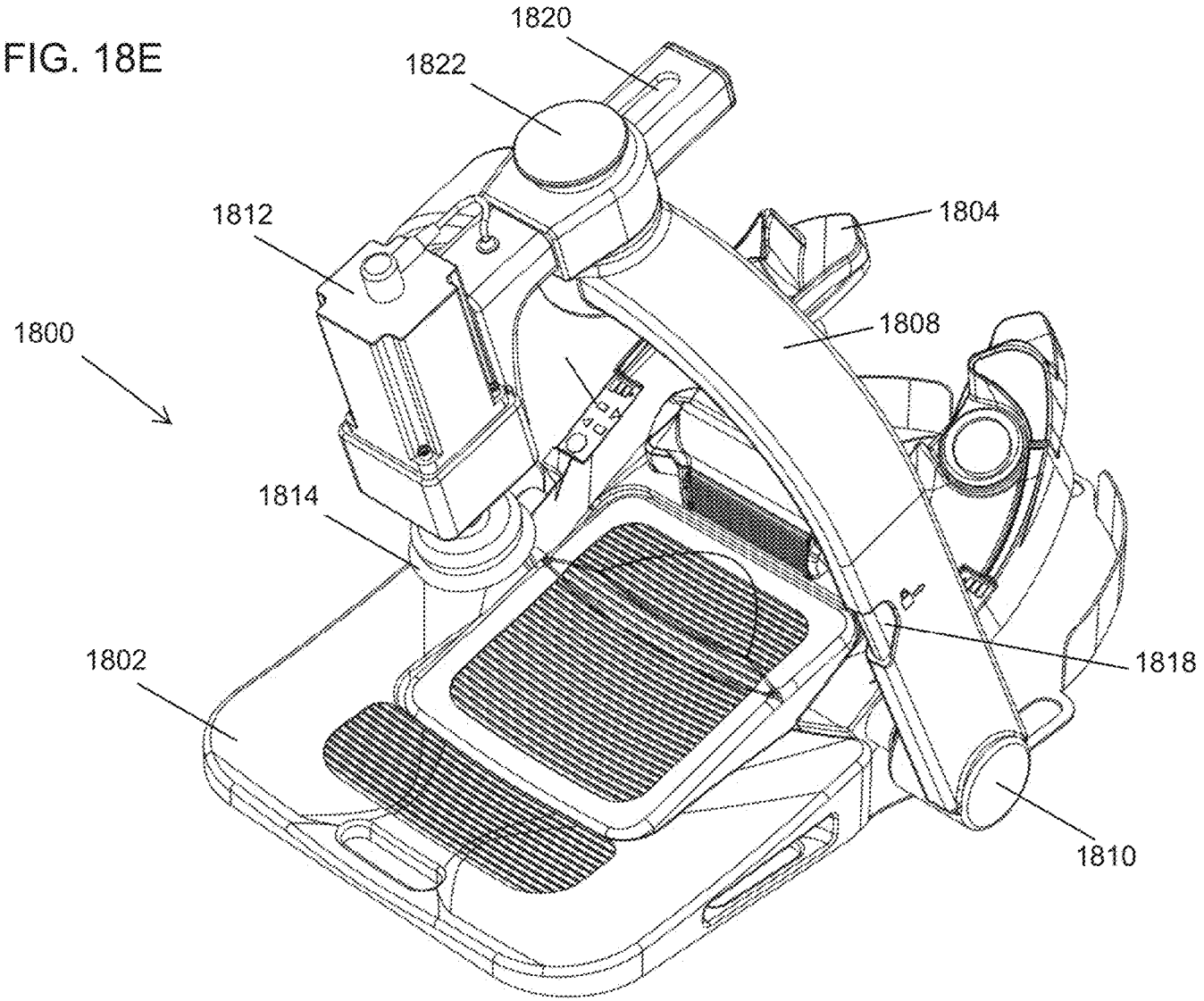
FIG. 18E depicts an isometric view of the elevation device of FIG. 18A with a chest compression device in an active position according to embodiments.

FIG. 18E shows upper support 1804 of the elevation device 1800 in an elevated position and support arm 1808 in an active position. Here, support arm 1808 is positioned such that the chest compression device is 1812 aligned generally orthogonal to the individual's sternum. In some embodiments, the elevation of the upper support 1804 and/or the support arm 1808 may be actuated using a motor (not shown). Oftentimes, a control interface 1830 may be included on the elevation device 1800, such as on base 1802. The control interface 1830 may include one or more buttons or other controls that allow a user to elevate and/or lower the upper support 1804 and/or support arm 1808. In other embodiments, the motor may be controlled remotely using Bluetooth communication or other wired and/or wireless techniques. Further, the compression/decompression movement may be regulated based upon physiological feedback from one or more sensors directly or indirectly attached to the patient. The chest compression device 1812 may be similar to those described above. In some embodiments, to provide a stronger decompressive force to the chest, the chest compression device 1812 may include one or more springs. For example, a spring (not shown) may be positioned around a portion of the plunger 1816 above the suction cup 1814. As the plunger 1816 is extended downward by the motor (often with a linear actuator positioned there between), the spring may be stretched, thus storing energy. As the plunger 1816 is retracted, the spring may recoil, providing sufficient force to actively decompress the patient's chest. In some embodiments, a spring (not shown) may be positioned near each pivot point 1810 of support arm 1808, biasing the rotatable arm in an upward, or decompression state. As the motor drives the plunger 1816 and/or suction cup 1814 to compress the patient's chest, the pivot point springs may also be compressed. As the tension is released by the motor, the pivot point springs may extend to their original state, driving the support arm 1808 and suction cup 1814 upward, thereby decompressing the patient's chest.

It will be appreciated that any number of tensioning mechanisms and drive mechanisms may be used to convert the force from the tensioning band or motor to an upward and/or downward linear force to compress the patient's chest. For example, a conventional piston mechanism may be utilized, such with tensioned bands and/or pulley systems providing rotational force to a crankshaft. In other embodiments, a pneumatically driven, hydraulically driver, and/or an electro-magnetically driven piston or plunger may be used. Additionally, the motor may be configured to deliver both compressions and decompressions, without the use of any springs. In other embodiments, both a spring around a plunger 1816 and/or pivot point springs may be used in conjunction with a compression only or compression/decompression motor to achieve a desired decompressive force applied to the patient's chest. In still other embodiments, the motor and power supply, such as a battery, will be positioned in a portion of base 1802 that is lateral or superior to the location of the patient's heart, such that they do not interfere with fluoroscopic, x-ray, or other imaging of the patient's heart during cardiac catheterization procedures. Further, the base 1802 could include an electrode, attached to the portion of the device immediately behind the heart (not shown), which could be used as a cathode or anode to help monitor the patient's heart rhythm and be used to help defibrillate or pace the patient. As such, base 1802 could be used as a 'work station' which would include additional devices such as monitors and defibrillators (not shown) used in the treatment of patients in cardiac arrest.

Figure 18F:
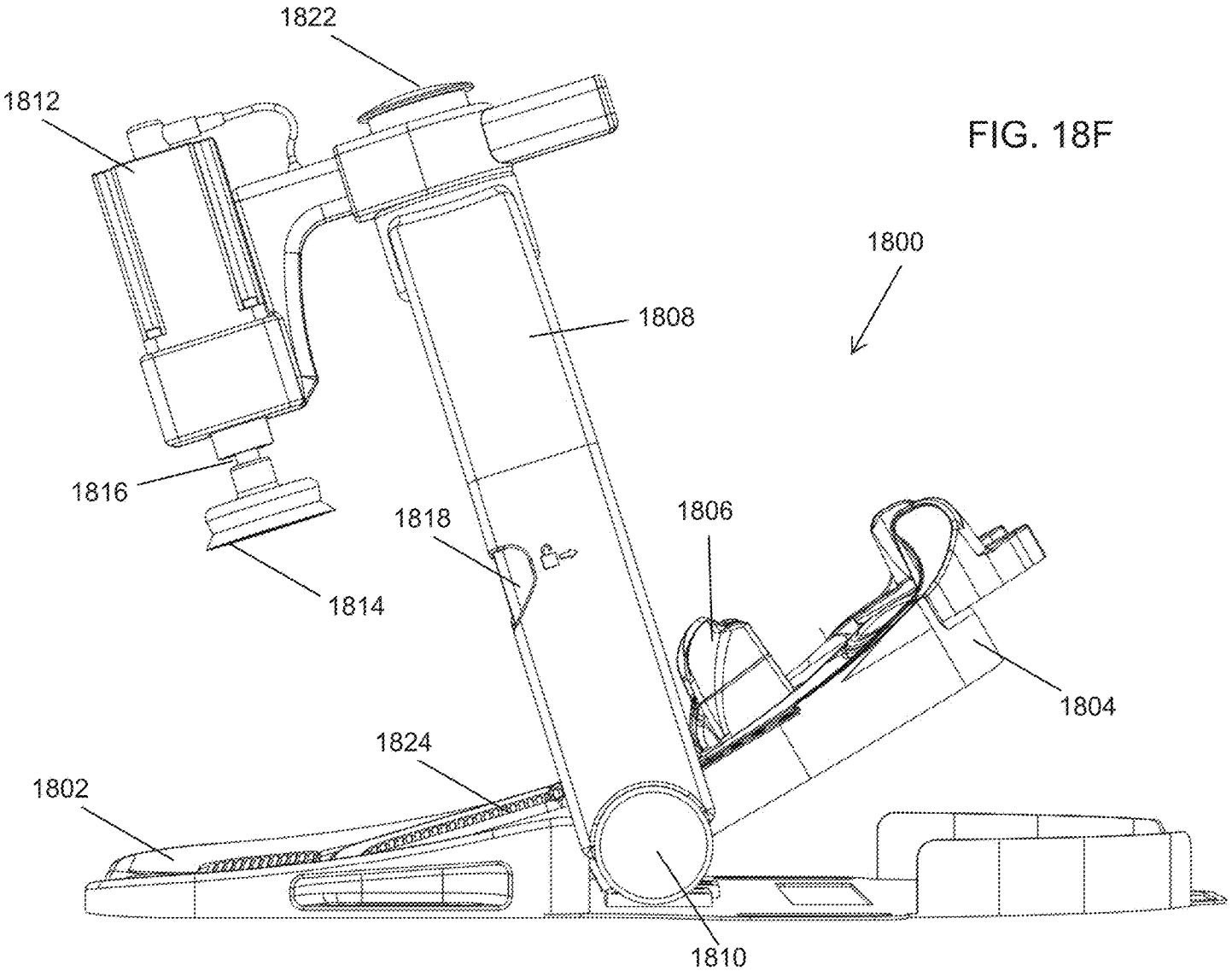
FIG. 18F depicts a side view of the elevation device of FIG. 18A with a chest compression device in an active position according to embodiments.
Figure 18G:
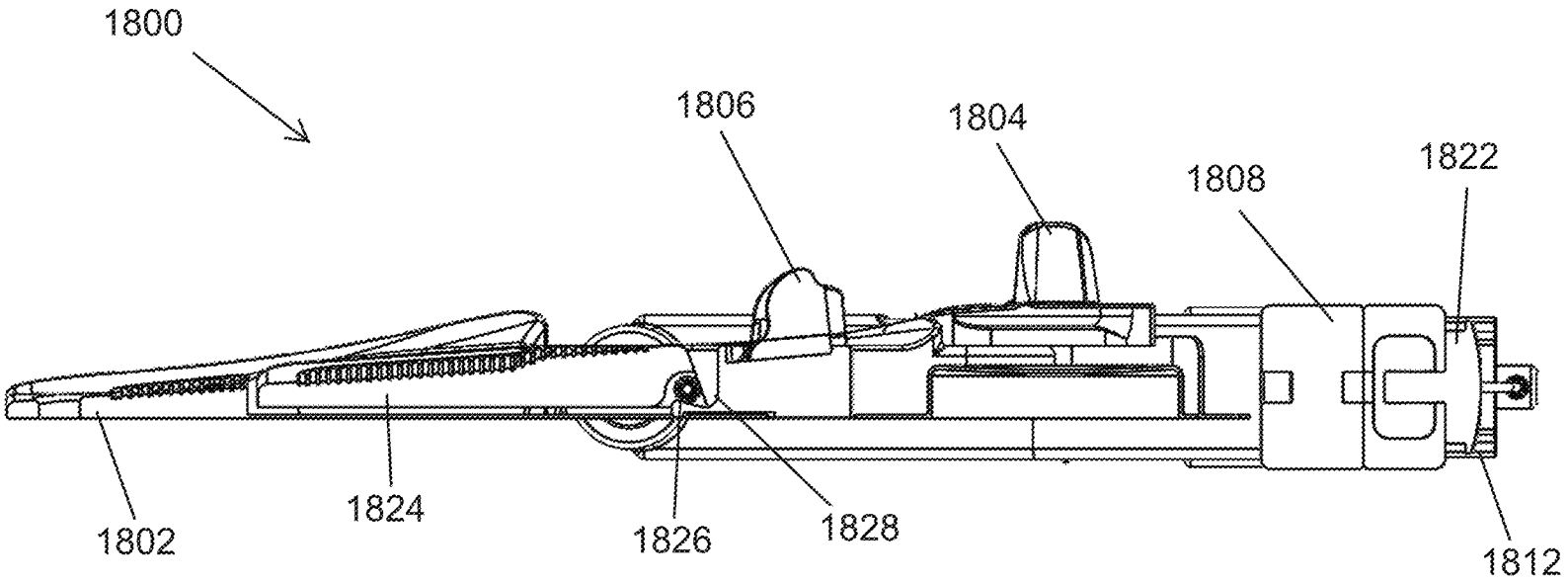
FIG. 18G depicts a mechanism for tilting a thoracic plate of the elevation device of FIG. 18A in a lowered position according to embodiments.
Figure 18H:
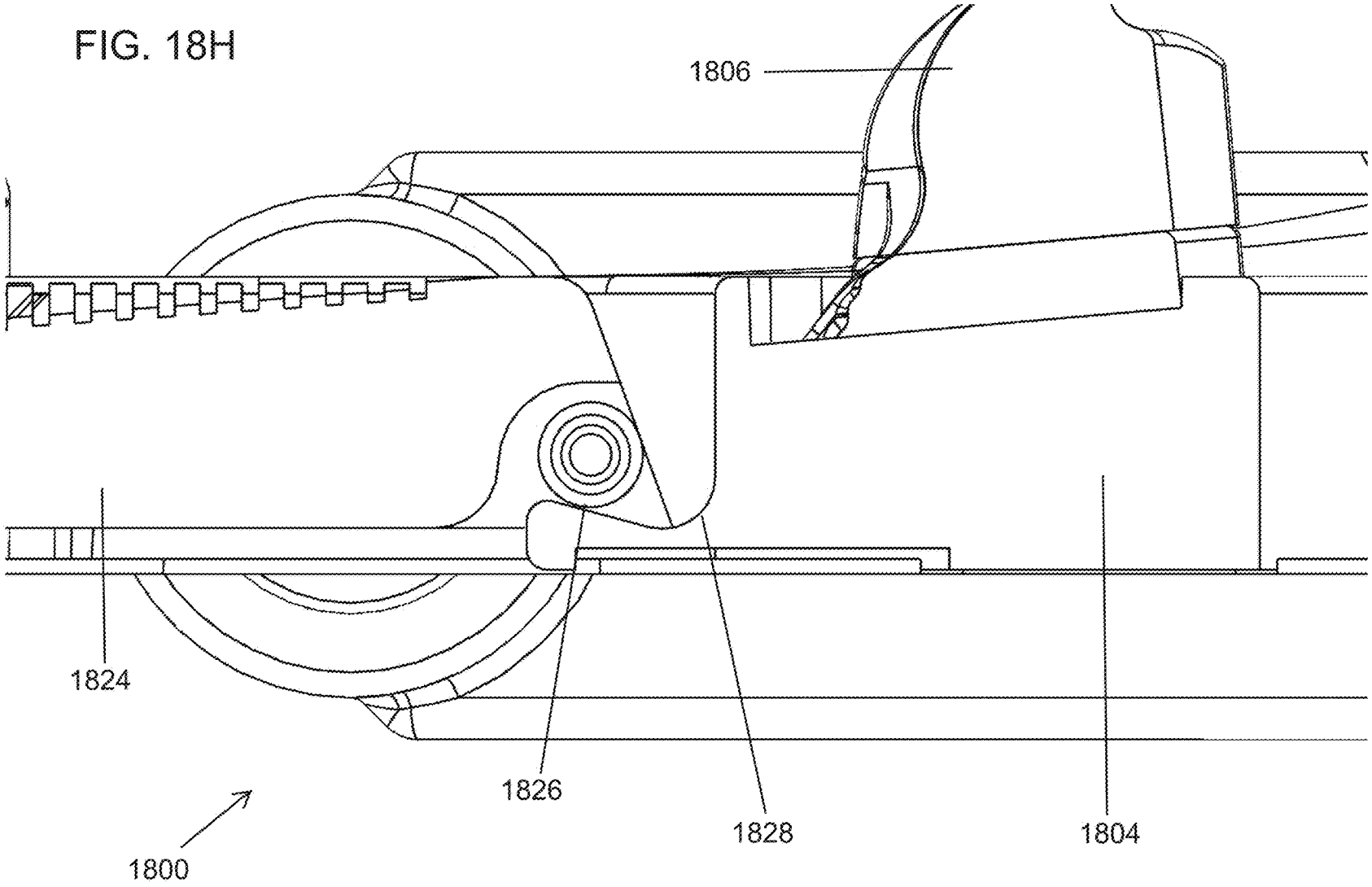
FIG. 18H depicts a mechanism for tilting a thoracic plate of the elevation device of FIG. 18A in a lowered position according to embodiments.
Figure 18I:
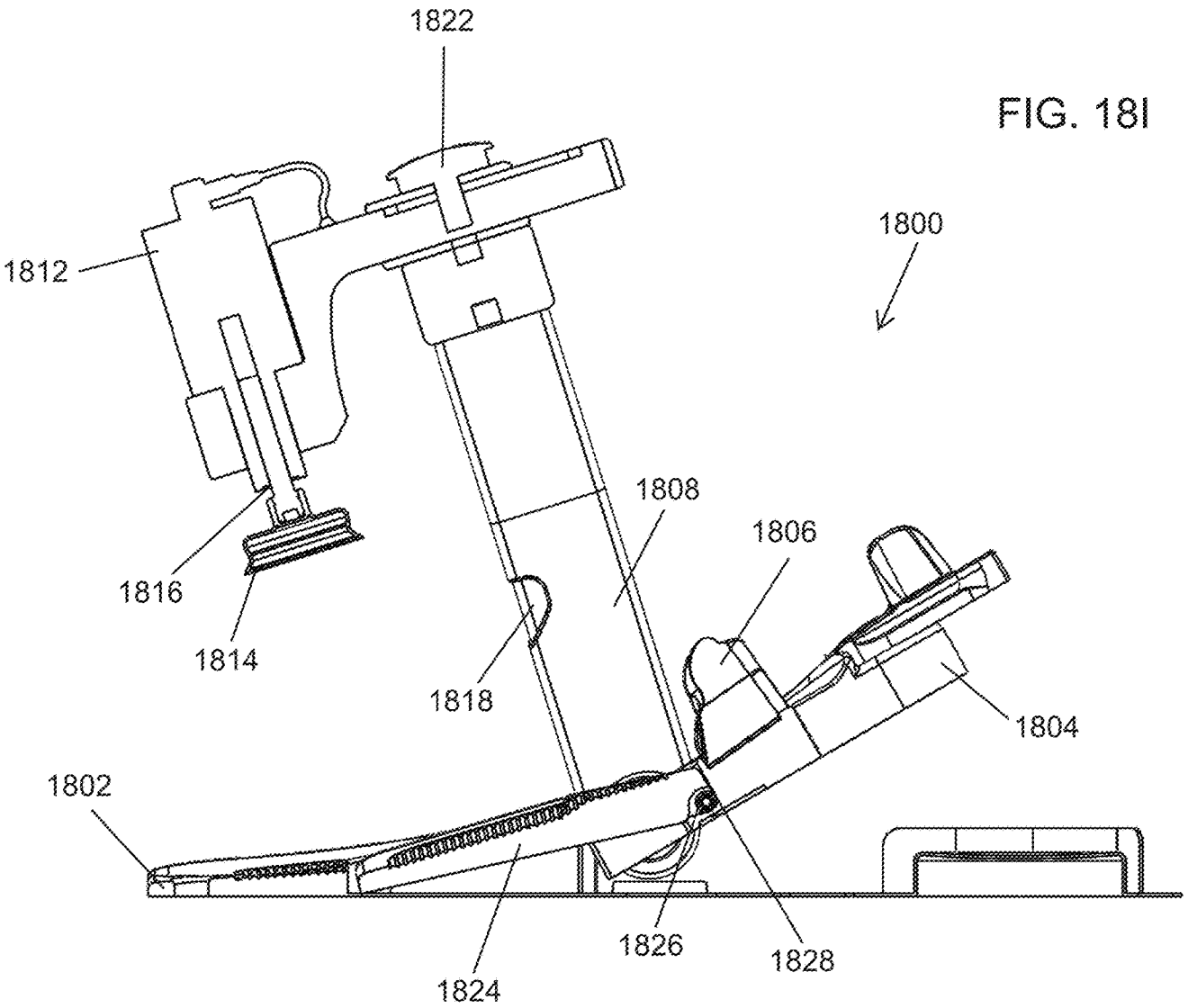
FIG. 18I depicts a mechanism for tilting a thoracic plate of the elevation device of FIG. 18A in an elevated position according to embodiments.
Figure 18J:
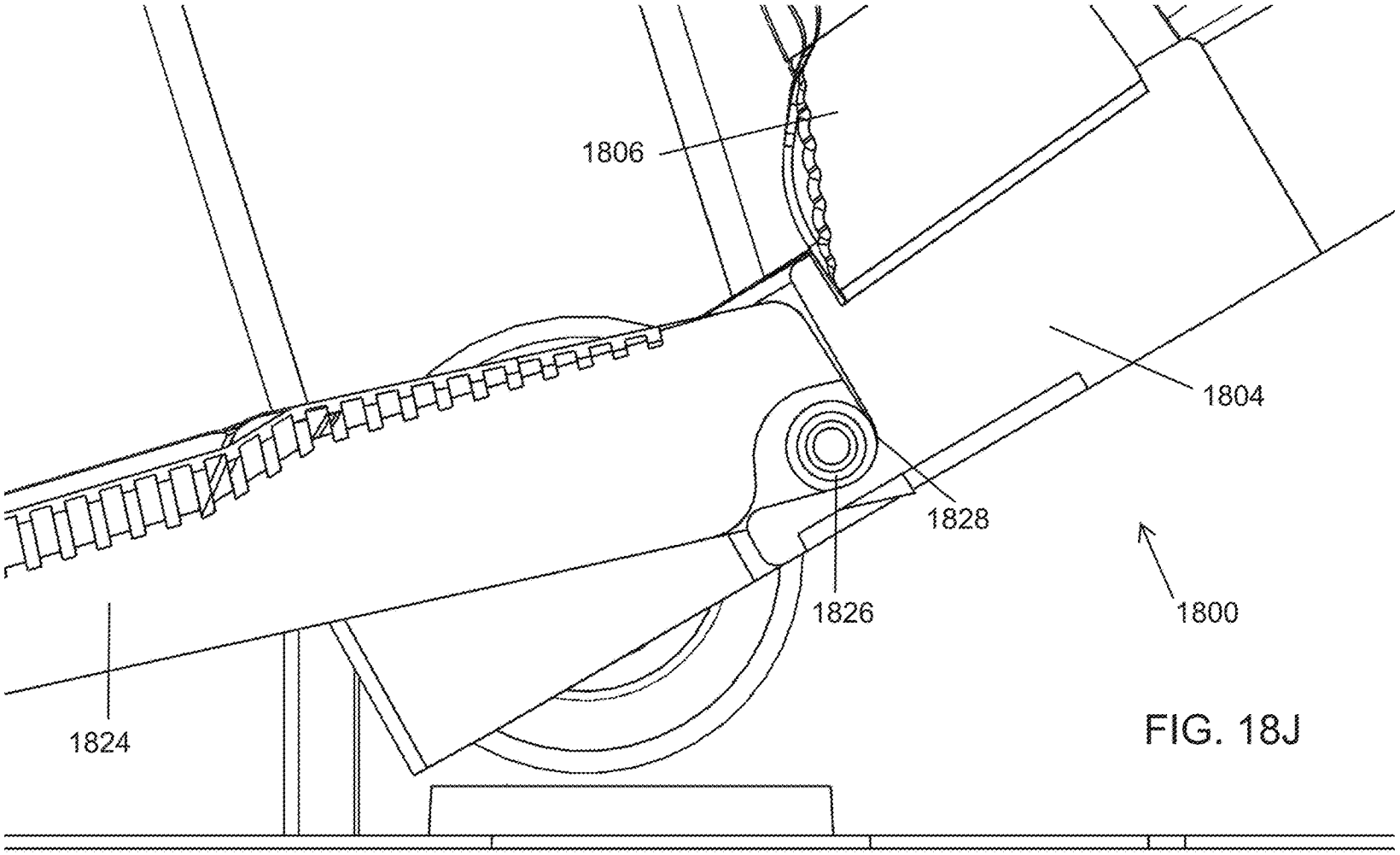
FIG. 18J depicts a mechanism for tilting a thoracic plate of the elevation device of FIG. 18A in an elevated position according to embodiments.

In some embodiments, the elevation device 1800 includes an adjustable thoracic plate 1824. The thoracic plate 1824 may be configured to adjust angularly to help combat thoracic shift to help maintain the chest compression device 1812 at a generally orthogonal to the sternum. The adjustment of the thoracic plate 1824 may create a separate elevation plane for the heart, with the head being elevated at a greater angle using the upper support 1804 as shown in FIG. 18F. In some embodiments, the thoracic plate 1824 may be adjusted independently, while in other embodiments, adjustment of the thoracic plate 1824 is tied to the elevation of the upper support 1804. FIG. 18G shows a mechanism for adjusting the angle of the thoracic plate 1824 in conjunction with elevation of the upper support 1804. Here, elevation device 1800 is shown with upper support 1804 in a lowered position and support arm 1808 in a stowed position. Thoracic plate 1824 includes a roller 1826 positioned on an elevation track 1828 of upper support 1804 as shown in FIG. 1811. The roller 1826 may be positioned on a forward, raised portion of the elevation track 1828. As the upper support 1804 is elevated, the roller 1826 is forced upward by elevation track 1828, thereby forcing an end of the thoracic plate 1824 proximate to the upper support 1804 upwards as shown in FIGS. 18I and 18J. This causes the thoracic plate 1824 to tilt, thus maintaining the chest at a generally orthogonal angle relative to the chest compression device 1812. Oftentimes, elevation track 1828 may be slanted from a raised portion proximate to the thoracic plate 1824 to a lowered portion. The elevation track 1828 may be tilted between about 4° and 20° to provide a measured amount of tilt relative to the thoracic shift expected based on a particular elevation level of the upper support 1804. Typically, the thoracic plate 1824 will be tilted at a lower angle than the upper support 1804 is inclined.

Figure 18K:
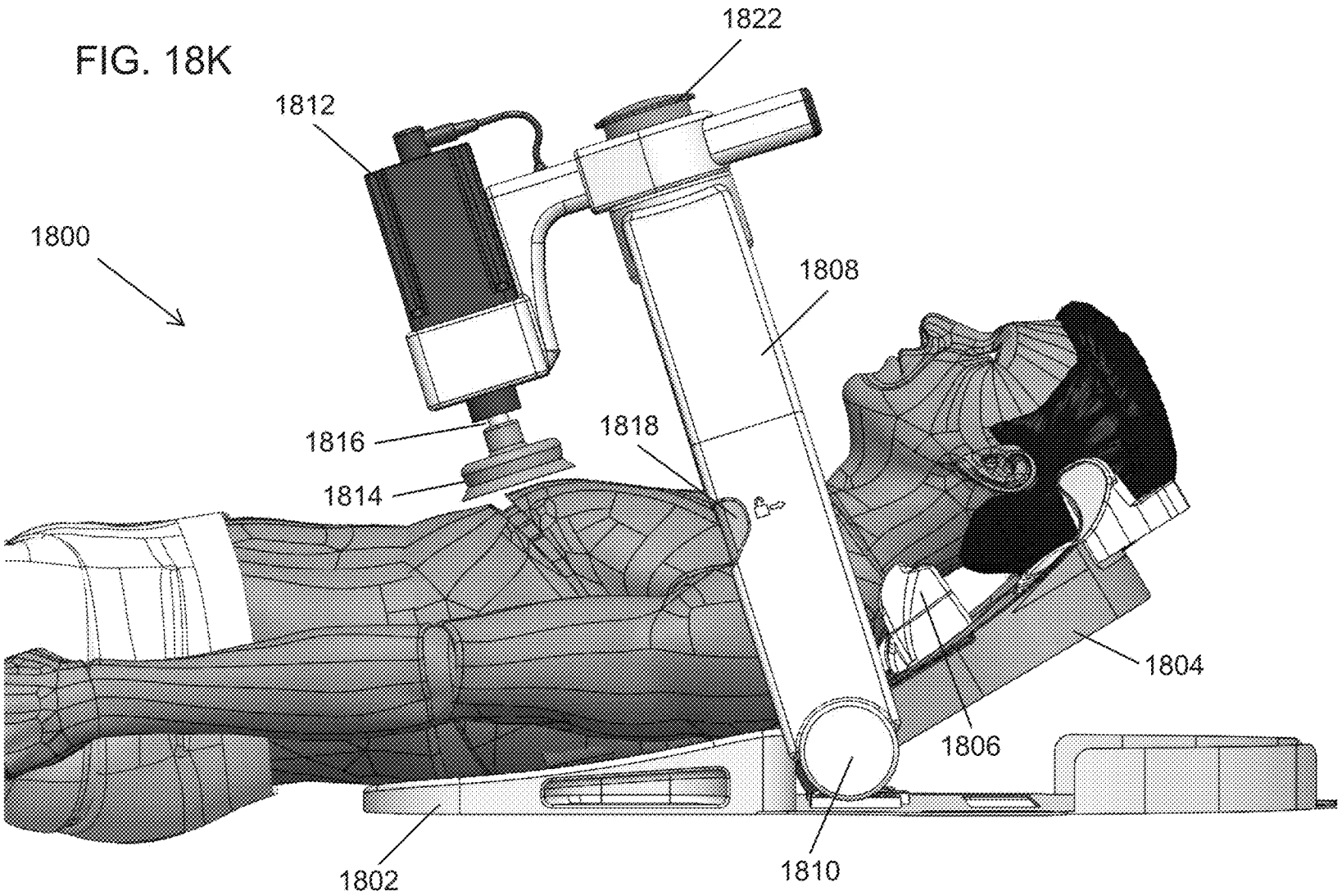
FIG. 18K depicts an individual positioned on the elevation device of FIG. 18A according to embodiments.

FIG. 18K depicts elevation device 1800 supporting an individual in an elevated and active position. Here, the user is positioned on the elevation device 1800 with his neck positioned on the neck support 1806. In some embodiments, the neck support 1806 may contact the individual's spine at a location near the C7 and C8 vertebrae. This position may help maintain the individual in the sniffing position, to help enable optimum ventilation of the individual. In some embodiments, the individual may be aligned on the elevation device 1800 by positioning his shoulders in alignment with the support arm 1808. The chest compression device 1812 is positioned in alignment with the individual's sternum at a generally orthogonal angle to ensure that the chest compressions are delivered at a proper angle and with proper force. In some embodiments, the alignment of the chest compression device 1812 may be achieved may configuring the chest compression device 1812 to pivot and/or otherwise adjust angularly to align the chest compression device 1812 at an angle substantially orthogonal to the sternum. A linear position the chest compression device 1812 may also be adjustable relative to the support arm 1808 such that the plunger 1816 and/or suction cup 1814 of the chest compression device 1812 may be moved up or down the individual's chest to ensure proper alignment of the plunger 1816 and/or suction cup 1814 with the sternum.

In some embodiments, the support arm 1808 may be generally U-shaped and may be coupled with the base 1802 on both sides as shown here. The U-shaped supports can generally be attached so that when the compression piston or suction cup is positioned over the sternum, the rotational angle with elevation of the U-shaped member is the same as the heart. However, in some embodiments, the support arm 1808 may be more generally L-shaped, with only a single point of coupling with base 1802. In some embodiments, the support arm 1808 may be configured to expand and/or contract to adjust a height of the chest compression device 1812 to accommodate individuals of different sizes.

Figure 19B:
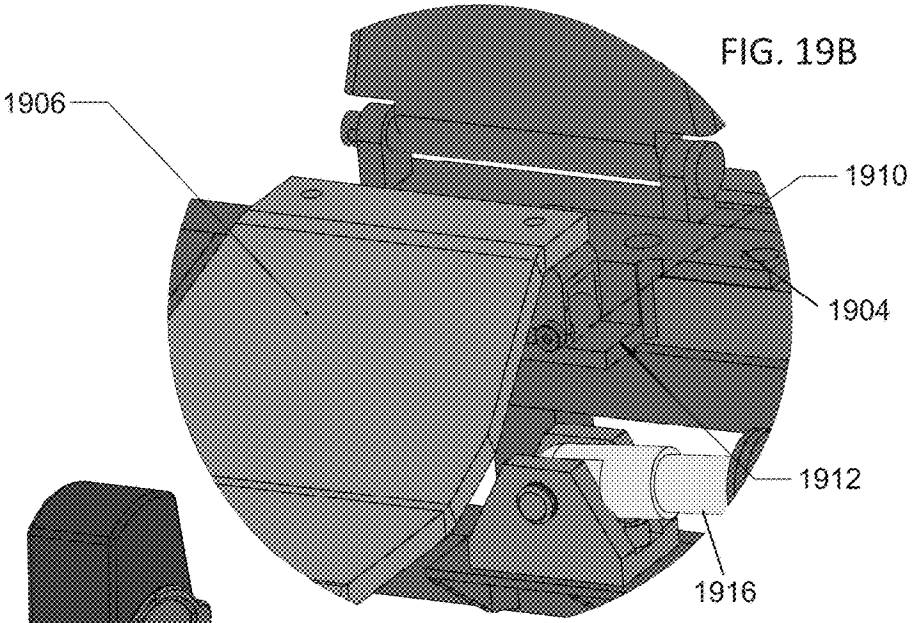
FIG. 19B depicts a roller assembly of the elevation device of FIG. 19A in a lowered position according to embodiments.
Figure 19A:
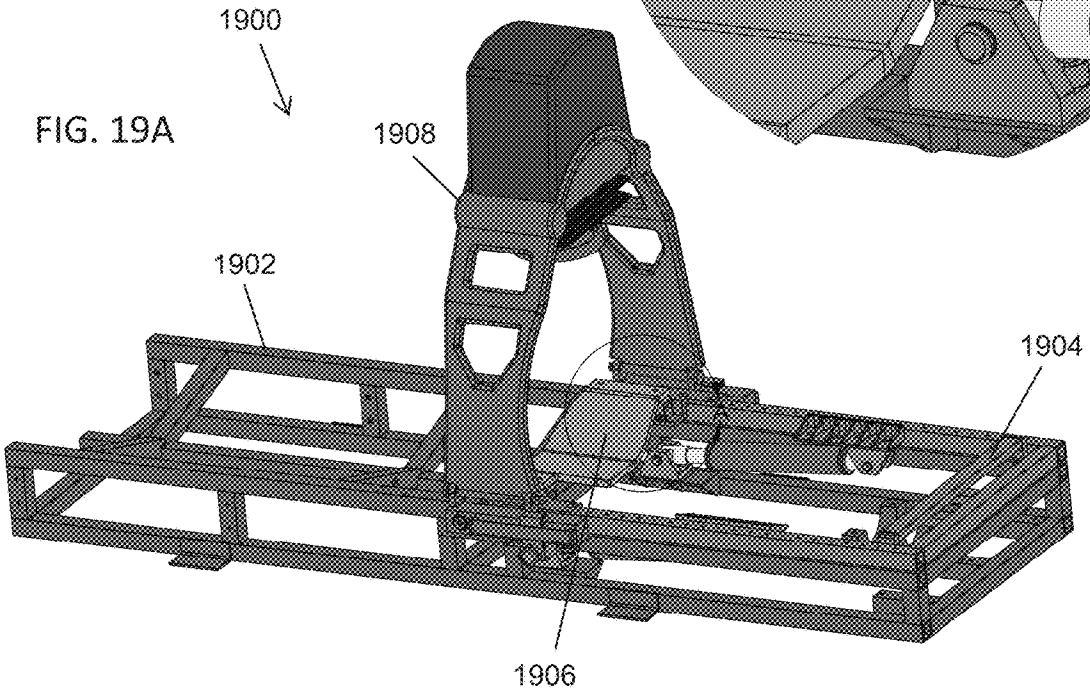
FIG. 19A depicts a top isometric view of elevation device for animals in a lowered position according to embodiments.
Figures 19C, 19D:
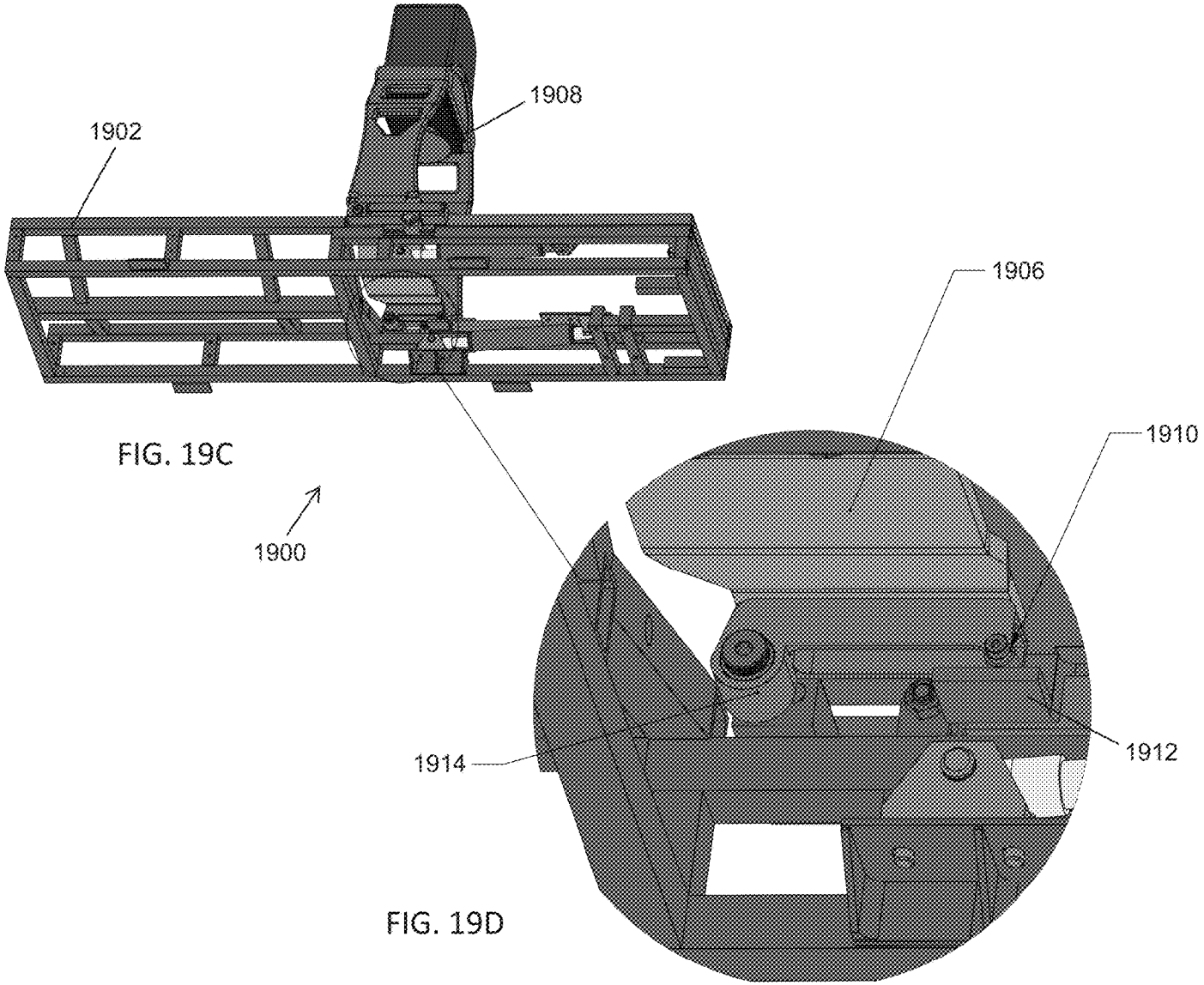
FIG. 19C depicts a bottom isometric view of the elevation device of FIG. 19A in a lowered position according to embodiments.
FIG. 19D depicts a thoracic plate pivot mechanism of the elevation device of FIG. 19A in a lowered position according to embodiments.
Figures 19E, 19F:
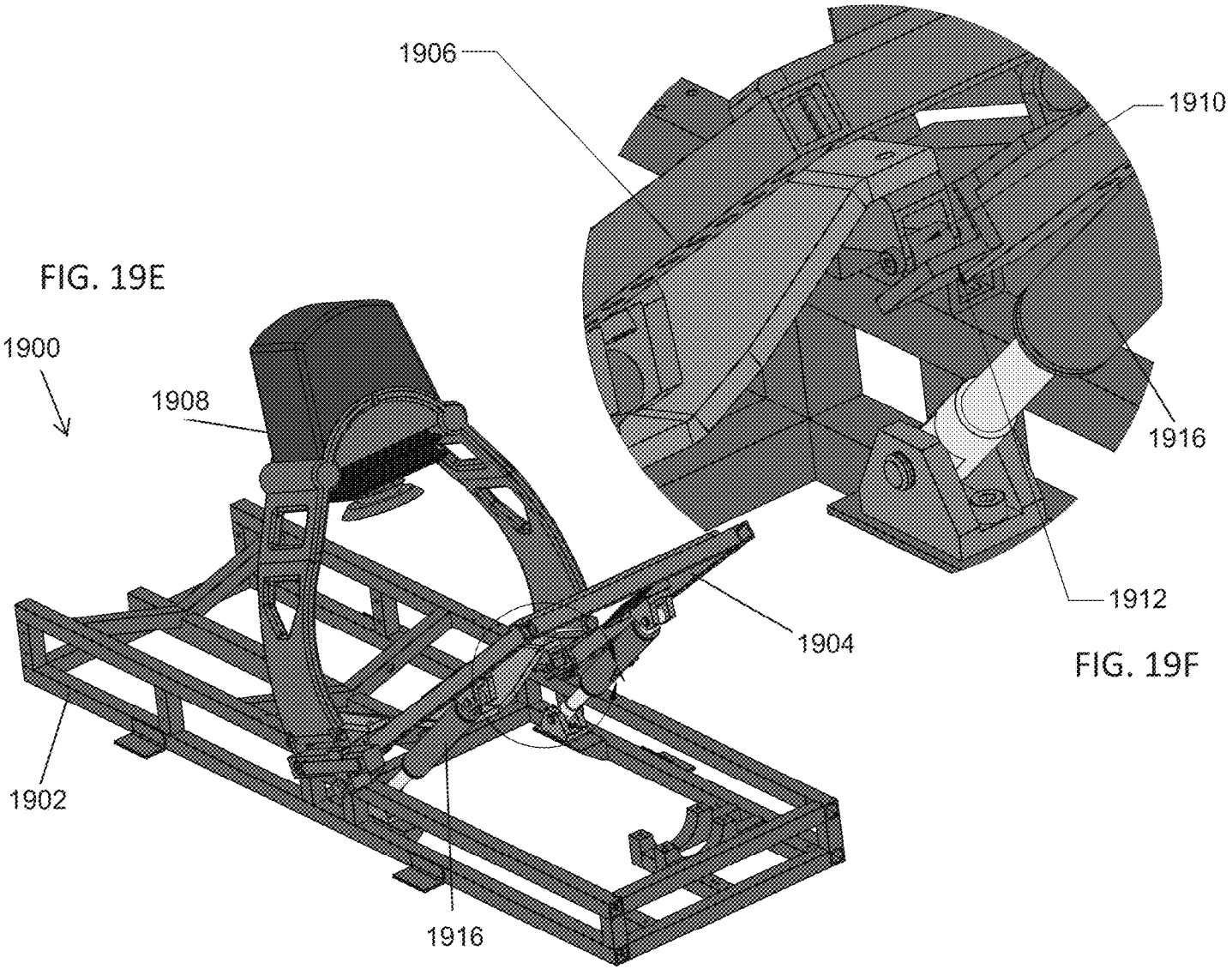
FIG. 19E depicts a top isometric view of the elevation device of FIG. 19A in an elevated position according to embodiments.
FIG. 19F depicts a roller assembly of the elevation device of FIG. 19A in an elevated position according to embodiments.
Figures 19G, 19H:
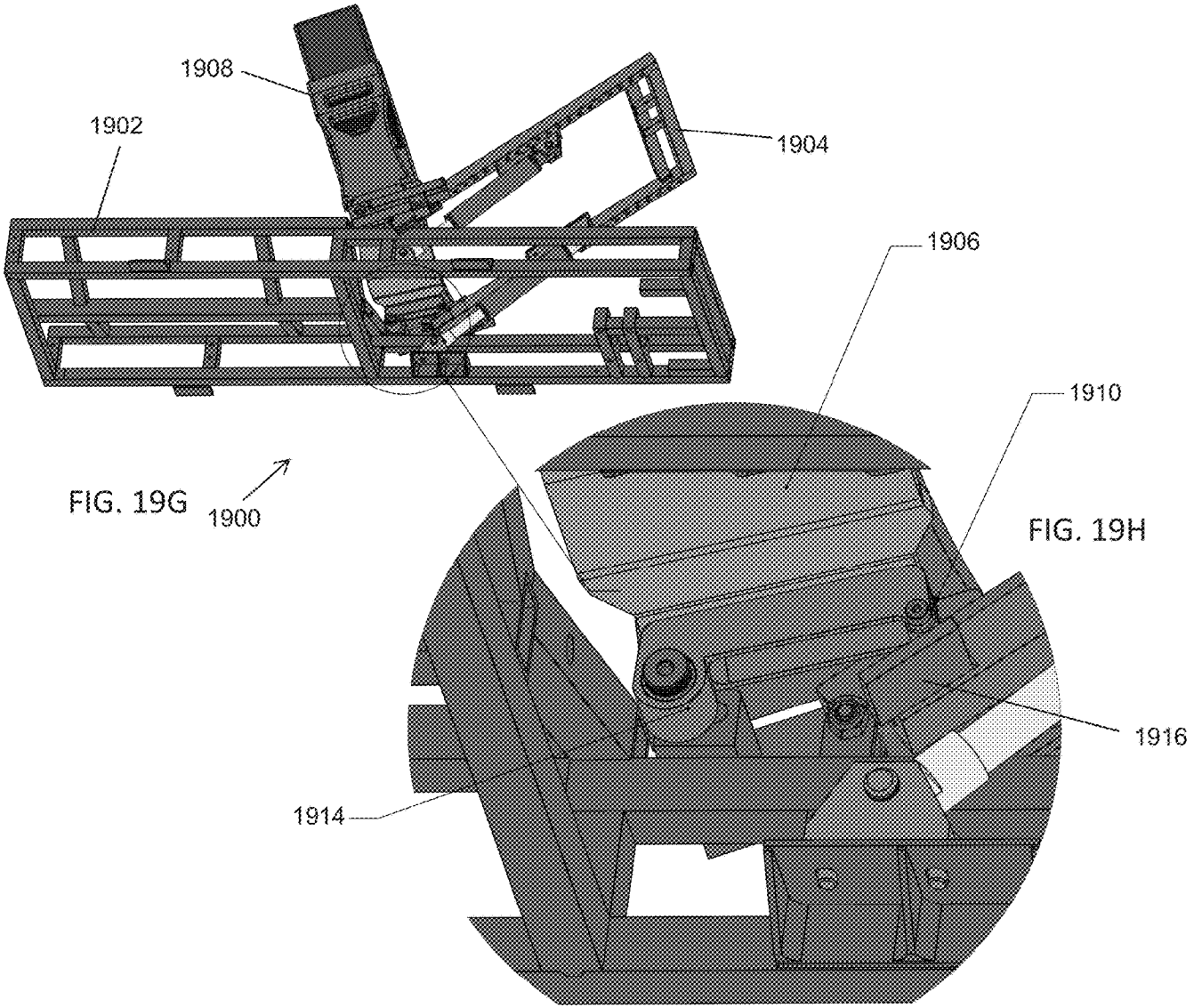
FIG. 19G depicts a bottom isometric view of the elevation device of FIG. 19A in an elevated position according to embodiments.
FIG. 19H depicts a thoracic plate pivot mechanism of the elevation device of FIG. 19A in an elevated position according to embodiments.

In some embodiments, elevation devices may be configured for use in the administration of head up CPR in animals. For example, FIGS. 19A-19H depict an elevation device 1900 configured for use in the performance of head up CPR in pigs. Elevation device 1900 may include similar features as other elevation devices described herein. Turning to FIG. 19A, elevation device 1900 includes a base 1902 operably coupled with an elevatable upper support 1904. A thoracic plate 1906 may be coupled with the upper support 1904. Elevation device 1900 may also include a chest compression device 1908, such as a LUCAS® or other automatic chest compression device such as those described herein. Thoracic plate 1906 may be configured to tilt as the upper support 1904 is elevated. For example, as shown in FIG. 19B, the thoracic plate 1906 may include a roller 1910 configured to rest on a track 1912 of the upper support 1904. As shown in FIGS. 19C and 19D, the thoracic plate 1906 may include a fixed pivot location 1914 positioned on an underside of the thoracic plate 1906 and operably coupled with roller 1910. Pivot location 1914 may be coupled with the base 1902 such that the thoracic plate 1906 may be tilted upward, while keeping a lower edge of the thoracic plate 1906 proximate the pivot location 1914 in a same or substantially same position. As shown in FIGS. 19E and 19F, as the upper support 1904 is elevated, the track 1912 is also raised. The raising of track 1912 forces roller 1910 upward, raising an end of the thoracic plate 1906 proximate to the upper support 1904. As shown in FIGS. 19G and 19H, the lower end tilts upward, with a bottom end staying at a same or substantially same height due to the pivot location 1914 while the upper end proximate the upper support 1904 is forced upward. Such tilting helps combat the effects of thoracic shift during elevation of the animal's head and upper torso. In some embodiments, the chest compression device 1908 may be coupled with the thoracic plate 1906 such that the chest compression device 1908 tilts in conjunction with the tilting of the thoracic plate 1906. This ensures that the chest compression device 1908 maintains a position substantially orthogonal to the chest of the animal.

Here, the elevation of the upper support 1904 may be driven by gas struts 1916 or springs that utilize pressurized gases to expand and contract. However, in other embodiments, the elevation may be driven by various mechanical means, such as motors in combination with threaded rods or lead screws, pneumatic or hydraulic actuators, motor driven telescoping rods, and/or any other elevation mechanism, such as those described elsewhere herein.

In some embodiments, the elevation devices may include elevation mechanisms that do not require a pivot point. As just one example, the upper supports may be elevated by raisable arms positioned underneath the upper support at a front and back of the upper support. The front arms may raise slower and/or raise to a shorter height than the back arms, thus raising a back portion of the upper support to a higher elevation than a front portion.

It should be noted that the elevation devices/head up devices (HUD) could serve as a platform for additional CPR devices and aids. For example, an automatic external defibrillator could be attached to the HUD or embodied within it and share the same power source. Electrodes could be provided and attached rapidly to the patient once the patient is place on the HUD. Similarly, ECG monitoring, end tidal CO2 monitoring, brain sensors, and the like could be co-located on the HUD. In addition, devices that facilitate the cooling of a patient could be co-located on the HUD to facilitate rapid cooling during and after CPR.

It should be further noted that during the performance of CPR the compression rate and depth and force applied to the chest might vary depending upon whether the patient is in the flat horizontal plane or whether the head and thorax are elevated. For example, CPR may be performed with compressions at a rate of 80/min using active compression decompression CPR when flat but at 100 per minute with head and thorax elevation in order to maintain an adequate perfusion pressure to the brain when the head is elevated. Moreover, with head elevation there is better pulmonary circulation so the increase in circulation generated by the higher compression rates will have a beneficial effect on circulation and not "overload" the pulmonary circulation which could happen when the patient is in the flat horizontal plane.

Figure 20:
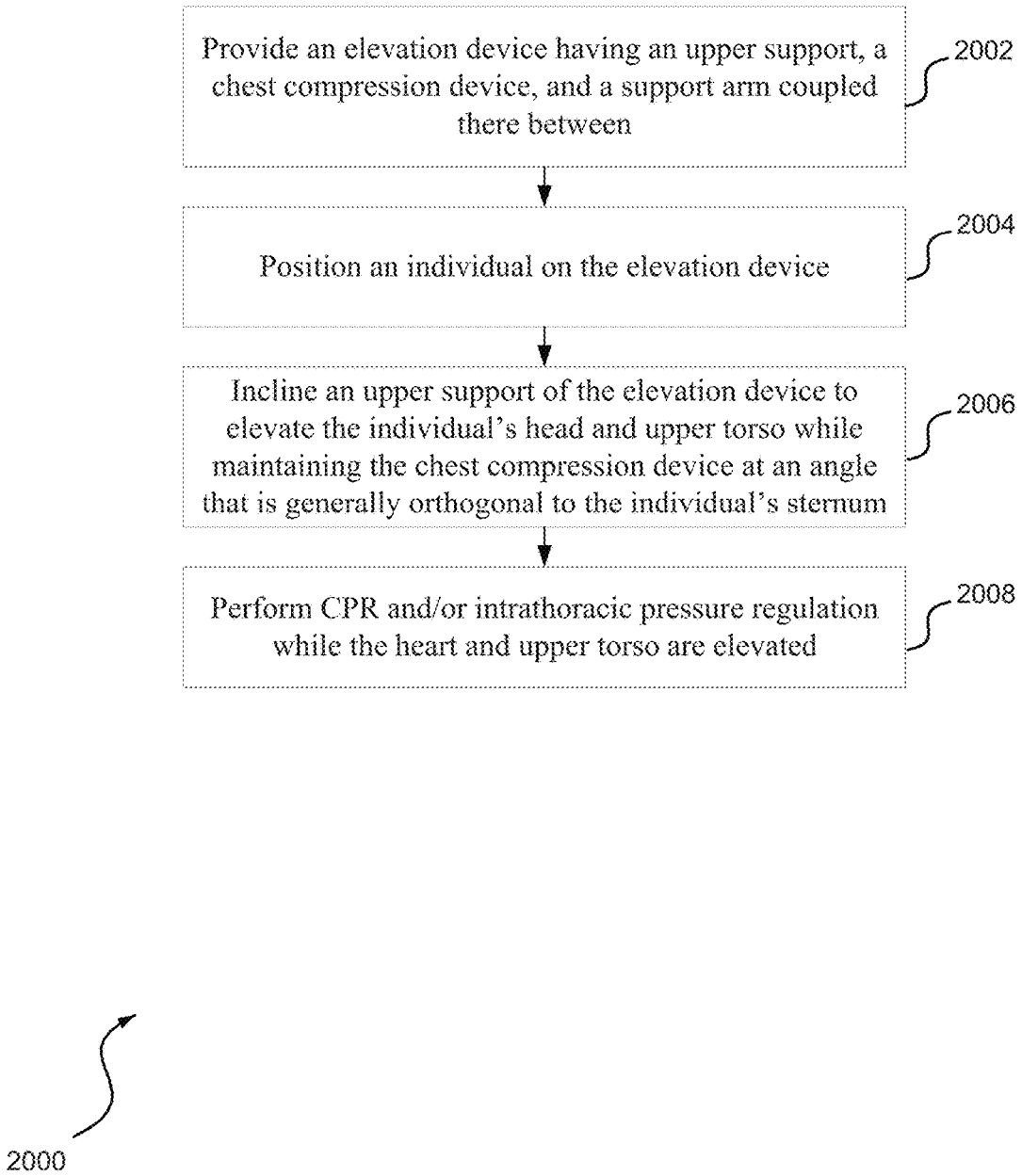
FIG. 20 is a flowchart for a process for performing CPR according to embodiments.

FIG. 20 depicts a process 2000 for performing CPR. In some embodiments, process 2000 begins with the patient flat, and flat, standard CPR is started as soon as possible. In some embodiments, manual CPR may be performed, while in other embodiments, active compression-decompression CPR may be performed. At block 2002, an elevation device is provided. Process 2000 may be performed using any of the elevation devices described herein. For example, the elevation device may include a base, an upper support operably coupled to the base, a support arm coupled with the upper support, and a chest compression device coupled with the support arm. The chest compression device may be configured to compress the chest and to actively decompress the chest. At block 2004, the individual is positioned on the elevation device. In some embodiments, this may include aligning the individual's shoulders with the support arm and/or positioning the individual's neck on a neck support of the upper support such that the neck support contacts the individual's spine at an area near the C7 and C8 vertebrae. Such positioning may help maintain the individual in the sniffing position throughout elevation of the head and upper torso, thereby providing more optimal airway management. In some embodiments, the chest compression device must be manipulated between a stowed position and an active position. In the stowed position the chest compression device is at least substantially aligned in a same plane as the support arm and in the active position the chest compression device is at least substantially orthogonal to the support arm.

At block 2006, the upper support may be inclined to raise the individual's upper torso and head while maintaining the chest compression device at an angle that is generally orthogonal to the individual's sternum. In some embodiments, this may be done by fixing an angle or other position of the support arm relative to the upper support such than any movement of the upper support causes a similar adjustment of the support arm and chest compression device In some embodiments, the elevation device may also include an adjustable thoracic plate that is operably coupled with the base. Elevating or otherwise inclining the upper support may then cause an angle of the thoracic plate to be adjusted relative to the base such that the chest compression device is maintained at a position generally orthogonal to the individual's sternum while a positional relationship between the support arm and the upper support is maintained as described herein. In some embodiments, a position of the chest compression device is adjusted relative to the support arm and/or a size of the support arm is adjusted based on a size and/or an age of the individual. At block 2008, one or more of CPR or intrathoracic pressure regulation are performed while elevating the heart and the head. Chest compressions may be administered by the chest compression device. In some embodiments, the chest compression device may actively compress and decompress the individual's chest, such as using a plunger and suction cup assembly and/or compression band that is driven by a motor or other actuator. In some embodiments, process 2000 may also include interfacing an impedance threshold device with the individual's airway before, during, or after the administration of CPR and/or the elevation of the head and upper torso.

In some embodiments, the process 2000 may include compressing the individual's abdomen while the head and upper torso are elevated. Conventionally, it is known that abdominal counterpulsation compressions, alternating with chest compressions, do not increase survival rates after out-of-hospital cardiac arrest, most likely as the enhanced venous return to the thorax also elevates ICP when a person is flat and supine. [Emerg Medi Clin N Am. 20 (2002) 771-784). Mechanical devices for CPR: an update. Author: Keith Lurie]. However, when in the head and thorax up position, compressions of the abdomen (abdominal counter pulsation CPR) do not result in increased ICP. Rather, such compressions may increase the amount of circulating blood volume by shifting venous blood from the abdomen into the thorax. The abdominal compressions may be performed manually and/or automatically. For example, a CPR compression band device, such as the Lifestick®, or a continuous pressure with a sand bag and the like, may be positioned against or on the individual's abdomen. The CPR compression band device may then automatically perform the abdominal compressions at a desired rate and/or force.

In some embodiments, the upper support may slide or extend along a longitudinal axis of the elevation device from an initial position over an excursion distance (measured from the initial position) of between about 0 and 2 inches, which may depend on various factors, such as the amount of elevation and/or the size of the individual. The initial position may be measured from a fixed point, such as a pivot point of the upper support. The initial position of the upper support may vary based on the height of the individual, as well as other physiological features of the individual. Such extension may accommodate shifting of the individual during elevation of the head and upper torso.

In some embodiments, the elevation devices described herein may be foldable for easy carrying. For example, the elevation devices may be configured to fold up, much like a briefcase, at or near the axis of rotation of the upper support such that the upper support may be brought in close proximity with the thoracic plate and/or base. In some embodiments, the upper support may be parallel or substantially parallel (such as within 10° of parallel) to the base. In some embodiments, an underside of the base and/or upper support may include a handle that allows the folded elevation device to be carried much like a briefcase. In other embodiments, rather than having a fixed handle, the elevation device may include one or more mounting features, such as clips or snaps, that allow a handle to be attached to the elevation device for transportation while in the folded state. In some embodiments, a lock mechanism or latch may be included to lock the elevation device in the folded and/or unfolded state. In some embodiments the foldable head and thorax elevation CPR device may be folded up in a briefcase and include an automated defibrillator, physiological sensors, and the like.

Specific details are given in the description to provide a thorough understanding of example configurations (including implementations). However, configurations may be practiced without these specific details. For example, well-known processes, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure. Additionally, features described in relation to one embodiment may be incorporated into other embodiments while staying within the scope of the disclosure.

Also, configurations may be described as a process that is depicted as a flow diagram or block diagram. Although each may describe the operations as a sequential process, many of the operations may be performed in parallel or concurrently. In addition, the order of the operations may be rearranged. A process may have additional steps not included in the figure.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An elevation device used in the performance of cardiopulmonary resuscitation (CPR) and after resuscitation, comprising:

a base defining a longitudinal axis and a lateral axis;

an upper support operably coupled to the base, wherein the upper support is configured to incline about the lateral axis at an angle relative to the base to elevate an individual's upper back, shoulders and head such that a central portion of the brain is positioned above the heart and shoulders at all angular positions of the upper support;

a support arm operably coupled with the upper support about the lateral axis or an additional axis that is parallel to the lateral axis, wherein the support arm is independently movable along a curved path to various angular positions about the lateral axis or the additional axis relative to the upper support and is rigidly lockable at a fixed angle about the lateral axis or the additional axis relative to the upper support such that the upper support and the support arm are movable about the lateral axis as a single unit relative to the base while the support arm maintains the angle relative to the upper support; and a chest compression device coupled with the support arm, the chest compression device being configured to compress the chest, wherein the support arm is configured to maintain the chest compression device at an angle that is perpendicular to the individual's sternum.

2. The elevation device used in the performance of cardiopulmonary resuscitation (CPR) and after resuscitation of claim 1, further comprising:

a thoracic plate operably coupled with the base.

3. The elevation device used in the performance of cardiopulmonary resuscitation (CPR) and after resuscitation of claim 2, wherein:

the upper support is configured to, when pivoted, adjust a position of the thoracic plate such that the chest compression device is appropriately aligned with the individual's anterior chest wall.

4. The elevation device used in the performance of cardiopulmonary resuscitation (CPR) and after resuscitation of claim 1, wherein:

the chest compression device comprises one or more of a plunger, a suction cup, or an adhesive band.

5. The elevation device used in the performance of cardiopulmonary resuscitation (CPR) and after resuscitation of claim 1, wherein:

the chest compression device comprises one or both of a motorized crankshaft or a piston; and compressions of the chest compression device are driven by actuation of the one or more of the motorized crankshaft or the piston.

6. The elevation device used in the performance of cardiopulmonary resuscitation (CPR) and after resuscitation of claim 1, wherein:

the chest compression device comprises:

a securement mechanism configured to couple with the individual's chest;

a decompression cable system coupled with the securement mechanism;

a compression strap configured to be positioned against the individual's chest;

a compression cable system; and at least one motor configured to:

tighten the decompression cable system, thereby causing the securement mechanism to pull upward on the individual's chest to actively decompress the individual's chest during a decompression phase of CPR; and tighten the compression cable system, thereby causing the compression strap to be pulled against the individual's chest to actively compress the individual's chest during a compression phase of CPR.

7. The elevation device used in the performance of cardiopulmonary resuscitation (CPR) and after resuscitation of claim 1, wherein:

a position of the chest compression device relative to the support arm is adjustable such that chest compressions may be delivered to individuals of different sizes.

8. The elevation device used in the performance of cardiopulmonary resuscitation (CPR) and after resuscitation of claim 1, wherein:

the chest compression device is further configured to actively decompress the chest.

9. An elevation device used in the performance of cardiopulmonary resuscitation (CPR) and after resuscitation, comprising:

a base configured to be positioned on a surface, the surface being at least substantially aligned with a horizontal plane, the base defining a longitudinal axis and a lateral axis;

an upper support operably coupled to the base, wherein the upper support is configured to move between a storage position and an elevated position, wherein in the elevated position the upper supported is inclined about the lateral axis at an angle relative to the base to elevate an individual's upper back, shoulders such that a central portion of the brain is positioned above the heart and shoulders at all angular positions of the upper support;

a support arm operably coupled with the upper support about the lateral axis or an additional axis that is parallel to the lateral axis such that the support arm is independently positionable along a curved path at different angular locations about the lateral axis or the additional axis relative to the upper support, wherein the support arm is configured to be rigidly locked in a given position about the lateral axis or the additional axis relative to the upper support; and a chest compression device coupled with the support arm, the chest compression device being configured to compress the chest at an angle generally orthogonal to the individual's sternum;

wherein the elevation device is configured such that while the upper support is being moved to the elevated position, the chest compression device remains orthogonal to the individual's sternum.

10. The elevation device used in the performance of cardiopulmonary resuscitation (CPR) and after resuscitation of claim 9, wherein:

in the storage position, the individual's head is elevated between about 3 inches and about 10 inches above the horizontal plane and the individual's shoulders are elevated between about 1 inches and about 3 inches above the horizontal plane.

11. The elevation device used in the performance of cardiopulmonary resuscitation (CPR) and after resuscitation of claim 9, wherein:

the upper support is expandable and contractible lengthwise, during an elevation of the individual; and the upper support is spring biased in a contraction direction.

12. The elevation device used in the performance of cardiopulmonary resuscitation (CPR) and after resuscitation of claim 9, wherein:

the chest compression device is rotatably coupled with the support arm between a stowed position and an active position, wherein in the stowed position the chest compression device is at least substantially aligned in a same plane as the support arm, and wherein in the active position the chest compression device is at least substantially orthogonal to the support arm.

13. The elevation device used in the performance of cardiopulmonary resuscitation (CPR) and after resuscitation of claim 9, wherein the elevation device further comprises:

a thoracic plate pivotally coupled with the base, wherein:

the upper support is configured to, when pivoted, adjust a position of the thoracic plate such that the thoracic plate helps align the chest compression device with the individual's anterior chest wall at a generally orthogonal angle; and the adjustment is less than an angle that the upper support is pivoted.

14. The elevation device used in the performance of cardiopulmonary resuscitation (CPR) and after resuscitation of claim 9, wherein the chest compression device comprises:

a chest compression mechanism; and at least one motor configured to actuate the chest compression mechanism, wherein the at least one motor is disposed within one or more of the base, the support arm, or the chest compression device.

15. The elevation device used in the performance of cardiopulmonary resuscitation (CPR) and after resuscitation of claim 9, wherein:

a size of the support arm adjustable to accommodate individuals of having one or both of different sizes or different ages.

16. The elevation device used in the performance of cardiopulmonary resuscitation (CPR) and after resuscitation of claim 9, wherein:

the chest compression device is further configured to actively decompress the chest.

17. A method of performing cardiopulmonary resuscitation (CPR), comprising:

providing an elevation device comprising:

a base defining a longitudinal axis and a lateral axis;

an upper support operably coupled to the base, wherein the upper support is configured to support a central portion of the brain at a position that is above the heart and shoulders at all angular positions of the upper support relative to the base;

a support arm coupled with the upper support about the lateral axis or an additional axis that is parallel to the lateral axis; and a chest compression device coupled with the support arm, the chest compression device being configured to compress the chest;

positioning the individual on the elevation device;

moving the support arm along a curved path about the lateral axis or the additional axis relative to the upper support to position the chest compression device over the individual's sternum;

locking the support arm at a fixed angle about the lateral axis or the additional axis relative to the upper support such that the upper support and the support arm are movable about the lateral axis as a single unit relative to the base while the support arm maintains the angle relative to the upper support elevating the upper support about the lateral axis to raise the individual's upper torso and head such that the support arm maintains a fixed angle relative to the upper support while maintaining the chest compression device at an angle that is orthogonal to the individual's sternum; and performing one or more of CPR or intrathoracic pressure regulation while elevating the heart and the head.

18. The method of performing cardiopulmonary resuscitation (CPR) of claim 17, wherein:

the elevation device further comprises a thoracic plate operably coupled with the base; and elevating the upper support causes an angle of the thoracic plate to be adjusted relative to the base such that the chest compression device is maintained at a position generally orthogonal to the individual's sternum while a positional relationship between the support arm and the upper support is maintained.

19. The method of performing cardiopulmonary resuscitation (CPR) of claim 17, further comprising:

interfacing an impedance threshold device with the individual's airway.

20. The method of performing cardiopulmonary resuscitation (CPR) of claim 17, further comprising:

adjusting a position of the chest compression device relative to the support arm based on one or more of a size or an age of the individual.

21. The method of performing cardiopulmonary resuscitation (CPR) of claim 17, further comprising:

adjusting a size of the support arm based on one or more of a size or an age of the individual.

22. The method of performing cardiopulmonary resuscitation (CPR) of claim 17, further comprising:

manipulating the chest compression device between a stowed position and an active position, wherein in the stowed position the chest compression device is at least substantially aligned in a same plane as the support arm, and wherein in the active position the chest compression device is at least substantially orthogonal to the support arm.

23. The method of performing cardiopulmonary resuscitation (CPR) of claim 17, wherein:

the chest compression device is further configured to actively decompress the chest; and the method further comprises alternating between compressing the chest and actively decompressing the chest while the individual's head and upper torso are elevated.

* * * * *